US008692859B2

(12) United States Patent
Ohno

(10) Patent No.: US 8,692,859 B2
(45) Date of Patent: Apr. 8, 2014

(54) LIGHT-EMITTING DEVICE, LIGHT-EMITTING ARRAY UNIT, PRINT HEAD, IMAGE FORMING APPARATUS AND LIGHT-EMISSION CONTROL METHOD

(75) Inventor: Seiji Ohno, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 700 days.

(21) Appl. No.: 12/915,914

(22) Filed: Oct. 29, 2010

(65) Prior Publication Data

US 2011/0274465 A1 Nov. 10, 2011

(30) Foreign Application Priority Data

May 10, 2010 (JP) ..... 2010-108736

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/237, 238, 247; 250/205
See application file for complete search history.

(56) References Cited

U.S. PATENT DOCUMENTS

| | | | | |
|---|---|---|---|---|
| 6,657,651 | B2 * | 12/2003 | Ohno | 347/235 |
| 7,330,204 | B2 | 2/2008 | Ohno | |
| 2003/0007063 | A1 | 1/2003 | Ohno | |
| 2003/0058329 | A1 | 3/2003 | Ohno | |
| 2004/0046976 | A1 | 3/2004 | Ohno et al. | |
| 2005/0230704 | A1 | 10/2005 | Ohno | |
| 2007/0296803 | A1 | 12/2007 | Ohno et al. | |
| 2010/0038671 | A1 | 2/2010 | Kondoh | |
| 2010/0045763 | A1 | 2/2010 | Tsuchiya | |
| 2010/0118100 | A1 | 5/2010 | Ohno | |
| 2010/0118108 | A1 | 5/2010 | Ohno | |
| 2010/0225728 | A1 | 9/2010 | Okazaki | |
| 2011/0069132 | A1 | 3/2011 | Ohno | |

FOREIGN PATENT DOCUMENTS

| | | | | |
|---|---|---|---|---|
| EP | 2 184 172 | A1 | 5/2010 | |
| EP | 2 184 649 | A2 | 5/2010 | |
| JP | 09-150542 | A | 6/1997 | |
| JP | 2001-219596 | A | 8/2001 | |
| JP | 2001-253116 | A | 9/2001 | |
| JP | 2001-260410 | A | 9/2001 | |
| JP | 2001253116 | A * | 9/2001 | B41J 2/44 |
| JP | 2001-270150 | A | 10/2001 | |

(Continued)

OTHER PUBLICATIONS

Japanese Office Action dated Oct. 26, 2010 for Japanese patent application No. 2010-108736 and English-language translation.

(Continued)

*Primary Examiner* — Hai C Pham
(74) *Attorney, Agent, or Firm* — Sughrue Mion, PLLC

(57) ABSTRACT

A light-emitting device includes: plural light-emitting array units that each include plural light-emitting elements, and for which lighting up and not lighting up are controlled by using a combination of a selection signal for selecting a control target for lighting up or not lighting up and a light-up signal for supplying power for lighting up to each light-emitting element forming the plural light-emitting elements; a selection signal generating unit that sends plural selection signals including the selection signal to the plural light-emitting array units; and a light-up signal generating unit that sends plural light-up signals including the light-up signal to the plural light-emitting array units.

13 Claims, 24 Drawing Sheets

(56) References Cited

FOREIGN PATENT DOCUMENTS

| | | | |
|---|---|---|---|
| JP | 2001-301231 | A | 10/2001 |
| JP | 2002-111063 | A | 4/2002 |
| JP | 2004-181741 | A | 7/2004 |
| JP | 2006-088465 | A | 4/2006 |
| JP | 2007-268895 | A | 10/2007 |
| JP | 2008-126589 | A | 6/2008 |
| JP | 2009-101712 | A | 5/2009 |
| JP | 2009-190405 | A | 8/2009 |
| JP | 2009-262419 | A | 11/2009 |
| JP | 2010-045230 | A | 2/2010 |
| TW | 200605347 | A | 4/2005 |

OTHER PUBLICATIONS

Extended European Search Report for European Patent Application No. 10192791.1 dated Jan. 25, 2012.

Japanese Office Action issued Jun. 26, 2012 in corresponding Japanese Patent Application No. 2011-126327.

Japanese Office Action issued on Jul. 6, 2010 Japanese Patent Appln. JP 2010-108736.

Extended Search Report for patent application No. 10192714.3; mailed Sep. 1, 2011.

* cited by examiner

S-A
80
102
φ1
φ1
φW
φ2
Vga

S-B
80
102
φ1
φ1
φW
φ2
Vga 65
62
63
SECOND SCANNING DIRECTION
FIRST SCANNING DIRECTION
φW20
φW5
φW4
φW3
φW2
φW1
φIa
φ2
φ1
Vga
Vsub
φIb
150
140a
120
140b
224
209
208
207
206
205
204a
202
201
200b
200a
204b
110
S-A1
S-A2
S-A3
S-A4
S-A5
S-B1
S-B2
S-B3
S-B4
S-B5
#a
#b
RI SECOND SCANNING DIRECTION
FIRST SCANNING DIRECTION
62
63
65
80
102
S
Vga
φ2
φW
φIl
φ1
φIr
Sa1
Sa2
Sa3
Sa4
Sa5
Sb1
Sb2
Sb3
Sb4
Sb5
RI
224a
209a
208a
207a
206a
205a
204a
202a
201a
200b
200a
204b
205b
206b
207b
208b
224b
φWa20
φWa5
φWa4
φWa3
φWa2
φWa1
φIl
φ2
φ1
Vga
Vsub
φIr
φWb1
φWb2
φWb3
φWb4
φWb20
150a
140l
120
110
140r
150b S-A
80
102
φ1 φ12
φ2 φW φI1
Vga S-B
80
102
φ1 φ12
φ2 φW φI1
Vga 65
62
63
SECOND SCANNING DIRECTION
FIRST SCANNING DIRECTION
S-A1
S-A2
S-A3
S-A4
S-A5
S-B1
S-B2
S-B3
S-B4
S-B5
#a
#b
RI
224
209
208
207
206
205
204a
202a
201a
200b
200a
204b
φW20
φW5
φW4
φW3
φW2
φW1
φIa
φ2
φ1
Vga
Vsub
φIb
150
140a
120
110
140b SECOND SCANNING DIRECTION
FIRST SCANNING DIRECTION
62
63
65
80
102
S
Vga
φ2
φW
φI1
φ1
φI2
Sa1
Sa2
Sa3
Sa4
Sa5
Sb1
Sb2
Sb3
Sb4
Sb5
RI
224a
209a
208a
207a
206a
205a
204a
202a
201a
200b
200a
204b
205b
206b
207b
208b
224b
φWa20
φWa5
φWa4
φWa3
φWa2
φWa1
φIa
φ2
φ1
Vga
Vsub
φIb
φWb1
φWb2
φWb3
φWb4
φWb20
150a
140a
120
110
140b
150b

LIGHT-EMITTING DEVICE, LIGHT-EMITTING ARRAY UNIT, PRINT HEAD, IMAGE FORMING APPARATUS AND LIGHT-EMISSION CONTROL METHOD

CROSS REFERENCE TO RELATED APPLICATIONS

This application is based on and claims priority under 35 USC §119 from Japanese Patent Application No. 2010-108736 filed May 10, 2010.

BACKGROUND

1. Technical Field

The present invention relates to a light-emitting device, a light-emitting array unit, a print head, an image forming apparatus and a light-emission control method.

2. Related Art

In an electrophotographic image forming apparatus such as a printer, a copy machine or a facsimile machine, an image is formed on a recording sheet as follows. Firstly, an electrostatic latent image is formed on a uniformly charged photoconductor by causing an optical recording unit to emit light so as to transfer image information onto the photoconductor. Then, the electrostatic latent image is made visible by being developed with toner. Lastly, the toner image is transferred on and fixed to the recording sheet. In addition to an optical-scanning recording unit that performs exposure by laser scanning in the first scanning direction using a laser beam, a recording device using the following LED print head (LPH) has been employed as such an optical recording unit in recent years in response to demand for downsizing the apparatus. This LPH includes a large number of light-emitting diodes (LEDs), serving as light-emitting elements, arrayed in the first scanning direction.

SUMMARY

According to an aspect of the present invention, there is provided a light-emitting device including: plural light-emitting array units that each include plural light-emitting elements, and for which lighting up and not lighting up are controlled by using a combination of a selection signal for selecting a control target for lighting up or not lighting up and a light-up signal for supplying power for lighting up to each light-emitting element forming the plural light-emitting elements; a selection signal generating unit that sends plural selection signals including the selection signal to the plural light-emitting array units; and a light-up signal generating unit that sends plural light-up signals including the light-up signal to the plural light-emitting array units.

BRIEF DESCRIPTION OF THE DRAWINGS

An Exemplary embodiment of the present invention will be described in detail based on the following figures, wherein.

DETAILED DESCRIPTION

Hereinafter, a description will be given of an exemplary embodiment of the present invention in detail with reference to the accompanying drawings.

First Exemplary Embodiment

Figure 1:
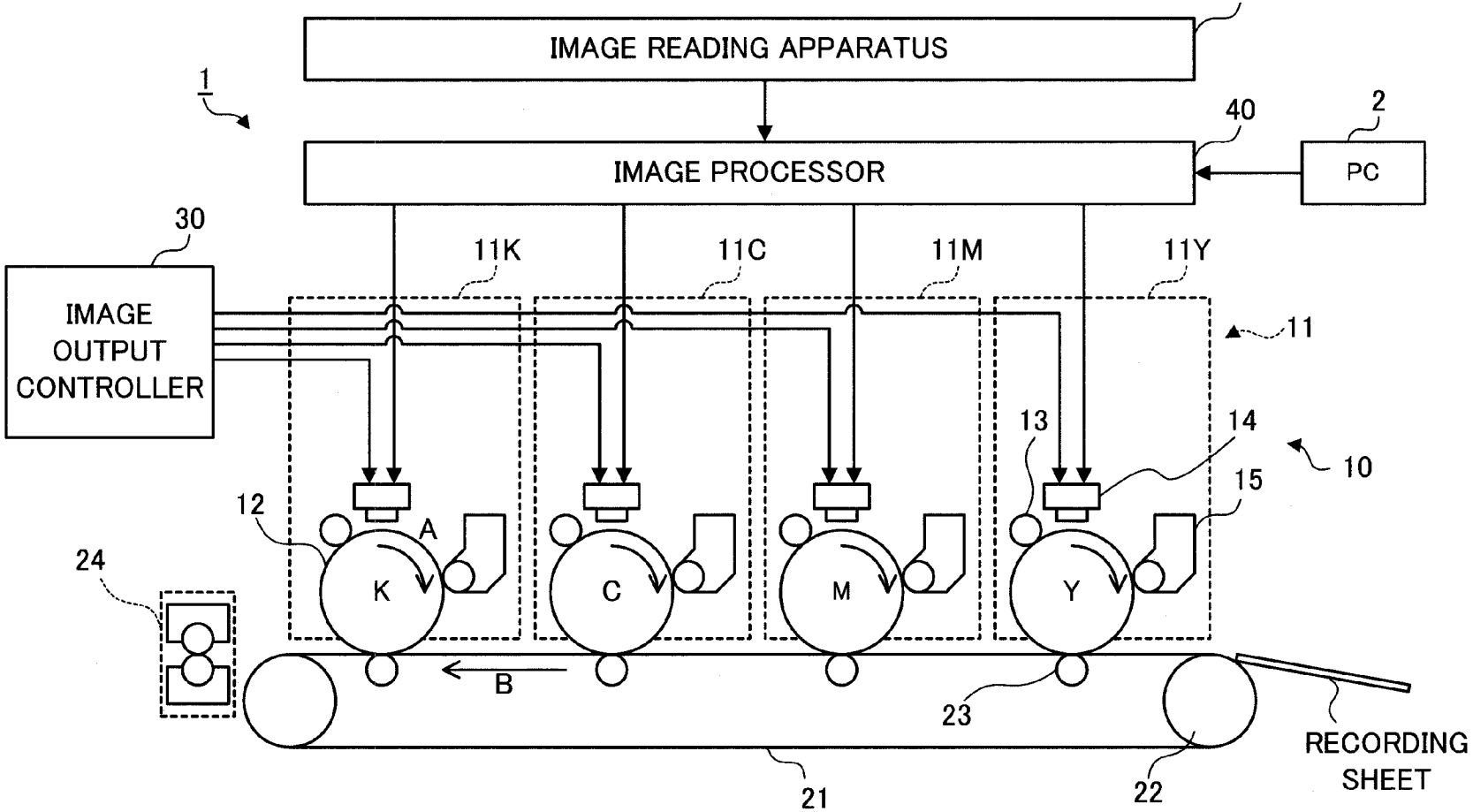
FIG. 1 is a diagram showing an example of an overall configuration of an image forming apparatus to which the first exemplary embodiment is applied.

FIG. 1 is a diagram showing an example of an overall configuration of an image forming apparatus 1 to which the first exemplary embodiment is applied. The image forming apparatus 1 shown in FIG. 1 is what is generally termed as a tandem image forming apparatus. The image forming apparatus 1 includes an image forming process unit 10, an image output controller 30 and an image processor 40. The image forming process unit 10 forms an image in accordance with different color image data. The image output controller 30 controls the image forming process unit 10. The image processor 40, which is connected to devices such as a personal computer (PC) 2 and an image reading apparatus 3, performs predefined image processing on image data received from the above devices.

The image forming process unit 10 includes image forming units 11 formed of plural engines arranged in parallel at intervals set in advance. The image forming units 11 are formed of four image forming units 11Y, 11M, 11C and 11K. Each of the image forming units 11Y, 11M, 11C and 11K includes a photoconductive drum 12, a charging device 13, a print head 14 and a developing device 15. On the photoconductive drum 12, which is an example of an image carrier, an electrostatic latent image is formed, and the photoconductive drum 12 retains a toner image. The charging device 13, as an example of a charging unit, charges the surface of the photoconductive drum 12 at a predetermined potential. The print head 14 exposes the photoconductive drum 12 charged by the charging device 13. The developing device 15, as an example of a developing unit, develops an electrostatic latent image formed by the print head 14. Here, the image forming units 11Y, 11M, 11C and 11K have approximately the same configuration excluding colors of toner put in the developing devices 15. The image forming units 11Y, 11M, 11C and 11K form yellow (Y), magenta (M), cyan (C) and black (K) toner images, respectively.

In addition, the image forming process unit 10 further includes a sheet transport belt 21, a drive roll 22, transfer rolls 23 and a fixing device 24. The sheet transport belt 21 transports a recording sheet as a transferred body so that different color toner images respectively formed on the photoconductive drums 12 of the image forming units 11Y, 11M, 11C and 11K are transferred on the recording sheet by multilayer transfer. The drive roll 22 is a roll that drives the sheet transport belt 21. Each transfer roll 23, as an example of a transfer unit, transfers a toner image formed on the corresponding photoconductive drum 12 onto the recording sheet. The fixing device 24 fixes the toner images on the recording sheet.

In this image forming apparatus 1, the image forming process unit 10 performs an image forming operation on the basis of various kinds of control signals supplied from the image output controller 30. Under the control by the image output controller 30, the image data received from the personal computer (PC) 2 or the image reading apparatus 3 is subjected to image processing by the image processor 40, and then the resultant data is supplied to the corresponding image forming unit 11. Then, for example in the black (K) color image forming unit 11K, the photoconductive drum 12 is charged at a predetermined potential by the charging device 13 while rotating in an arrow A direction, and then is exposed by the print head 14 emitting light on the basis of the image data supplied from the image processor 40. By this operation, the electrostatic latent image for the black (K) color image is formed on the photoconductive drum 12. Thereafter, the electrostatic latent image formed on the photoconductive drum 12 is developed by the developing device 15, and accordingly the black (K) color toner image is formed on the photoconductive drum 12. Similarly, yellow (Y), magenta (M) and cyan (C) color toner images are formed in the image forming units 11Y, 11M and 11C, respectively.

The respective color toner images on the photoconductive drums 12, which are formed in the respective image forming units 11, are electrostatically transferred to the recording sheet supplied with the movement of the sheet transport belt 21 by a transfer electric field applied to the transfer rolls 23, in sequence. Here, the sheet transport belt 21 moves in an arrow B direction. By this operation, a synthetic toner image, which is superimposed color-toner images, is formed on the recording sheet.

Thereafter, the recording sheet on which the synthetic toner image is electrostatically transferred is transported to the fixing device 24. The synthetic toner image on the recording sheet transported to the fixing device 24 is fixed on the recording sheet through fixing processing using heat and pressure by the fixing device 24, and then is outputted from the image forming apparatus 1.

Figure 2:
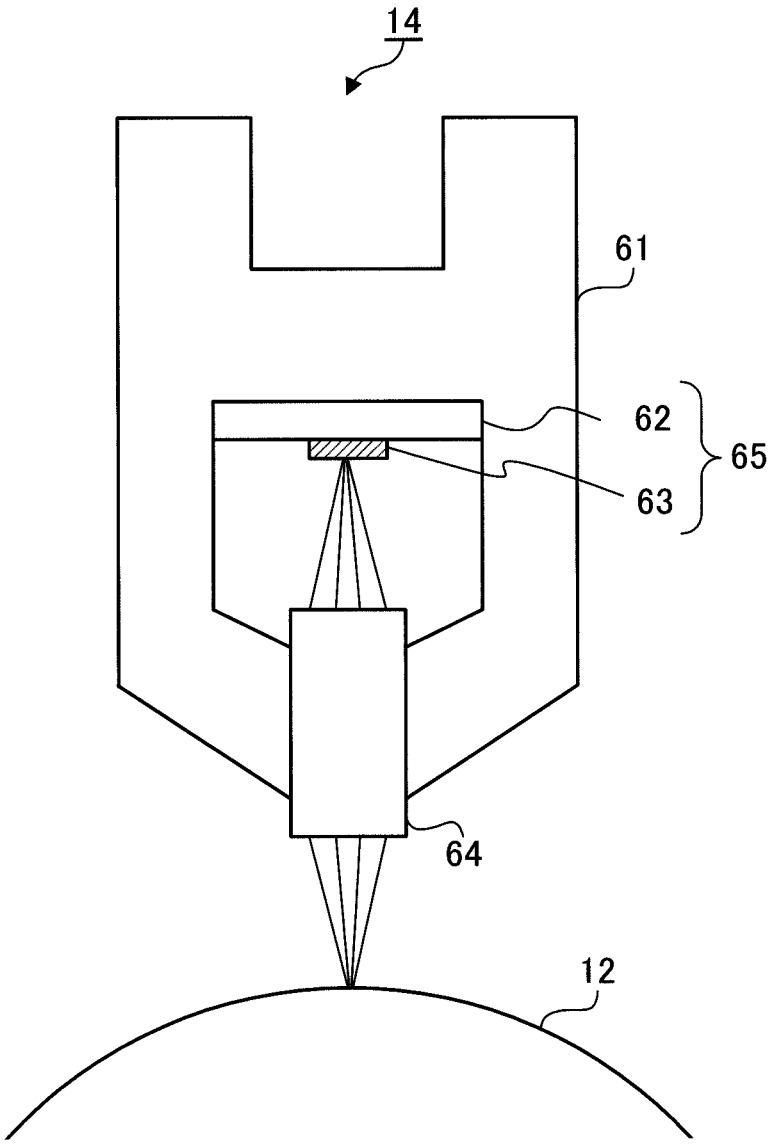
FIG. 2 is a cross-sectional diagram showing a structure of the print head.

FIG. 2 is a cross-sectional diagram showing a structure of the print head 14. The print head 14 includes a housing 61, a light-emitting device 65 and a rod lens array 64. The light-emitting device 65, as an example of an exposure unit, includes a light-emitting portion 63 formed of plural light-emitting elements (light-emitting thyristors in the first exemplary embodiment) that exposes the photoconductive drum 12. The rod lens array 64, as an example of an optical unit, focuses light emitted by the light-emitting portion 63 onto the surface of the photoconductive drum 12.

The light-emitting device 65 also includes a circuit board 62 on which the light-emitting portion 63, a signal generating circuit 110 (see FIG. 3 to be described later) driving the light-emitting portion 63, and the like are mounted.

The housing 61 is made of metal, for example, and supports the circuit board 62 and the rod lens array 64. The housing 61 is set so that the light-emitting points of the light-emitting elements in the light-emitting portions 63 are located on the focal plane of the rod lens array 64. In addition, the rod lens array 64 is arranged along an axial direction of the photoconductive drum 12 (the first scanning direction).

Figure 3:
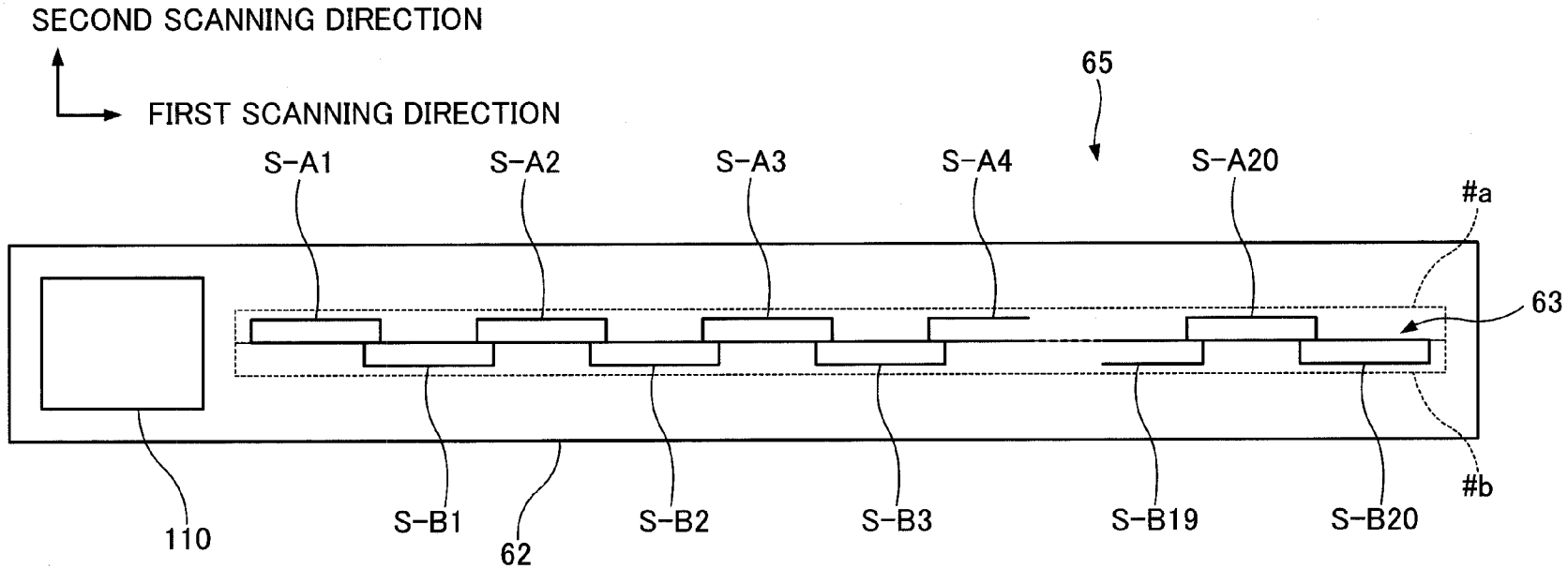
FIG. 3 is a top view of the light-emitting device in the first exemplary embodiment.

FIG. 3 is a top view of the light-emitting device 65 in the first exemplary embodiment.

As FIG. 3 shows, in the light-emitting device 65 according to the first exemplary embodiment, the light-emitting portion 63 is configured with twenty light-emitting array units S-A1 to S-A20 (a light-emitting array unit group #a) and also twenty light-emitting array units S-B1 to S-B20 (a light-emitting array unit group #b) which are arranged on the circuit board 62 in two lines in the first scanning direction in a staggered manner. In other words, in the first exemplary embodiment, there are the two light-emitting array unit groups (the light-emitting array unit group #a and the light-emitting array unit group #b). Herein, each light-emitting array unit group is sometimes referred to simply as a group.

Note that how the light-emitting array unit group #a and the light-emitting array unit group #b face each other will be described in detail later.

In addition, as described earlier, the light-emitting device 65 has the signal generating circuit 110 that drives the light-emitting portion 63.

The light-emitting array units S-A1 to S-A20 and the light-emitting array units S-B1 to S-B20 have different configurations as will be described later. Thus, when not differentiated from one another, the light-emitting array units S-A1 to S-A20 are called light-emitting array units S-A. Likewise, when not differentiated from one another, the light-emitting array units S-B1 to S-B20 are called light-emitting array units S-B.

Note that each of the light-emitting array units S-A and S-B may be a light-emitting chip configured by forming light-emitting elements and the like on a substrate 80. In the following, the light-emitting array units S-A and S-B are described as being light-emitting chips. Although the number of the light-emitting array units S-A and the number of the light-emitting array units S-B are each twenty here, the number of arrays are not limited to this.

Figures 4A, 4B, 4C:
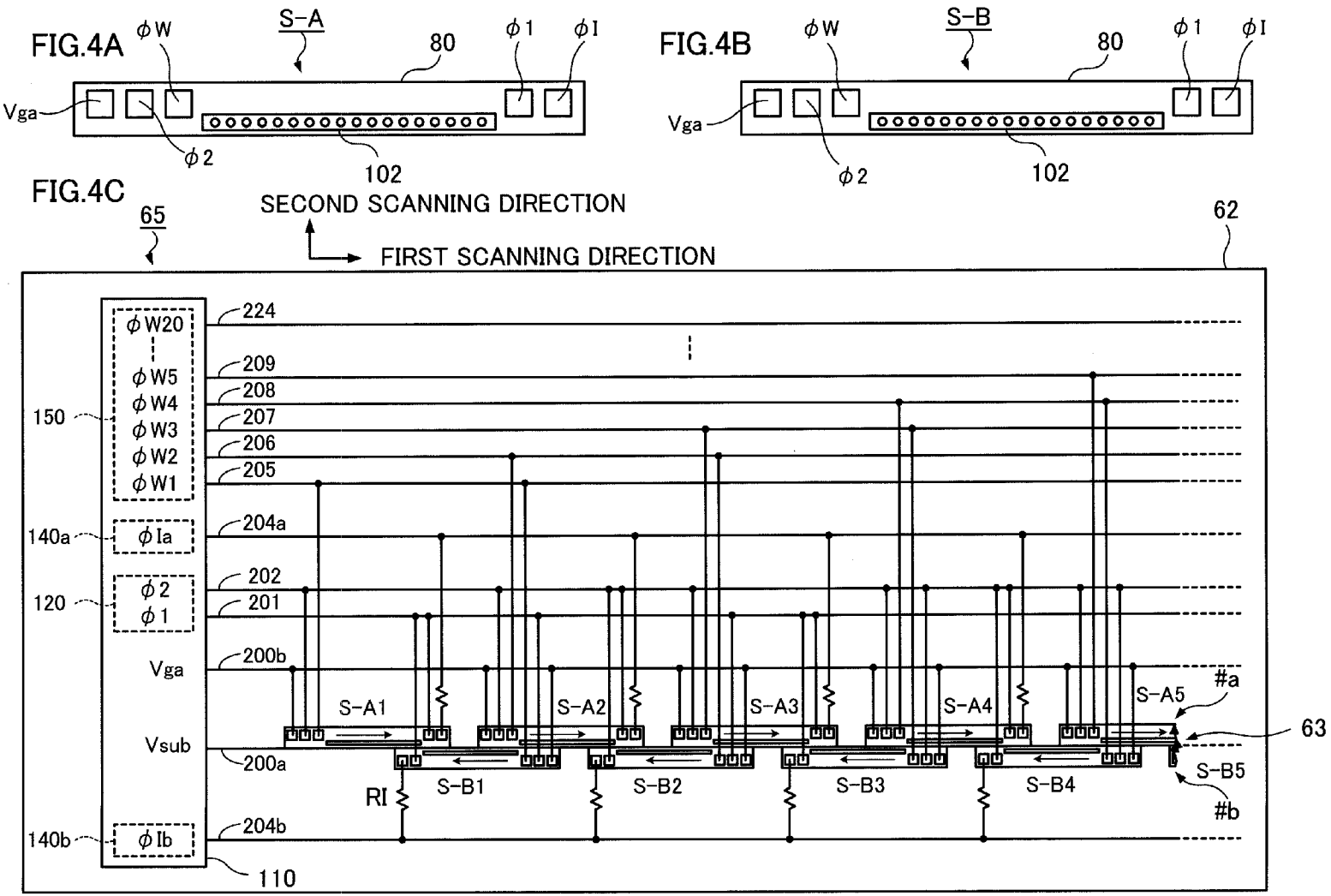
FIGS. 4A to 4C are diagrams showing configurations of the light-emitting array units, a configuration of the signal generating circuit of the light-emitting device, and a wiring configuration on the circuit board, in the first exemplary embodiment.

FIGS. 4A to 4C are diagrams showing configurations of the light-emitting array units S-A and S-B, a configuration of the signal generating circuit 110 of the light-emitting device 65, and a wiring configuration on the circuit board 62, in the first exemplary embodiment. FIG. 4A shows a configuration of the light-emitting array unit S-A, and FIG. 4B shows a configuration of the light-emitting array unit S-B. FIG. 4C shows a configuration of the signal generating circuit 110 of the light-emitting device 65 and a wiring configuration on the circuit board 62. In the first exemplary embodiment, the light-emitting array units S-A1 to S-A20 belong to the light-emitting array unit group #a, and the light-emitting array units S-B1 to S-B20 belong to the light-emitting array unit group #b.

First, a description is given of a configuration of the light-emitting array unit S-A shown in FIG. 4A and a configuration of the light-emitting array unit S-B shown in FIG. 4B.

Each of the light-emitting array units S-A and S-B includes a light-emitting element array 102 on the rectangular substrate 80. The light-emitting element array 102 has multiple light-emitting elements (light-emitting thyristors in the first exemplary embodiment) that are arranged in line along a long side of the substrate 80, closely to the long side. In addition, each of the light-emitting array units S-A and S-B includes multiple input terminals (a Vga terminal, a $\phi$2 terminal, a $\phi$W terminal, a $\phi$1 terminal, and a $\phi$I terminal) at both end portions, in a long-side direction, of the substrate 80. These input terminals are bonding pads for reading various control signals and the like. These input terminals are arranged in such a manner that the Vga terminal, the $\phi$2 terminal, and the $\phi$W terminal are arranged in this order from one end portion of the substrate 80, and the $\phi$I terminal and the $\phi$1 terminal are arranged in this order from the other end of the substrate 80. The light-emitting element array 102 is provided between the $\phi$W terminal and the $\phi$1 terminal.

Figure 6:
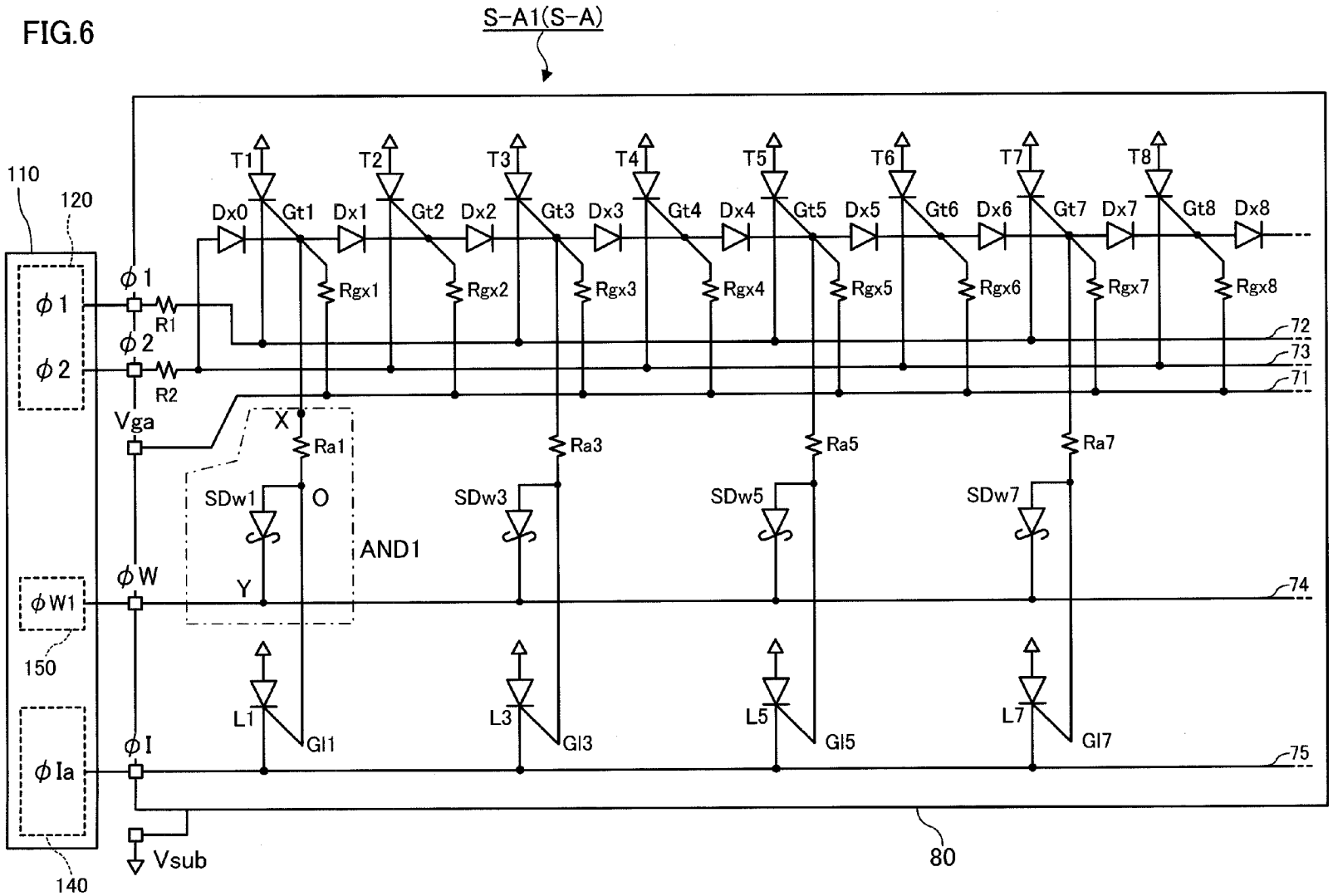
FIG. 6 is an equivalent circuit diagram for illustrating a circuit configuration of the light-emitting array unit in the first exemplary embodiment.
Figure 7:
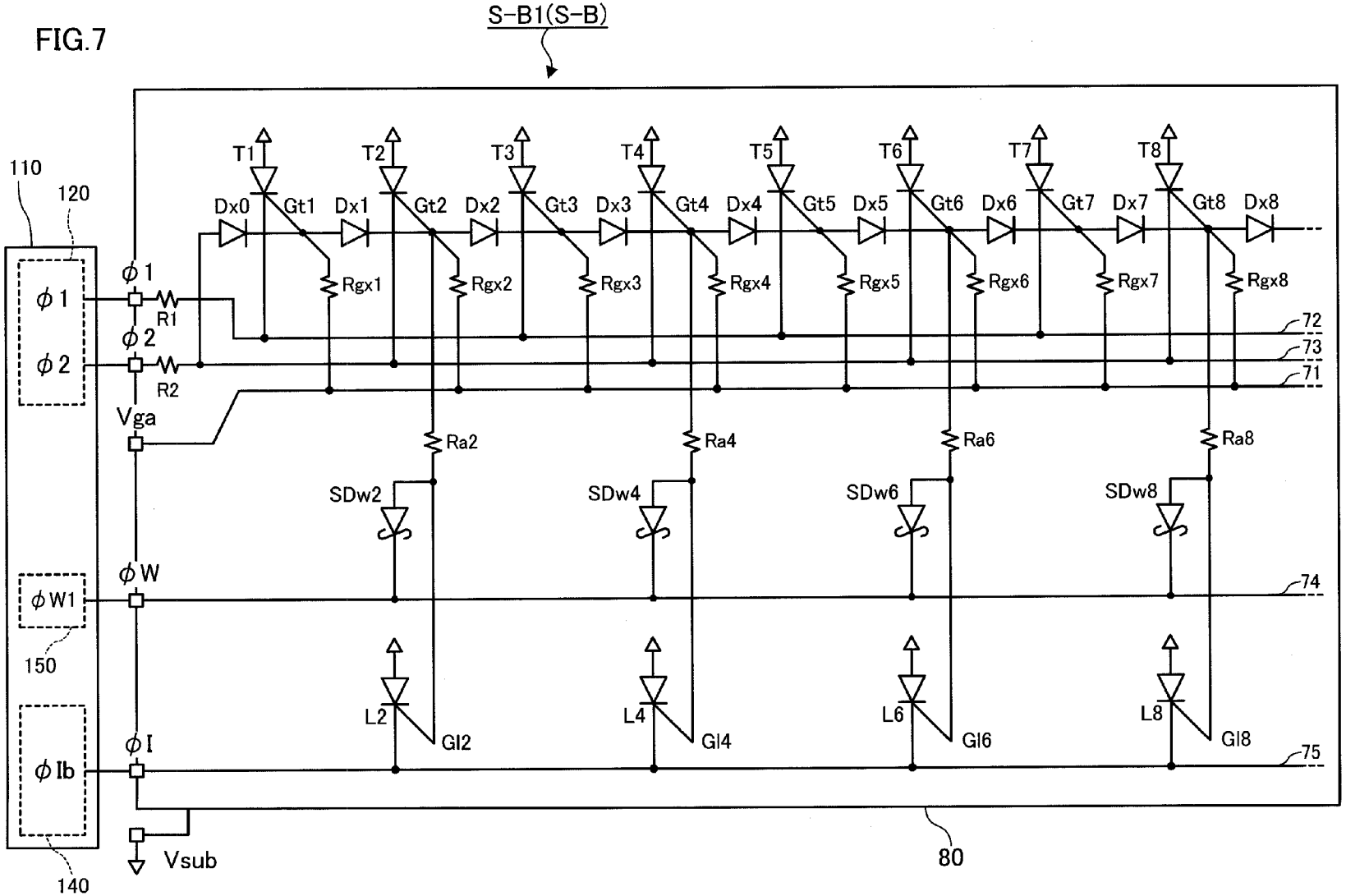
FIG. 7 is an equivalent circuit diagram for illustrating a circuit configuration of the light-emitting array unit in the first exemplary embodiment.

As FIGS. 4A and 4B show, the light-emitting array units S-A and the light-emitting array units S-B have the same outer shape and configuration of the input terminals. However, as shown in FIGS. 6 and 7 to be described later, the light-emitting array units S-A and S-B are self-scanning light-emitting device arrays (SLED) having different circuit configurations from each other.

Next, using FIG. 4C, a configuration of the signal generating circuit 110 of the light-emitting device 65 and a wiring configuration on the circuit board 62 are described.

As described earlier, the circuit board 62 of the light-emitting device 65 has the signal generating circuit 110, the light-emitting array units S-A (the light-emitting array units S-A1 to S-A20), and the light-emitting array units S-B (the light-emitting array units S-B1 to S-B20). Wirings are provided to connect the signal generating circuit 110 to the light-emitting array units S-A1 to S-A20 and to the light-emitting array units S-B1 to S-B20.

First, a configuration of the signal generating circuit 110 is described.

Although not shown, image data after an image process and various control signals are inputted to the signal generating circuit 110 from the image output controller 30 and the image processor 40 (see FIG. 1). Based on the image data and various control signals, the signal generating circuit 110 performs re-arrangement, light-amount correction, and the like on the image data.

The signal generating circuit 110 includes a transfer signal generating part 120 that sends, based on the various control signals, a first transfer signal $\phi$1 and a second transfer signal $\phi$2 to the light-emitting array unit group #a (the light-emitting array units S-A1 to S-A20) and to the light-emitting array unit group #b (the light-emitting array units S-B1 to S-B20).

In addition, the signal generating circuit 110 includes a light-up signal generating part 140*a* and a light-up signal generating part 140*b*. Based on the various control signals, the light-up signal generating part 140*a* sends a light-up signal $\phi$Ia to the light-emitting array unit group #a (the light-emitting array units S-A1 to S-A20), and the light-up signal generating part 140*b* sends a light-up signal $\phi$Ib to the light-emitting array unit group #b (the light-emitting array units S-B1 to S-B20).

Moreover, the signal generating circuit 110 includes a selection signal generating part 150 that sends, based on the various control signals, selection signals $\phi$W1 to $\phi$W20 to respective light-emitting array unit classes each including one light-emitting array unit S-A belonging to the light-emitting array unit group #a and one light-emitting array unit S-B belonging to the light-emitting array unit group #b. Herein, the light-emitting array class is sometimes referred to simply as a pair.

For example, the selection signal generating part 150 sends the selection signal $\phi$W1 to a light-emitting array unit class #1 formed by the light-emitting array unit S-A1 belonging to the light-emitting array unit group #a and the light-emitting array unit S-B1 belonging to the light-emitting array unit group #b. The selection signal generating part 150 sends the selection signal $\phi$W2 to a light-emitting array unit class #2 formed by the light-emitting array unit S-A2 belonging to the light-emitting array unit group #a and the light-emitting array unit S-B2 belonging to the light-emitting array unit group #b. In the same manner for the rest of the pairs, the selection signal generating part 150 sends the selection signal $\phi$W20 to a light-emitting array unit class #20 formed by the light-emitting array unit S-A20 belonging to the light-emitting array unit group #a and the light-emitting array unit S-B20 belonging to the light-emitting array unit group #b.

Although shown separately in FIG. 4C, the light-up signal generating part 140*a* and the light-up signal generating part 140*b* are collectively called a light-up signal generating part 140. When not differentiated from each other, the light-up signal $\phi$Ia and the light-up signal $\phi$Ib are called a light-up signal $\phi$I. When not differentiated from one another, the selection signals $\phi$W1 to $\phi$W20 are called a selection signal $\phi$W.

Next, a description is given of arrangement of the light-emitting array units S-A1 to S-A20 and the light-emitting array units S-B1 to S-B20.

The light-emitting array units S-A1 to S-A20 belonging to the light-emitting array unit group #a are arranged in one line at predetermined intervals in the direction of their long sides. Likewise, the light-emitting array units S-B1 to S-B20 belonging to the light-emitting array unit group #b are arranged in one line at predetermined intervals in the direction of their long sides. The light-emitting array units S-A1 to S-A20 belonging to the light-emitting array unit group #a and the light-emitting array units S-B1 to S-B20 belonging to the light-emitting array unit group #b face each other and are arranged in a staggered manner so that the light-emitting elements may be arranged at predetermined intervals in the first scanning direction.

A description is given of wirings that connect the signal generating circuit 110 to the light-emitting array units S-A (the light-emitting array units S-A1 to S-A20) and to the light-emitting array units S-B (the light-emitting array units S-B1 to S-B20).

The circuit board 62 is provided with a power supply line 200*a* which is connected to a Vsub terminal (see FIGS. 6 to 8A to be described later) provided on a side opposite to the side having the light-emitting array units S-A and S-B and through which a reference potential Vsub is supplied. In addition, the circuit board 62 is provided with a power supply line 200*b* which is connected to a Vga terminal provided to each of the light-emitting array units S-A and S-B and through which a power supply potential Vga for power supply is supplied.

Moreover, the circuit board 62 is provided with a first transfer signal line 201 and a second transfer signal line 202. From the transfer signal generating part 120 of the signal generating circuit 110, the first transfer signal ϕ1 is sent through the first transfer signal line 201 to the ϕ1 terminal of each of the light-emitting array units S-A1 to S-A20 of the light-emitting array unit group #a, and the second transfer signal ϕ2 is sent through the second transfer signal line 202 to the ϕ2 terminal of each of the light-emitting array units S-B1 to S-B20 of the light-emitting array unit group #b. The first transfer signal ϕ1 and the second transfer signal ϕ2 are sent commonly (in parallel) to the light-emitting array units S-A1 to S-A20 of the light-emitting array unit group #a and to the light-emitting array units S-B1 to S-B20 of the light-emitting array unit group #b.

Further, the circuit board 62 is provided with a light-up signal line 204*a* through which the light-up signal ϕIa from the light-up signal generating part 140*a* of the signal generating circuit 110 is sent to the ϕI terminal of each of the light-emitting array units S-A1 to S-A20 of the light-emitting array unit group #a. The light-up signal ϕIa is sent commonly (in parallel) to the light-emitting array units S-A1 to S-A20 of the light-emitting array unit group #a through current limitation resistors RI provided for the respective light-emitting array units S-A1 to S-A20.

Likewise, the circuit board 62 is provided with a light-up signal line 204*b* through which a light-up signal ϕIb from the light-up signal generating part 140*b* of the signal generating circuit 110 is sent to the ϕI terminal of each of the light-emitting array units S-B1 to S-B20 of the light-emitting array unit group #b. The light-up signal ϕIb is sent commonly (in parallel) to the light-emitting array units S-B1 to S-B20 of the light-emitting array unit group #b through current limitation resistors RI provided for the respective light-emitting array units S-B1 to S-B20.

Furthermore, the circuit board 62 is provided with selection signal lines 205 to 224 through which the selection signals ϕW1 to ϕW20 are sent from the selection signal generating part 150 of the signal generating circuit 110 to the respective light-emitting array unit classes each including one light-emitting array unit S-A belonging to the light-emitting array unit group #a and one light-emitting array unit S-B belonging to the light-emitting array unit group #b.

For example, the selection signal line 205 is connected to the ϕW terminal, which is an example of a control terminal, of the light-emitting array unit S-A1 of the light-emitting array unit group #a and to the ϕW terminal, which is an example of the control terminal, of the light-emitting array unit S-B1 of the light-emitting array unit group #b. Through the selection signal line 205, the selection signal ϕW1 is sent to the light-emitting array unit class #1 including the light-emitting array units S-A1 and the light-emitting array units S-B1. The selection signal line 206 is connected to the ϕW terminal of the light-emitting array unit S-A2 of the light-emitting array unit group #a and to the ϕW terminal of the light-emitting array unit S-B2 of the light-emitting array unit group #b to send the selection signal ϕW2 to the light-emitting array unit class #2 including the light-emitting array units S-A2 and the light-emitting array units S-B2. In the same manner for the rest of the pairs, the selection signal line 224 is connected to the ϕW terminal of the light-emitting array unit S-A20 of the light-emitting array unit group #a and to the ϕW terminal of the light-emitting array unit S-B20 of the light-emitting array unit group #b to send the selection signal ϕW20 to the light-emitting array unit class #20 including the light-emitting array units S-A20 and the light-emitting array units S-B20.

As described above, all of the light-emitting array units S-A and S-B on the circuit board 62 are commonly supplied with the reference potential Vsub and the power supply potential Vga. Likewise, all of the light-emitting array units S-A and S-B on the circuit board 62 are commonly supplied with the first transfer signal ϕ1 and the second transfer signal ϕ2.

The light-up signal ϕIa is sent commonly to all of the light-emitting array units S-A of the light-emitting array unit group #a. The light-up signal ϕIb is sent commonly to all of the light-emitting array units S-B of the light-emitting array unit group #b.

The selection signals ϕW1 to ϕW20 are sent commonly to the respective light-emitting array unit classes #1 to #20 each including one light-emitting array unit S-A belonging to the light-emitting array unit group #a and one light-emitting array unit S-B belonging to the light-emitting array unit group #b.

Figure 5:
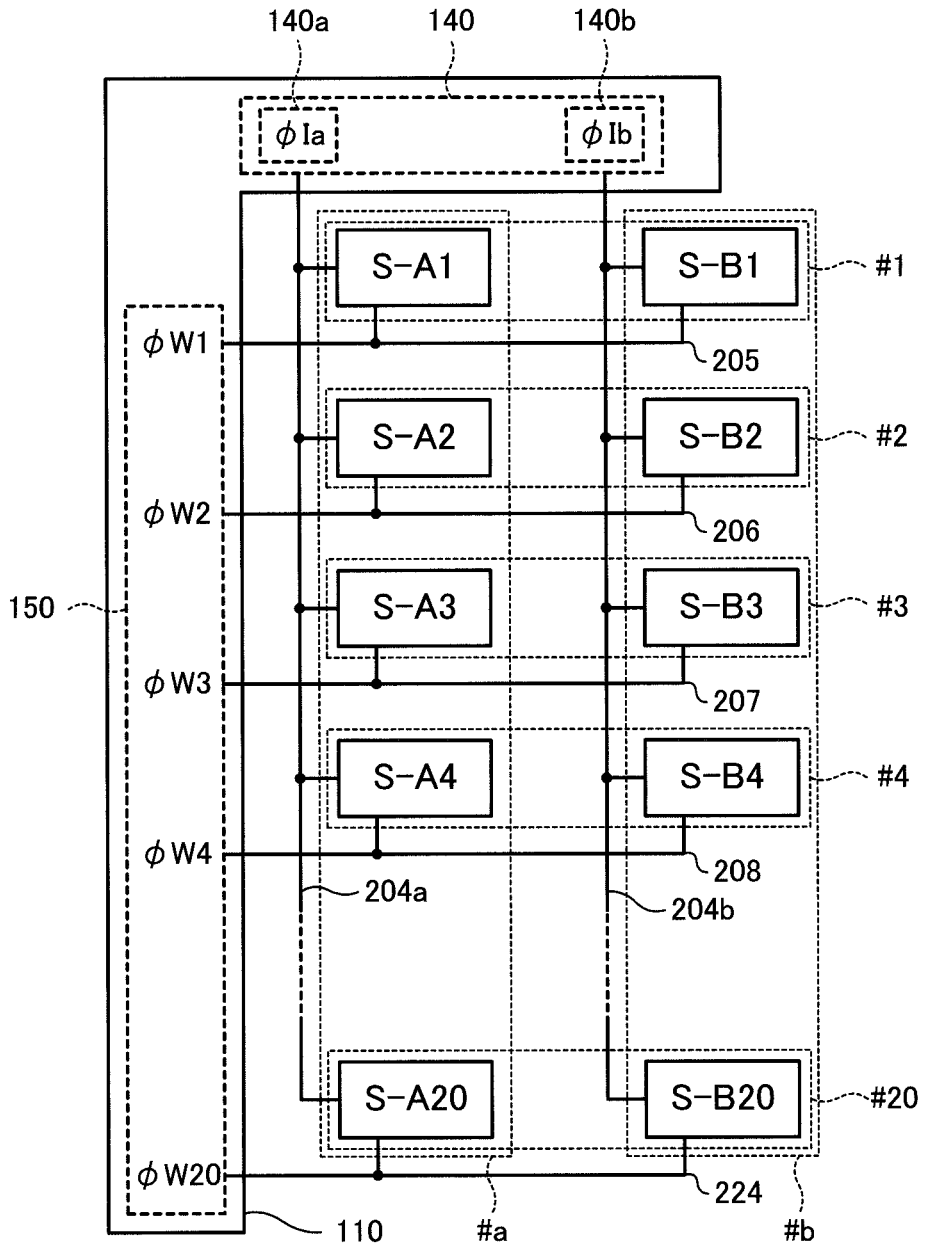
FIG. 5 is a diagram showing the light-emitting array units on the circuit board of the light-emitting device in the first exemplary embodiment, arranged as matrix elements.

FIG. 5 is a diagram showing the light-emitting array units S-A and S-B on the circuit board 62 of the light-emitting device 65 in the first exemplary embodiment, arranged as matrix elements.

In FIG. 5, the light-emitting array units S-A (the light-emitting array units S-A1 to S-A20) and the light-emitting array units S-B (the light-emitting array units S-B1 to S-B20) are arranged as elements in a matrix of 2×20. FIG. 5 shows only lines for signals (the light-up signals ϕIa and ϕIb and the selection signals ϕW1 to ϕW20) that connect the above-described signal generating circuit 110 to the light-emitting array units S-A (the light-emitting array units S-A1 to S-A20) and to the light-emitting array units S-B (the light-emitting array units S-B1 to S-B20). The power supply lines 200*a* and 200*b*, the first transfer signal line 201, and the second transfer signal line 202 are common to all of the light-emitting array units S-A and S-B, and are therefore not shown here.

It is easily understandable that, as described earlier, the light-up signal ϕIa is sent commonly to the light-emitting array units S-A of the light-emitting array unit group #a, and the light-up signal ϕIb is sent commonly to the light-emitting array units S-B of the light-emitting array unit group #b.

Moreover, it is easily understandable that the selection signals ϕW1 to ϕW20 are sent commonly to the respective light-emitting array unit classes #1 to #20 each including one light-emitting array unit S-A belonging to the light-emitting array unit group #a and one light-emitting array unit S-B belonging to the light-emitting array unit group #b.

In other words, each of the light-emitting array units S-A and S-B of the light-emitting device 65 in the first exemplary embodiment is selected according to a combination of the light-up signal ϕIa or ϕIb and one of the selection signal ϕW1 to ϕW20.

Here, the number of wirings is described.

Suppose that the first exemplary embodiment is not employed and that the light-emitting array units S-A and S-B of the light-emitting device 65 are not divided into the light-emitting array unit groups and into the light-emitting array unit pairs. Then, the light-up signal ϕI is sent to each of the light-emitting array units S-A and S-B which are forty in total here; therefore, forty light-up signal lines 204 (corresponding to the light-up signal lines 204*a* and 204*b* in FIG. 5) are needed. In addition, the first transfer signal line 201, the second transfer signal line 202, and the power supply lines 200*a* and 200*b* are needed. Accordingly, the number of wirings provided to the light-emitting device 65 is forty-four.

Moreover, since a current for lighting up light-emitting elements is sent through the light-up signal line 204, the light-up signal line 204 needs to have a small resistance. Accordingly, the light-up signal line 204 requires a wide wiring. For that reason, if the first exemplary embodiment is not employed, many wide wirings are provided on the circuit board 62 of the light-emitting device 65, which increases the area of the circuit board 62.

In the first exemplary embodiment, on the other hand, there are two groups of light-emitting array units, as shown in FIGS. 4A to 5. Accordingly, there are two light-up signal lines 204*a* and 204*b*. Further, the selection signal lines 205 to 224 for the selection signals ϕW1 to ϕW20 are needed in addition to the first transfer signal line 201, the second transfer signal line 202, and the power supply lines 200*a* and 200*b*. Accordingly, in the first exemplary embodiment, the number of wirings is twenty-six.

The number of wirings in the first exemplary embodiment is ⅔ or less of that in the case of not employing the first exemplary embodiment.

Furthermore, in the first exemplary embodiment, the number of wide wirings used for sending a current for lighting up the light-emitting elements is reduced to two, namely, the light-up signal lines 204*a* and 204*b*. Note that a large current does not flow through the selection signal lines 205 to 224. Accordingly, the selection signal lines 205 to 224 do not require wide wirings. For those reasons, the first exemplary embodiment does not require many wide wirings to be provided on the circuit board 62, which prevents an increase in the area of the circuit board 62.

FIG. 6 is an equivalent circuit diagram for illustrating a circuit configuration of the light-emitting array unit S-A in the first exemplary embodiment. The light-emitting array unit S-A is a self-scanning light-emitting device array (SLED). Note that, in FIG. 6, the elements described below are arranged based on the layout on the light-emitting array unit S-A which will be described in FIGS. 8A and 8B later, except for the input terminals (the Vga terminal, the ϕ2 terminal, the ϕW terminal, the ϕ1 terminal, and the ϕI terminal).

Here, the light-emitting array unit S-A is described taking the light-emitting array unit S-A1 as an example. The light-emitting array unit S-A is therefore called a light-emitting array unit S-A1(S-A) in FIG. 6. The other light-emitting array units S-A2 to S-A20 have the same configuration as the light-emitting array unit S-A1.

For illustrative convenience, in FIG. 6, the input terminals (the Vga terminal, the ϕ2 terminal, the ϕW terminal, the ϕ1 terminal, and the ϕI terminal) are shown at positions different from those shown in FIG. 4A, namely, at the left edge of FIG. 6.

As described earlier, the light-emitting array unit S-A1(S-A) has a transfer thyristor array including transfer thyristors T1, T2, T3, . . . that are arranged in line on the substrate 80 (see FIGS. 8A and 8B to be described later). Further, the light-emitting array unit S-A1(S-A) has power-supply-line resistors Rgx1, Rgx2, Rgx3, . . . for the respective transfer thyristors T1, T2, T3, . . . . When not differentiated from one another, the transfer thyristors T1, T2, T3, . . . and the power-supply-line resistors Rgx1, Rgx2, Rgx3, . . . are called transfer thyristors T and power-supply-line resistors Rgx, respectively.

Further, the light-emitting array unit S-A1(S-A) has a light-emitting thyristor array (the light-emitting element array 102 (see FIGS. 4A and 4B)) including odd-numbered light-emitting thyristors L1, L3, L5, . . . that are arranged in line. The light-emitting thyristors are an example of light-emitting elements. One light-emitting thyristor is provided for each pair of transfer thyristors T. When not differentiated from one another, the light-emitting thyristors L1, L3, L5, . . . are called light-emitting thyristors L. Note that the light-emitting array unit S-A1(S-A) does not have even-numbered light-emitting thyristors L2, L4, L6, . . . .

In addition, the light-emitting array unit S-A1(S-A) has coupling diodes Dx1, Dx2, Dx3, . . . provided between respective adjacent twos of the transfer thyristors T1, T2, T3, . . . paired in numerical order. The coupling diodes are an example of first electrical parts.

The light-emitting array unit S-A1(S-A) also has connection resistors Ra1, Ra3, Ra5, . . . and Schottky write diodes SDw1, SDw3, SDw5, . . . between the odd-numbered transfer thyristors T1, T3, T5, . . . and the light-emitting thyristors L1, L3, L5, . . . , respectively. Each connection resistor is an example of a second electrical part, and each Schottky write diode is an example of a third electrical part. Here, like the light-emitting thyristors L and others, when not differentiated from one another, the coupling diodes Dx1, Dx2, Dx3, . . . , the connection resistors Ra1, Ra3, Ra5, . . . , the Schottky write diodes SDw1, SDw3, SDw5, . . . are called coupling diodes Dx, connection resistors Ra, and Schottky write diodes SDw, respectively.

Note that the above-described thyristors (the light-emitting thyristors L and the transfer thyristors T) are each a semiconductor device having three terminals: an anode terminal, a cathode terminal, and a gate terminal.

Herein, the anode terminal, the cathode terminal, and the gate terminal of the transfer thyristor T are sometimes called a first anode terminal, a first cathode terminal, and a first gate terminal, respectively. Likewise, the anode terminal, the cathode terminal, and the gate terminal of the light-emitting thyristor L are sometimes called a second anode terminal, a second cathode terminal, and a second gate terminal, respectively.

Moreover, the light-emitting array unit S-A1(S-A) has one start diode Dx0. Further, the light-emitting array unit S-A1 (S-A) has a current limitation resistor R1 and a current limitation resistor R2 for preventing an excessive current from flowing into a first transfer signal line 72 and a second transfer signal line 73, to be described later, for sending the first transfer signal ϕ1 and the second transfer signal ϕ2, respectively.

Note that the transfer thyristors T1, T2, T3, . . . of the transfer thyristor array, the power-supply-line resistors Rgx1, Rgx2, Rgx3, . . . , and the coupling diodes Dx1, Dx2, Dx3, . . . , are arranged in numerical order from the left of FIG. 6. Likewise, the light-emitting thyristors L1, L2, L3, . . . of the light-emitting thyristor array, the connection resistors Rat, Ra3, Ra5, . . . , and the Schottky write diodes SDw1, SDw3, SDw5, . . . are arranged in numerical order from the left of FIG. 6.

The transfer thyristor array and the light-emitting thyristor array are arranged in this order from the top of FIG. 6.

Next, a description is given of electrical connection among the elements of the light-emitting array unit S-A1(S-A).

The anode terminals of the transfer thyristors T and the anode terminals of the light-emitting thyristors L are connected to the substrate 80 of the light-emitting array unit S-A1(S-A) (i.e., common anode).

Then, these anode terminals are connected to the power supply line 200*a* (see FIG. 4C) through the Vsub terminal which is a back-side electrode 85 (to be described later in FIG. 8B) provided on the back side of the substrate 80. The power supply line 200*a* is supplied with the reference potential Vsub.

The cathode terminals of the transfer thyristors T1, T3, T5, . . . that are odd-numbered according to the arrangement of the transfer thyristors T are connected to the first transfer signal line 72. The first transfer signal line 72 is connected through the current limitation resistor R1 to the ϕ1 terminal which is an input terminal for the first transfer signal ϕ1. To this ϕ1 terminal, the first transfer signal line 201 (see FIG. 4C) is connected, and the first transfer signal ϕ1 is sent.

On the other hand, the cathode terminals of the transfer thyristors T2, T4, T6, . . . that are even-numbered according to the arrangement of the transfer thyristors T are connected to the second transfer signal line 73. The second transfer signal line 73 is connected through the current limitation resistor R2 to the ϕ2 terminal which is an input terminal for the second transfer signal ϕ2. To this ϕ2 terminal, the second transfer signal line 202 (see FIG. 4C) is connected, and the second transfer signal ϕ2 is sent.

The coupling diodes Dx1, Dx2, Dx3, . . . are connected between respective adjacent twos of gate terminals Gt1, Gt2, Gt3, . . . , paired in numerical order, of the transfer thyristors T1, T2, T3, . . . . In other words, the coupling diodes Dx1, Dx2, Dx3, . . . are serially connected while each of them is sandwiched between adjacent pair of the gate terminals Gt1, Gt2, Gt3, . . . sequentially. The coupling diode Dx1 is connected such that a current may flow from the gate terminal Gt1 toward the gate terminal Gt2. The same is true for the other coupling diodes Dx2, Dx3, Dx4, . . . . When not differentiated from one another, the gate terminals Gt1, Gt2, Gt3, . . . are called gate terminals Gt.

The gate terminals Gt of the transfer thyristors T are connected to a power supply line 71 through the power-supply-line resistors Rgx provided for the transfer thyristors T, respectively. The power supply line 71 is connected to the Vga terminal. The Vga terminal is connected to the power supply line 200*b* (see FIG. 4C), and is supplied with the power supply potential Vga.

The odd-numbered gate terminals Gt1, Gt3, Gt5, . . . of the transfer thyristors T are connected one-by-one to gate terminals Gl1, Gl3, Gl5, . . . of also the odd-numbered light-emitting thyristors L1, L3, L5, . . . , through the connection resistors Rat, Ra3, Ra5, . . . , respectively. When not differentiated from one another, the gate terminals Gl1, Gl3, Gl5, . . . are called gate terminals Gl.

The cathode terminals of the Schottky write diodes SDw are connected to a selection signal line 74. The selection signal line 74 is connected to the ϕW terminal to which one of the selection signals ϕW1 to ϕW20 is sent. To the ϕW terminal of the light-emitting array unit S-A1, the selection signal line 205 (see FIG. 4C) is connected, and the selection signal ϕW1 is sent.

The anode terminals of the Schottky write diodes SDw are connected to the respective gate terminals Gl of the light-emitting thyristors L.

The cathode terminals of the light-emitting thyristors L are connected to a light-up signal line 75. The light-up signal line 75 is connected to the ϕI terminal which is an input terminal for the light-up signal ϕI. To the ϕI terminal of the light-emitting array unit S-A1, the light-up signal line 204*a* (see FIG. 4C) is connected, and the light-up signal ϕIa is sent.

Note that, although not shown in FIG. 6, the current limitation resistor R1 is actually provided between the light-up signal generating part 140 and the ϕI terminal as shown in FIG. 4C.

The gate terminal Gt1 of the transfer thyristor T1 at one end of the transfer thyristor array is connected to the cathode terminal of the start diode Dx0. The anode terminal of the start diode Dx0 is connected to the second transfer signal line 73.

FIG. 7 is an equivalent circuit diagram for illustrating a circuit configuration of the light-emitting array unit S-B in the first exemplary embodiment. The light-emitting array unit S-B is a self-scanning light-emitting device array (SLED). Here, the light-emitting array unit S-B is described taking the light-emitting array unit S-B1 as an example. The light-emitting array unit S-B is therefore called a light-emitting array unit S-B1(S-B) in FIG. 7. The other light-emitting array units S-B2 to S-B20 have the same configuration as the light-emitting array unit S-B1.

In the light-emitting array unit S-A shown in FIG. 6, the light-emitting thyristors L are provided for the respective (2n−1)-th (i.e., odd-numbered) transfer thyristors T. In contrast, in the light-emitting array unit S-B, the light-emitting thyristors L are provided for the respective 2n-th (i.e., even-numbered) transfer thyristors T.

For the light-emitting array unit S-B, differences from the light-emitting array unit S-A are described, and the same configurations are denoted by the same reference signs and are not described in detail.

The light-emitting array unit S-B1(S-B) has a light-emitting thyristor array (the light-emitting element array 102 (see FIGS. 4A and 4B)) including the even-numbered light-emitting thyristors L2, L4, L6, . . . that are arranged in line. The light-emitting thyristors are an example of the light-emitting elements. One light-emitting thyristor is provided for every two transfer thyristors T. The light-emitting array unit S-B1 (S-B) has connection resistors Ra2, Ra4, Ra6, . . . and Schottky write diodes SDw2, SDw4, SDw6, . . . between the even-numbered transfer thyristors T2, T4, T6, . . . and the even-numbered light-emitting thyristors L2, L4, L6, . . . , respectively. Each connection resistor is an example of the second electrical part, and each Schottky write diode is an example of the third electrical part. Note that the light-emitting array unit S-B1(S-B) does not have the odd-numbered light-emitting thyristors L.

The light-emitting thyristors are called light-emitting thyristors L when no differentiation is made between the odd-numbered light-emitting thyristors L1, L3, L5, . . . of the light-emitting array unit S-A and the even-numbered light-emitting thyristors L2, L4, L6, . . . of the light-emitting array unit S-B. The connection resistors are called connection resistors Ra when no differentiation is made between the odd-numbered connection resistors Ra1, Ra3, Ra5, . . . of the light-emitting array unit S-A and the even-numbered connection resistors Ra2, Ra4, Ra6, . . . of the light-emitting array unit S-B. The Schottky write diodes are called Schottky write diodes SDw when no differentiation is made between the odd-numbered Schottky write diodes SDw1, SDw3, SDw5, . . . of the light-emitting array unit S-A and the even-numbered Schottky write diodes SDw2, SDw4, SDw6, . . . of the light-emitting array unit S-B.

Like the light-emitting array unit S-A, the anode terminal, the cathode terminal, and the gate terminal of each light-emitting thyristor L of the light-emitting array unit S-B are sometimes called a second anode terminal, a second cathode terminal, and a second gate terminal, respectively.

The cathode terminals of the Schottky write diodes SDw are connected to the selection signal line 74. The selection signal line 74 is connected to the φW terminal to which one of the selection signals φW1 to φW20 is sent. To the φW terminal of the light-emitting array unit S-B1, the selection signal line 205 (see FIG. 4C) is connected, and the selection signal φW1 is sent.

The anode terminals of the Schottky write diodes SDw are connected to the respective gate terminals Gl of the light-emitting thyristors L.

The cathode terminals of the light-emitting thyristors L are connected to the light-up signal line 75. The light-up signal line 75 is connected to the φI terminal which is an input terminal for the light-up signal φI. To the φI terminal of the light-emitting array unit S-B1, the light-up signal line 204*b* (see FIG. 4C) is connected, and the light-up signal φIb is sent.

Note that, although not shown in FIG. 7, the current limitation resistor R1 is actually provided between the light-up signal generating part 140 and the φI terminal as shown in FIG. 4C.

As described above, the light-emitting array unit S-A has the odd-numbered light-emitting thyristors L, connection resistors Ra, and Schottky write diodes SDw, whereas the light-emitting array unit S-B has the even-numbered light-emitting thyristors L, connection resistors Ra, and Schottky write diodes SDw.

The light-emitting array units S-A and S-B may have any predetermined number of the light-emitting thyristors L in the light-emitting thyristor array. For example, if the number of the light-emitting thyristors L is 128 in the first exemplary embodiment, the number of the connection resistors Ra and the number of the Schottky write diodes SDw are each 128, as well.

In the light-emitting array units S-A, the light-emitting thyristors L are provided for the respective (2n−1)-th transfer thyristors T (n is an integer of 1 or higher). Accordingly, the number of the transfer thyristors T is at least 255, and the number of the power-supply-line resistors Rgx is also at least 255. The number of the coupling diodes Dx is 254 which is less by 1 than the number of the transfer thyristors T.

In the light-emitting array units S-B, on the other hand, the light-emitting thyristors L are provided for the respective 2n-th transfer thyristors T. The number of the transfer thyristors T is at least 256, and the number of the power-supply-line resistors Rgx is also at least 256. The number of the coupling diodes Dx is 255 which is less by 1 than the number of the transfer thyristors T.

Note that the number of the transfer thyristors T may be more than double of the number of the light-emitting thyristors L in the light-emitting array units S-A and S-B.

Figure 8B:
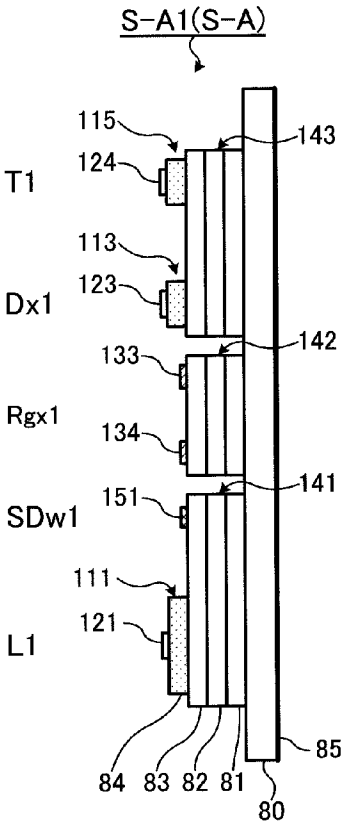
FIGS. 8A and 8B are a planar layout diagram and a cross-sectional diagram, respectively, of the light-emitting array unit in the first exemplary embodiment.
Figure 8A:
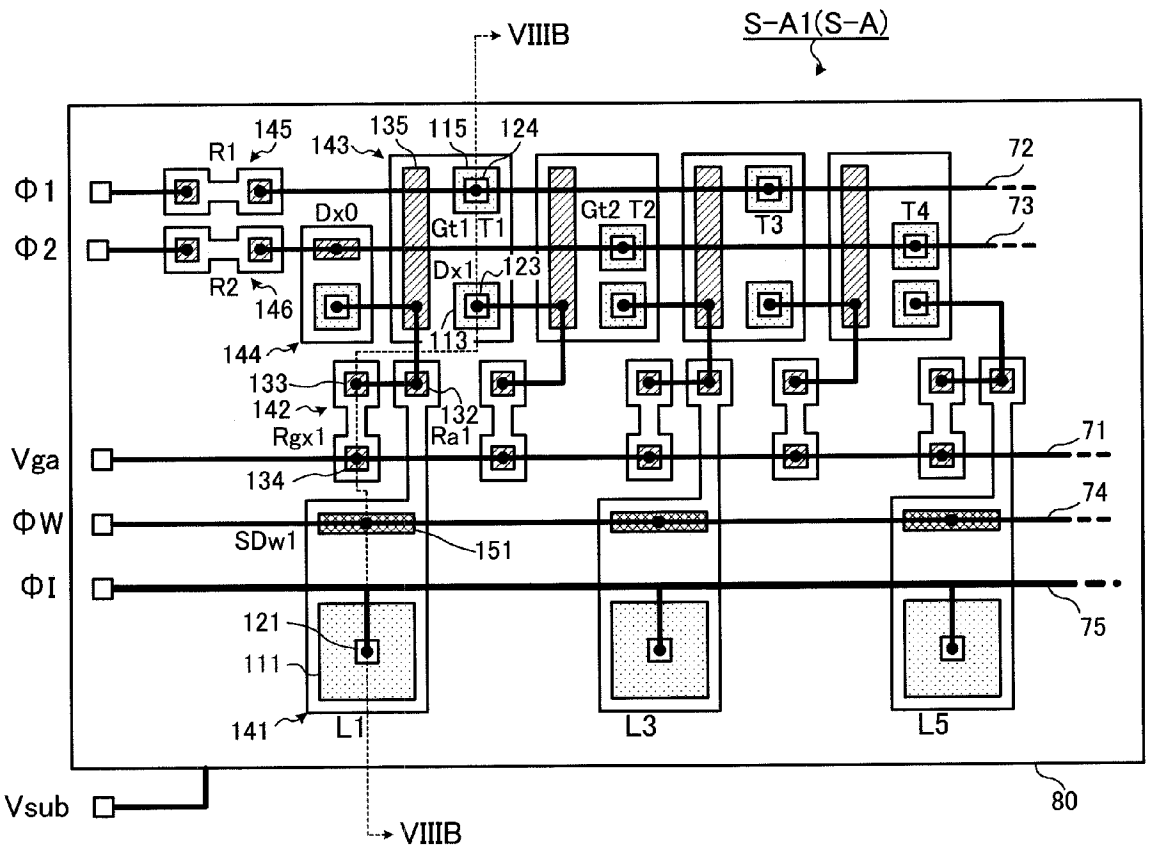

FIGS. 8A and 8B are a planar layout diagram and a cross-sectional diagram, respectively, of the light-emitting array unit S-A in the first exemplary embodiment. Here, the light-emitting array unit S-A is described taking the light-emitting array units S-A1 as an example. The light-emitting array unit S-A is therefore called the light-emitting array unit S-A1(S-A) in FIGS. 8A and 8B. The other light-emitting array units S-A2 to S-A20 have the same configurations as the light-emitting array unit S-A1.

FIG. 8A is a planar layout diagram of the light-emitting array unit S-A1(S-A), showing a part having the light-emitting thyristors L1, L3, and L5 and the transfer thyristors T1, T2, T3, and T4. FIG. 8B is a cross-sectional view, taken along a VIIIB-VIIIB line shown in FIG. 8A. The cross-sectional view in FIG. 8B shows cross sections of the light-emitting thyristor L1, the Schottky write diode SDw1, the power-supply-line resistor Rgx1, the coupling diode Dx1, and the transfer thyristor T1, from the bottom of FIG. 8B. In FIGS. 8A and 8B, main elements and terminals are indicated by their names.

Note that FIG. 8A shows the wirings connecting the elements in solid lines. FIG. 8B does not show the wirings connecting the elements.

As FIG. 8B shows, the light-emitting array unit S-A1(S-A) includes multiple islands (a first island 141, a second island 142, a third island 143, a fourth island 144, a fifth island 145, and a sixth island 146). These islands are formed as follows. For example, with a composite semiconductor of GaAs, GaAlAs, or the like, a p-type first semiconductor layer 81, an n-type second semiconductor layer 82, a p-type third semiconductor layer 83, and an n-type fourth semiconductor layer 84 are laminated in this order on the p-type substrate 80. The p-type first semiconductor layer 81, the n-type second semiconductor layer 82, the p-type third semiconductor layer 83, and the n-type fourth semiconductor layer 84 are etched successively at peripheries. Thereby, the islands that are separated from one another are formed.

As FIG. 8A shows, the first island 141, in a plane view, has a rectangular shape with a protruding part, and has the light-emitting thyristor L1, the Schottky write diode SDw1, and the connection resistors Ra1. The second island 142, in a plane view, has a shape with wide parts at both ends, and has the power-supply-line resistor Rgx1. The third island 143, in a plane view, has a rectangular shape, and has the transfer thyristor T1 and the coupling diode Dx1. The fourth island 144, in a plane view, has a rectangular shape, and has the start diode Dx0. Each of the fifth island 145 and the sixth island 146, in a plane view, has a shape with wide parts at both ends. The fifth island 145 has the current limitation resistor R1, and the sixth island 146 has the current limitation resistor R2.

Moreover, in the light-emitting array unit S-A1(S-A), islands similar to the second island 142 and islands similar to the third island 143 are formed in parallel. Like the second island 142 and the third island 143, these islands have the power-supply-line resistors Rgx2, Rgx3, Rgx4, . . . , the transfer thyristors T2, T3, T4, . . . , and the like. In addition, in the light-emitting array unit S-A1(S-A), islands similar to the first island 141 are formed in parallel. Like the first island 141, these islands have the light-emitting thyristors L3, L5, . . . . Descriptions for those islands are omitted here.

Further, the back-side electrode 85 which is the Vsub terminal is provided on the back side of the substrate 80.

Based on FIGS. 8A and 8B, the first island 141, the second island 142, the third island 143, the fourth island 144, the fifth island 145, and the sixth island 146 are described in further detail.

In the light-emitting thyristor L1 provided in the first island 141, the anode terminal is the substrate 80, the cathode terminal is an n-type ohmic electrode 121 formed in a region 111 of the n-type fourth semiconductor layer 84, and the gate terminal Gl1 is the p-type third semiconductor layer 83 exposed by etching and removing the n-type fourth semiconductor layer 84. Note that the gate terminal Gl1 is not formed as an electrode and therefore is not shown. Light is emitted from the surface of the region 111 of the n-type fourth semiconductor layer 84, except for the part where the n-type ohmic electrode 121 is formed.

In the Schottky write diode SDw1 provided in the first island 141, the anode terminal is the p-type third semiconductor layer 83, and the cathode terminal is a Schottky electrode 151 formed on the p-type third semiconductor layer 83 exposed by etching and removing the n-type fourth semiconductor layer 84.

The gate terminal Gl1 of the light-emitting thyristor L1 and the anode terminal of the Schottky write diode SDw1 are the common p-type third semiconductor layer 83 of the first island 141.

The p-type third semiconductor layer 83 provided in the first island 141 at the protruding part in a planar shape is the connection resistor Ra1, and a p-type ohmic electrode 132 is formed at an end of the protruding part. In other words, the p-type third semiconductor layer 83 between the Schottky electrode 151 and the p-type ohmic electrode 132 is used as the resistance of the connection resistor Ra1.

The power-supply-line resistor Rgx1 provided in the second island 142 is formed between two p-type ohmic electrodes 133 and 134 formed on the p-type third semiconductor layer 83. The p-type third semiconductor layer 83 between the two p-type ohmic electrodes 133 and 134 is used as the resistance of the power-supply-line resistor Rgx1.

In the transfer thyristor T1 provided in the third island 143, the anode terminal is the substrate 80, the cathode terminal is an n-type ohmic electrode 124 formed in a region 115 of the n-type fourth semiconductor layer 84, and the gate terminal Gt1 is a p-type ohmic electrode 135 formed on the p-type third semiconductor layer 83 exposed by etching and removing the n-type fourth semiconductor layer 84.

In the coupling diode Dx1 provided in the same third island 143, the cathode terminal is the n-type ohmic electrode 123 provided in a region 113 of the n-type fourth semiconductor layer 84 and the anode terminal is the p-type third semiconductor layer 83. The p-type third semiconductor layer 83 serving as the anode terminal is connected to the gate terminal Gt1 of the transfer thyristor T1.

In the start diode Dx0 provided in the fourth island 144, the cathode terminal is an n-type ohmic electrode (having no reference numeral) provided on a region (having no reference numeral) of the n-type fourth semiconductor layer 84, and the anode terminal is a p-type ohmic electrode (having no reference numeral) formed on the p-type third semiconductor layer 83 exposed by etching and removing the n-type fourth semiconductor layer 84.

Like the power-supply-line resistor Rgx1 provided in the second island 142, the current limitation resistors R1 and R2 provided in the fifth island 145 and the sixth island 146, respectively, each uses, as its resistance, the p-type third semiconductor layer 83 between paired p-type ohmic electrodes (having no reference numeral) formed on the p-type third semiconductor layer 83 exposed by etching and removing the n-type fourth semiconductor layer 84.

Based on FIG. 8A, how the elements are connected is described.

In the first island 141, the p-type third semiconductor layer 83 serving as the gate terminal Gl1 of the light-emitting thyristor L1 is used for both of the anode terminal of the Schottky write diode SDw1 and one of the terminals of the connection resistor Ra1.

The p-type ohmic electrode 132 which is the other one of the terminals of the connection resistor Ra1 is connected to the p-type ohmic electrode 135 which is the gate terminal Gt1 of the transfer thyristor T1 in the third island 143.

The n-type ohmic electrode 121 which is the cathode terminal of the light-emitting thyristor L1 is connected to the light-up signal line 75. The light-up signal line 75 is connected to the ϕI terminal.

The Schottky electrode 151 which is the cathode terminal of the Schottky write diode SDw1 is connected to the selection signal line 74. The selection signal line 74 is connected to the ϕW terminal.

The p-type ohmic electrode 133 which is one of the terminals of the power-supply-line resistor Rgx1 provided in the second island 142 is connected to the p-type ohmic electrode 132 which is the other one of the terminals of the connection resistor Ra1 provided in the first island 141. The p-type ohmic electrode 134 which is the other one of the terminals of the power-supply-line resistor Rgx1 is connected to the power supply line 71. The power supply line 71 is connected to the Vga terminal.

The n-type ohmic electrode 124 which is the cathode terminal of the transfer thyristor T1 provided in the third island 143 is connected to the first transfer signal line 72. The first transfer signal line 72 is connected to the ϕ1 terminal through the current limitation resistor R1 provided in the fifth island 145.

The n-type ohmic electrode 123 which is the cathode terminal of the coupling diode Dx1 provided in the third island 143 is connected to a p-type ohmic electrode (having no reference numeral) which is the gate terminal Gt2 of the transfer thyristor T2 provided adjacently.

On the other hand, the p-type ohmic electrode 135 which is the gate terminal Gt1 of the transfer thyristor T1 provided in the third island 143 is connected to the n-type ohmic electrode (having no reference numeral) which is the cathode terminal of the start diode Dx0 provided in the fourth island 144 and which is formed on the n-type fourth semiconductor layer 84.

The p-type ohmic electrode (having no reference numeral) which is the anode terminal of the start diode Dx0 provided in the fourth island 144 and is formed on the p-type third semiconductor layer 83 is connected to the n-type ohmic electrodes (having no reference numeral) which are the cathode terminals of the respective even-numbered transfer thyristors T2, T4, T6, . . . and are formed on the n-type fourth semiconductor layer 84, and is also connected to the ϕ2 terminal through the current limitation resistor R2 provided in the sixth island 146.

Although not described here, the same is true for the other light-emitting thyristors L, transfer thyristors T, coupling diodes Dx, Schottky write diodes SDw, connection resistors Ra, and power-supply-line resistors Rgx.

The circuit configuration of the light-emitting array unit S-A1(S-A) shown in FIG. 6 is as described above.

Note that the light-emitting array unit S-B is configured such that the p-type ohmic electrode 132 provided in the first island 141, which has the light-emitting thyristor L1 in the light-emitting array unit S-A, is connected to the gate terminal Gt2 of the transfer thyristor T2. In other words, a planar layout of the light-emitting array unit S-B is obtainable by shifting the positions of the light-emitting thyristors L to the right of FIG. 8A by ½ of the distance between the light-emitting thyristor L1 and the light-emitting thyristor L3 in the planar configuration of the light-emitting array units S-A shown in FIG. 8A. Accordingly, the planar layout and cross sections of the light-emitting array unit S-B are not described in detail here.

Next, operations of the light-emitting device 65 are described.

The light-emitting device 65 includes the light-emitting array units S-A1 to S-A20 belonging to the light-emitting array unit group #a and the light-emitting array units S-B1 to S-B20 belonging to the light-emitting array unit group #b (see FIGS. 3 to 5).

As FIG. 4C shows, the reference potential Vsub and the power supply potential Vga are commonly supplied to all of the light-emitting array units S-A (the light-emitting array units S-A1 to S-A20) and the light-emitting array units S-B (the light-emitting array units S-B1 to S-B20) on the circuit board 62.

Moreover, the first transfer signal ϕ1 and the second transfer signal ϕ2 are commonly sent to all of the light-emitting array units S-A (the light-emitting array units S-A1 to S-A20) and the light-emitting array units S-B (the light-emitting array units S-B1 to S-B20) on the circuit board 62.

The light-up signal ϕIa is sent commonly to the light-emitting array units S-A1 to S-A20 of the light-emitting array unit group #a. Thus, the light-emitting array units S-A1 to S-A20 of the light-emitting array unit group #a are driven in parallel. The light-up signal ϕIb is sent commonly to the light-emitting array units S-B1 to S-B20 of the light-emitting array unit group #b. Thus, the light-emitting array units S-B1 to S-B20 of the light-emitting array unit group #b are driven in parallel.

Meanwhile, the selection signals ϕW1 to ϕW20 (ϕW) are sent commonly to the respective light-emitting array unit classes #1 to #20 each including one light-emitting array unit S-A of the light-emitting array unit group #a and one light-emitting array unit S-B of the light-emitting array unit group #b. For example, the selection signal ϕW1 is sent commonly to the light-emitting array unit class #1 including the light-emitting array unit S-A1 of the light-emitting array unit group #a and the light-emitting array unit S-B1 of the light-emitting array unit group #b. The twenty selection signals ϕW1 to ϕW20 are sent in parallel at the same timing. Thus, the light-emitting array unit classes #1 to #20 are driven in parallel.

Note that the selection signals ϕW1 to ϕW20 may be sent at different timings.

Since the light-emitting array units S-A2 to S-A20 of the light-emitting array unit group #a are driven in parallel with the light-emitting array unit S-A1, it is only necessary here to describe the operations of the light-emitting array unit S-A1. Also, since the light-emitting array units S-B2 to S-B20 of the light-emitting array unit group #b are driven in parallel with the light-emitting array unit S-B1, it is only necessary here to describe the operations of the light-emitting array unit S-B1. Likewise, since the light-emitting array unit classes #2 to #20 are driven in parallel to the light-emitting array unit class #1, it is only necessary here to describe the operations of the light-emitting array unit class #1 having the light-emitting array units S-A1 and S-B1.

Figure 9:
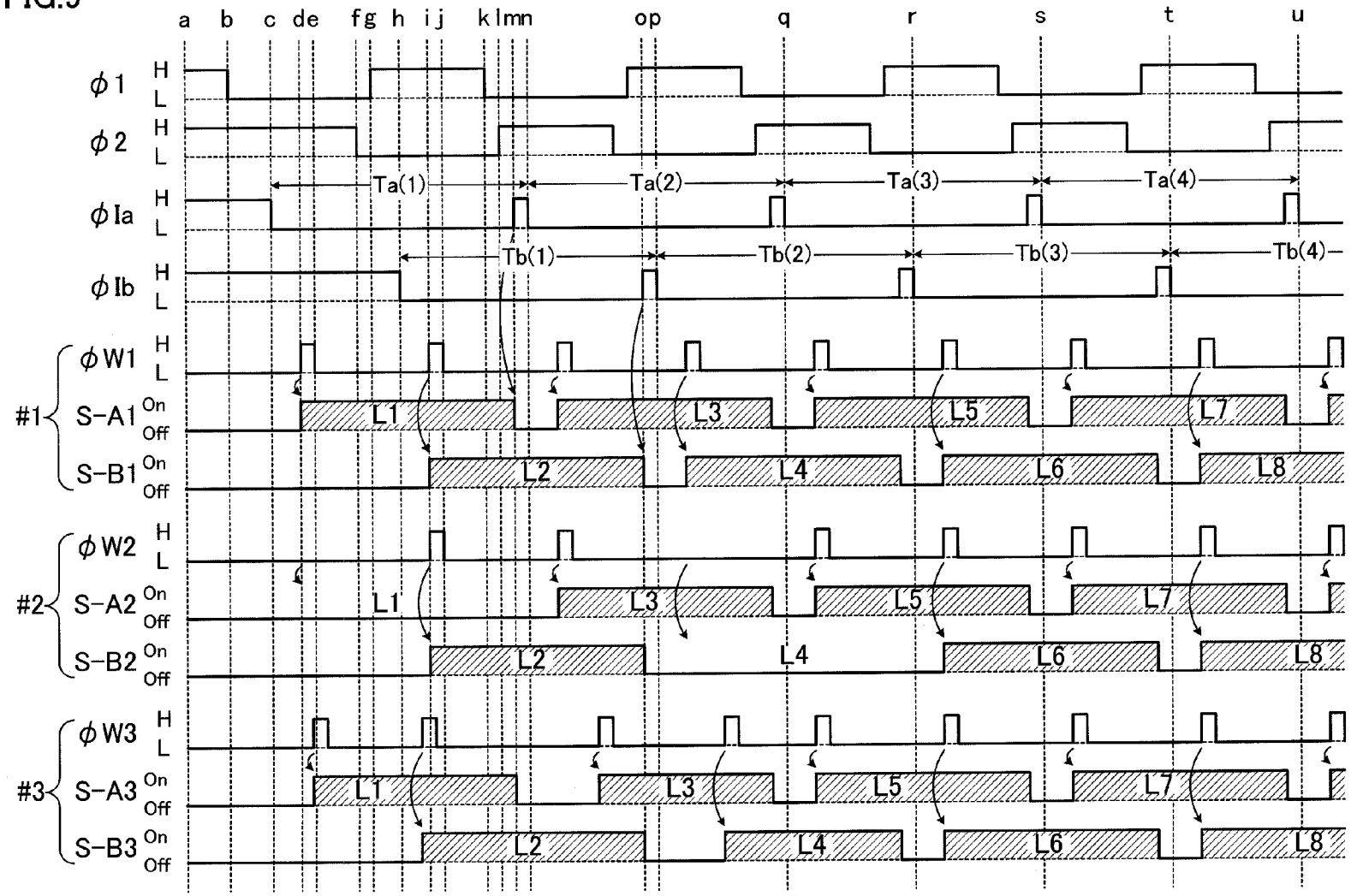
FIG. 9 is a timing chart for illustrating the operations of the light-emitting device and the light-emitting array units in the first exemplary embodiment.

FIG. 9 is a timing chart for illustrating the operations of the light-emitting device 65 and the light-emitting array units S-A and S-B in the first exemplary embodiment.

Although it is only necessary to describe the operations of the light-emitting array units S-A1 and S-B1 as mentioned above, FIG. 9 shows a timing chart illustrating the operations of not only the light-emitting array unit class #1 (the light-emitting array units S-A1 and S-B1), but also the light-emitting array unit class #2 (the light-emitting array units S-A2 and S-B2) and the light-emitting array unit class #3 (the light-emitting array units S-A3 and S-B3). The timing chart shown in FIG. 9 shows parts for controlling lighting up and not lighting up of the light-emitting thyristors L1, L3, L5, and L7 of each of the light-emitting array units S-A and the light-emitting thyristors L2, L4, L6, and L8 of each of the light-emitting array units S-B. Note that controlling of lighting up and not lighting up of the light-emitting thyristors L is called light-controlling below.

Here, in the light-emitting array unit class #1, the light-emitting thyristors L1, L3, L5, and L7 of the light-emitting array unit S-A1 and the light-emitting thyristors L2, L4, L6, and L8 of the light-emitting array unit S-B1 are to be lighted up. In the light-emitting array unit class #2, the light-emitting thyristors L3, L5, and L7 of the light-emitting array unit S-A2 and the light-emitting thyristors L2, L6, and L8 of the light-emitting array unit S-B2 are to be lighted up, and the light-emitting thyristor L1 of the light-emitting array unit S-A2 and the light-emitting thyristor L4 of the light-emitting array unit S-B2 are to be not lighted up (to be unlighted). In the light-emitting array unit class #3, the light-emitting thyristors L1, L3, L5, and L7 of the light-emitting array unit S-A3 and the light-emitting thyristors L2, L4, L6, and L8 of the light-emitting array unit S-B3 are to be lighted up, and the selection signal ϕW3 is sent at a different timing from that for the selection signal ϕW1.

The operations of the light-emitting array units S-A1 and S-B1 of the light-emitting array unit class #1 are mainly described below.

Suppose that time passes from a time point a to a time point u alphabetically in FIG. 9.

In the light-emitting array unit group #a, the light-emitting thyristor L1 of each of the light-emitting array units S-A1, S-A2, and S-A3 is light-controlled in a period Ta(1) which is from a time point c to a time point n. The light-emitting thyristor L3 of each of the light-emitting array units S-A1, S-A2, and S-A3 is light-controlled in a period Ta(2) which is from the time point n to a time point q. The light-emitting thyristor L5 of each of the light-emitting array units S-A1, S-A2, and S-A3 is light-controlled in a period Ta(3) which is from the time point q to a time point s. The light-emitting thyristor L7 of each of the light-emitting array units S-A1, S-A2, and S-A3 is light-controlled in a period Ta(4) which is from the time point s to the time point u. In the same manner, the light-emitting thyristor L9 and the rest of the light-emitting thyristors L are light-controlled.

In the light-emitting array unit group #b, the light-emitting thyristor L2 of each of the light-emitting array units S-B1, S-B2, and S-B3 is light-controlled in a period Tb(1) which is from a time point h to a time point p. The light-emitting thyristor L4 of each of the light-emitting array units S-B1, S-B2, and S-B3 is light-controlled in a period Tb(2) which is from the time point p to a time point r. The light-emitting thyristor L6 of each of the light-emitting array units S-B1, S-B2, and S-B3 is light-controlled in a period Tb(3) which is from the time point r to a time point t. The light-emitting thyristor L8 of each of the light-emitting array units S-B1, S-B2, and S-B3 is light-controlled in a period Tb(4) which is from the time point t. In the same manner, the light-emitting thyristor L10 and the rest of the light-emitting thyristors L are light-controlled.

In the first exemplary embodiment, the periods Ta(1), Ta(2), Ta(3), . . . and the periods Tb(1), Tb(2), Tb(3), . . . have the same length, and are called a period T when not differentiated from one another.

The periods Ta(1), Ta(2), Ta(3), . . . in which the light-emitting array units S-A1 to S-A20 of the light-emitting array unit group #a are controlled are shifted, by a half length of the period T (180 degrees in terms of phase), from the periods Tb(1), Tb(2), Tb(3), . . . in which the light-emitting array units S-B1 to S-B20 of the light-emitting array unit group #b are controlled. In other words, the period Tb(1) starts after a period half of the period T passes after the period Ta(1) starts.

Accordingly, a description is given below as to the periods Ta(1), Ta(2), Ta(3), . . . in which the light-emitting array unit S-A1 of the light-emitting array unit group #a is controlled.

Note that the length of the period T may be variable as long as relationships among the signals described below are maintained.

A signal waveform in the periods Ta(1), Ta(2), Ta(3), . . . is repetition of the same waveform, except for those of the selection signals ϕW (ϕW1 to ϕW20) that vary depending on image data.

Accordingly, the period Ta(1) which is from the time point c to the time point n is described below. Note that a period from the time point a to the time point c is a period in which the light-emitting array units S-A1 and S-B1 start operations. Signals during this period will be described in a description of operations.

First, a description is given of the signal waveforms of the first transfer signal ϕ1 and the second transfer signal ϕ2 in the period Ta(1).

The first transfer signal ϕ1 is a low-level potential (called "L" below) at the time point c, transitions from "L" to a high-level potential (called "H" below) at a time point g, transitions from "H" to "L" at a time point k, and is maintained at "L" at the time point n.

The second transfer signal ϕ2 is "H" at the time point c, transitions from "H" to "L" at a time point f, transitions from "L" to "H" at a time point l, and is maintained at "H" at the time point n.

The signal waveforms of the first transfer signal ϕ1 and the second transfer signal ϕ2 in the period Ta(1) are repeated in the periods Ta(2), Ta(3), . . . . The first transfer signal ϕ1 and the second transfer signal ϕ2 have waveforms that repeat on the period-T basis.

In comparison between the first transfer signal ϕ1 and the second transfer signal ϕ2, the signal waveform of the second transfer signal ϕ2 is what the signal waveform of the first transfer signal ϕ1 in the period Ta(1) is shifted to a delayed point on a time axis by a half length of the period T (180 degrees in terms of phase).

The signal waveforms of the first transfer signal ϕ1 and the second transfer signal ϕ2 repeat "H" and "L" alternately with a period in which both are "L," such as from the time point f to the time point g, in between. Except for the period from the time point a to a time point b, the first transfer signal ϕ1 and the second transfer signal ϕ2 do not have a period in which both are "H" at the same time.

The paired transfer signals, namely the first transfer signal ϕ1 and second transfer signal ϕ2, bring the transfer thyristors T shown in FIGS. 6 and 7 into an ON state sequentially as will be described later, and thus the light-emitting thyristors L (to be light-controlled) are set as a control target for light up or not lighting up.

Next, a description is given of the signal waveforms of the light-up signals ϕIa and ϕIb in the period Ta(1).

The light-up signals ϕIa and ϕIb supply the light-emitting thyristors L with a current needed for lighting up (emitting light), as will be described later.

The light-up signal ϕIa transitions from "H" to "L" at the time point c at which the period Ta(1) starts, transitions from "L" to "H" at a time point m, and transitions from "H" to "L" at the time point n at which the period Ta(1) ends. The waveform of the light-up signal ϕIa in the period Ta(1) is repeated in the periods Ta(2), Ta(3), . . . .

The light-up signal ϕIb is "H" at the time point c, transitions from "H" to "L" at the time point h (at which the period Tb(1) starts), and is maintained at "L" at the time point n. Then, the light-up signal ϕIb transitions from "L" to "H" at a time point o in the period Ta(2), and transitions from "H" to "L" at the time point p (at which the period Tb(1) ends). Accordingly, focusing on the period Tb(1), the waveform of the light-up signal ϕIb in the period Tb(1) is the same as that of the light-up signal ϕIa in the period Ta(1). The waveform of the light-up signal ϕIb is what the waveform of the light-up signal ϕIa is shifted to a delayed point on the time axis by a half length of the period T (180 degrees in terms of phase). The waveform of the light-up signal ϕIb in the period Tb(1) is repeated in the periods Tb(2), Tb(3), . . . .

Next, the selection signals ϕW (ϕW1 to ϕW20) are described.

The selection signal ϕW1 sent to the light-emitting array units S-A1 and S-B1 is "L" at the time point c, transitions from "L" to "H" at a time point d, and transitions from "H" to "L" at a time point e. Further, the selection signal ϕW1 transitions from "L" to "H" at a time point i and transitions from "H" to "L" at a time point j. In other words, the selection signal ϕW1 has two "L" periods in the period Ta(1).

The relationship among the first transfer signal ϕ1, the second transfer signal ϕ2, and the selection signal ϕW1 is as follows. The selection ϕW1 is "H" during a period from the time point d to the time point e which is included in a period from the time point c to the time point f in which only the first transfer signal ϕ1 between the first transfer signal ϕ1 and the second transfer signal ϕ2 is "L." Moreover, the selection signal ϕW1 is "H" during a period from the time point i to the time point j which is included in a period from the time point g to the time point k in which only the second transfer signal ϕ2 between the first transfer signal ϕ1 and the second transfer signal ϕ2 is "L."

In other words, in the period Ta(1), the light-emitting thyristor L1 of the light-emitting array unit S-A1 transitions to a light-up state at the period in which the selection signal ϕW1 becomes "H" first (from the time point d to the time point e), and the light-emitting thyristor L2 of the light-emitting array unit S-B1 transitions to a light-up state in the period at which the selection signal W1 becomes "H" later (from the time point i to the time point j). Accordingly, in the period Tb(1), the selection signal ϕW1 is "H" in the period in which the selection signal ϕW1 becomes "H" later (from the time point i to the time point j).

The relationship among the light-up signals ϕIa and ϕIb and the selection signal ϕW1 is as follows. In the period Ta(1), the period in which the selection signal ϕW1 is "H" (the time point d to the time point e) in the period in which the light-up signal ϕIa is "L" (the time point c to the time point m). Similarly, in the period Tb(1), the period in which the selection signal ϕW1 is "H" (from the time point i to the time point j) is in the period in which the light-up signal ϕIb is "L" (from the time point h to the time point o).

As will be described later, the light-emitting thyristor L transitions to a light-up state when the selection signal ϕW (ϕW1 to ϕW20) is "H" and the light-up signal ϕI (ϕIa and ϕIb) is "L."

Specifically, assuming that "H" and "L" of the selection signal ϕW (ϕW1 to ϕW20) are "1" and "0," respectively, and that "L" and "H" of the light signal ϕI (ϕIa and ϕIb) are "1" and "0," respectively, the light-emitting thyristor L transitions to a light-up state when the logical product (AND) of the selection signal ϕW (ϕW1 to ϕW20) and the light-up signal ϕI (ϕIa and ϕIb) is "1."

As FIG. 9 shows, the selection signal ϕW1 sent commonly to the light-emitting array units S-A1 and S-B1 has the "H" periods shifted from each other on the time axis (temporally), the "H" periods each bringing the light-emitting thyristor L of a corresponding one of the light-emitting array units S-A1 and S-B1 into a light-up state.

Before describing the operations of the light-emitting device 65 and the light-emitting array units S-A and S-B, a description is given of the basis operations of the thyristors (the transfer thyristors T and the light-emitting thyristors L). The thyristors are each a semiconductor device having three terminals: an anode terminal, a cathode terminal, and a gate terminal.

In the following, as an example, the reference potential Vsub supplied to the Vsub terminal which is the anode terminals of the thyristors as shown in FIGS. 6 to 8A is set to 0 V ("H"), and the power supply potential Vga supplied to the Vga terminal is set to −3.3 V ("L"). Further, as shown in FIGS. 8A and 8B, the thyristors are formed by laminating p-type semiconductor layers and n-type semiconductor layers formed of GaAs, GaAlAs, or the like. A diffusion potential Vd (forward potential) of pn junction is set to 1.5 V, and a forward potential Vs of Schottky junction (barrier) is set to 0.5 V. The following descriptions use these numeral values.

A thyristor with no current flowing between its anode terminal and cathode terminal transitions to an ON state (i.e., is turned on) when a potential lower than a threshold voltage V (a negatively-large potential) is applied to its cathode terminal. When turned on, the thyristor is in a state where a current is flowing between its anode terminal and cathode terminal (an ON state). Here, the threshold voltage of the thyristor is a value obtained by subtracting the diffusion potential Vd from the potential of the gate terminal. Thus, when the potential of the gate terminal of the thyristor is −1.5 V, the threshold voltage is −3.0 V. Accordingly, the thyristor is turned on when a voltage lower than −3.0 V is applied to its cathode terminal.

In the thyristor in an ON state, the potential of its gate terminal becomes close to the potential of its anode terminal. Since the anode terminal is set to 0 V ("H") here, the following description is given assuming that the potential of the gate terminal becomes 0 V ("H"). Further, the cathode terminal of the thyristor in an ON state becomes equal to the diffusion potential Vd of pn junction. Accordingly, the potential of the cathode terminal becomes −1.5 V here.

Once the thyristor is turned on, the thyristor maintains its ON state until the potential of the cathode terminal reaches a potential higher than a potential needed to maintain the ON state (maintenance potential) (i.e., reaches a negatively small potential). Since the potential of the cathode terminal of the thyristor in an ON state is −1.5 V, the thyristor transitions to an OFF state (i.e., is turned off) when a potential higher than −1.5 V is applied to the cathode terminal. For example, when the cathode terminal becomes "H" (0 V), the cathode terminal and the anode terminal have the same potential, so that the thyristor is turned off.

On the other hand, when a potential lower than −1.5 V is continuously applied to the cathode of the thyristor and a current that allows the thyristor to keep on being in an ON state is supplied, the thyristor maintains its ON state.

As described above, the thyristor in an ON state maintains a state where a current flows therethrough, and does not transition to an OFF state depending on the potential of the gate terminal. In other words, the thyristor has a function to maintain (memorize or hold) its ON state.

As described, the maintenance potential continuously applied to the cathode terminal to allow the thyristor to maintain its ON state may be higher (smaller in terms of absolute value) than the potential applied to the cathode terminal to turn on the thyristor.

Note that the light-emitting thyristor L lights up (emits light) when turned on, and is unlighted (does not light up) when turned off. The light-emitting output (luminance) of the thyristor L depends on a current flowing between the cathode terminal and the anode terminal.

Further, before describing the operations of the light-emitting device 65 and the light-emitting array units S-A and S-B, a description is given of the operations of the Schottky write diodes SDw.

Each pair of the Schottky write diode SDw and the connection resistor Ra forms a two-input AND circuit AND1.

The two-input AND circuit AND1 is described using the Schottky write diode SDw1 and the connection resistor Ra1 surrounded by a dashed-dotted line in the light-emitting array unit S-A1 shown in FIG. 6.

The two-input AND circuit AND1 is configured by connecting the anode terminal of the Schottky write diode SDw1 to an O terminal which is one of the terminals of the connection resistor Ra1. Then, an X terminal which is the other terminal of the connection resistor Ra1 is connected to the gate terminal Gt1 of the transfer thyristor T1. A Y terminal which is the cathode terminal of the Schottky write diode SDw1 is connected to the selection signal line 74. As described earlier, the selection signal line 74 is connected to the ϕW terminal to which the selection signal ϕW1 is sent.

The O terminal of the connection resistor Ra1 is connected to the gate terminal Gl1 of the light-emitting thyristor L1.

The X terminal and the Y terminal serve as input terminals, and the O terminal serves as an output terminal.

Table 1 illustrates, for each of three cases where the potential of the X terminal of the connection resistor Ra1 (called Gt(x) here) is "H" (0 v), −1.5 V, and smaller than −2.8 V (Gt(x)<−2.8 V), a relationship between the potential of the ϕW terminal (the Y terminal of the two-input AND circuit AND1) and the potential of the O terminal which is the gate terminal Gl1 of the light-emitting thyristor L1. Hereinbelow, the potential of the ϕW terminal is called ϕW(Y), and the potential of the O terminal is called Gl(O).

Suppose that the gate terminal Gt1 (Gt(X)) of the transfer thyristor T1 is "H" (0 V). If the selection signal ϕW1 sent to the ϕW terminal is "L" (−3.3 V) (ϕW(Y)), a voltage is applied to the Schottky write diode SDw1 in a forward direction (namely, the Schottky write diode SDw1 is forward-biased). The O terminal (Gl(O)) then becomes −2.8 V which is obtained by subtracting, from "L" (−3.3 V), 0.5 V which is the forward potential Vs of Schottky junction (barrier). Then, the threshold voltage of the light-emitting thyristor L1 becomes −4.3 V, so that the light-emitting thyristor L1 does not light up (emit light) even if the light-up signal ϕIa is "L" (−3.3 V).

On the other hand, suppose that the selection signal ϕW1 sent to the ϕW terminal is "H" (0 V) (ϕW(Y)). Then, since the gate terminal Gt1 (Gt(X)) is "H" (0 V) here, Gl(O) becomes "H" (0 V), as well. Then, the threshold voltage of the light-emitting thyristor L1 becomes −1.5 V, so that the light-emitting thyristor L1 lights up (emits light) if the light-up signal ϕIa is "L" (−3.3 V).

Next, suppose that the gate terminal Gt1 (Gt(X)) of the transfer thyristor T1 is −1.5 V. If the selection signal ϕW1 sent to the ϕW terminal is "L" (−3.3 V) (ϕW(Y)), the Schottky write diode SDw1 is forward-biased. The O terminal (Gl(O)) then becomes −2.8 V which is obtained by subtracting, from "L" (−3.3 V), 0.5 V which is the forward potential of the Schottky write diode SDw1.

On the other hand, if the selection signal ϕW1 sent to the ϕW terminal is "H" (0 V) (ϕW(Y)), a voltage is applied to the Schottky write diode SDw1 in a reverse direction (namely, the Schottky write diode SDw1 is reverse-biased). Consequently, the potential of the O terminal (Gl(O)) becomes −1.5 V, which is the potential of the X terminal (Gt(X)). Then, the threshold voltage of the light-emitting thyristor L1 becomes −3 V.

Now suppose that the gate terminal Gt1 (Gt(X)) of the transfer thyristor T1 is smaller than −2.8 V (Gt(x)<−2.8 V) which is obtained by subtracting, from "L" (−3.3 V), 0.5 V which is the forward potential of Schottky junction (barrier). If the selection signal ϕW1 sent to the ϕW terminal is "L" (−3.3 V) (ϕW(Y)), the Schottky write diode SDw1 is not forward-biased, so that the potential of the O terminal (Gl(O)) becomes equal to the potential of the X terminal (Gt(X)).

Further, when the selection signal ϕW1 sent to the ϕW terminal is "H" (0 V) (ϕW(Y)), the Schottky write diode SDw1 is reverse-biased, so that the potential of the O terminal (Gl(O)) becomes equal to the potential of the X terminal (Gt(X)).

Then, when Gt(X)<−2.8 V, the threshold voltage of the light-emitting thyristor L1 is smaller than −4.3 V.

Accordingly, when the potential (signal) of Gt(X) and ϕW(Y) is "H" (0 V), the potential (signal) of Gl(O) becomes "H" (0 V), and the light-emitting thyristor L lights up (emits light). Thus, the two-input AND circuit AND1 serves as a two-input AND.

TABLE 1

| Gt (X) | ϕW (Y) | GI (O) |
|---|---|---|
| "H" (0 V) | "L" (−3.3 V) | −2.8 V |
| | "H" (0 V) | "H" (0 V) |
| −1.5 V | "L" (−3.3 V) | −2.8 V |
| | "H" (0 V) | −1.5 V |
| <−2.8 V | "L" (−3.3 V) | Gt (X) |
| | "H" (0 V) | |

Although the two-input AND circuit AND1 has been described using the Schottky write diode SDw1 and the connection resistor Ra1 here, the same is true for the other Schottky write diodes SDw and the connection resistors Ra.

Now, with reference to FIGS. 4A to 7, the operations of the light-emitting device 65 are described according to the timing chart shown in FIG. 9.

(1) Time Point a

A description is given of a state (initial state) at the time point a at which the light-emitting device 65 is started to be supplied with the reference potential Vsub and the power supply potential Vga.

At the time point a in the timing chart shown in FIG. 9, the power supply line 200*a* is set to the reference potential Vsub which is "H" (0 V), and the power supply line 200*b* is set to the power supply potential Vga which is "L" (−3.3 V) (see FIG. 4C). Accordingly, the Vsub terminal and the Vga terminal of each of the light-emitting array units S-A (the light-emitting array units S-A1 to S-A20) and the light-emitting array units S-B (the light-emitting array units S-B1 to S-B20) is set to "H" and "L," respectively (see FIGS. 6 and 7).

Moreover, the transfer signal generating part 120 of the signal generating circuit 110 sets the first transfer signal ϕ1 and the second transfer signal ϕ2 to "H." Then, the first transfer signal line 201 and the second transfer signal line 202 become "H" (see FIG. 4C). Thereby, the ϕ1 terminal and the ϕ2 terminal of each of the light-emitting array units S-A (the light-emitting array units S-A1 to S-A20) and the light-emitting array units S-B (the light-emitting array units S-B1 to S-B20) are set to "H." The potential of the first transfer signal line 72 connected to the ϕ1 terminal through the current limitation resistor R1 and the potential of the second transfer signal line 73 connected to the ϕ2 terminal through the current limitation resistor R2 also become "H" (see FIGS. 6 and 7).

Further, the light-up signal generating part 140 of the signal generating circuit 110 sets the light-up signals ϕIa and ϕIb to "H." Thus, the light-up signal lines 204*a* and 204*b* become "H" (see FIG. 4C). Thereby, the ϕI terminal of each of the light-emitting array units S-A (the light-emitting array units S-A1 to S-A20) and the light-emitting array units S-B (the light-emitting array units S-B1 to S-B20) becomes "H." The light-up signal line 75 connected to the ϕI terminal also becomes "H" (see FIGS. 6 and 7).

The selection signal generating part 150 of the signal generating circuit 110 sets the selection signals ϕW1 to ϕW20 to "L" (−3.3 V). Then, the selection signal lines 205 to 224 become "L" (−3.3 V) (see FIG. 4C). Thereby, the ϕW terminal of each of the light-emitting array units S-A (the light-emitting array units S-A1 to S-A20) and the light-emitting array units S-B (the light-emitting array units S-B1 to S-B20) becomes "L" (−3.3 V). The selection signal line 74 connected to the ϕW terminal also becomes "L" (−3.3 V) (FIGS. 6 and 7).

Next, with reference to FIGS. 6 and 7, the operations of the light-emitting array units S-A (the light-emitting array units S-A1 to S-A20) and the light-emitting array units S-B (the light-emitting array units S-B1 to S-B20) are described according to the timing chart shown in FIG. 9, focusing on the light-emitting array units S-A1 and S-B1 belonging to the light-emitting array unit class #1.

Note that, although the potential of each terminal changes in a stepwise manner in the description in FIG. 9 and below, the potential of each terminal actually changes gradually. Thus, even during the potential is changing, the thyristors are changeable in state, such as being turned on and being turned off, if conditions described below are met.

The anode terminals of the transfer thyristors T and the light-emitting thyristors L of the light-emitting array units S-A1 and S-B1 are connected to the Vsub terminal, and are therefore set to "H."

On the other hand, the cathode terminals of the odd-numbered transfer thyristors T1, T3, T5, . . . are connected to the first transfer signal line 72, and is therefore set to "H." The cathode terminals of the even-numbered transfer thyristor T2, T4, T6, . . . are connected to the second transfer signal line 73, and is therefore set to "H." Since the anode terminals and the cathode terminals of the transfer thyristors T are both "H," the transfer thyristors T are in an OFF state.

The gate terminals Gt of the transfer thyristors T are connected to the power supply line 71 through the respective power-supply-line resistors Rgx. Since the power supply line 71 is set to the power supply potential Vga which is "L" (−3.3 V), the potential of the gate terminals Gt is "L," except for the gate terminals Gt1 and Gt2 to be described later.

As described earlier, the gate terminal Gt1 at one end of the transfer thyristor array in FIG. 6 (FIG. 7) is connected to the cathode terminal of the start diode Dx0. The anode terminal of the start diode Dx0 is connected to the second transfer signal line 73. The second transfer signal line 73 is set to "H. The start diode Dx0 has its cathode terminal at "L" and its anode terminal at "H," is thus forward-biased. Thereby, the cathode terminal of the start diode Dx0 (the gate terminal Gt1) becomes −1.5 V which is a value obtained by subtracting the diffusion potential Vd (1.5 V) of the start diode Dx0 from "H" (0 V) of the anode terminal of the start diode Dx0. Accordingly, the threshold voltage of the transfer thyristor T1 becomes −3 V which is a value obtained by subtracting the diffusion potential Vd (1.5 V) from the potential of the gate terminal Gt1 (−1.5 V).

The gate terminal Gt2 of the transfer thyristor T2 adjacent to the transfer thyristor T1 is connected to the gate terminal Gt1 through the coupling diode Dx1. The potential of the gate terminal Gt2 of the transfer thyristor T2 becomes −3 V which is a value obtained by subtracting the diffusion potential Vd (1.5 V) of the coupling diode Dx1 from the potential of the gate terminal Gt1 (−1.5 V). Accordingly, the threshold voltage of the transfer thyristor T2 is −4.5 V.

The cathode terminals of the light-emitting thyristors L are connected to the light-up signal line 75, and are set to "H." Accordingly, both of the anode terminals and the cathode terminals of the light-emitting thyristors L become "H," and the light-emitting thyristors are thus in an OFF state.

<Light-Emitting Array Unit S-A1>

The gate terminals Gl of the light-emitting thyristors L are connected to the gate terminals Gt of the transfer thyristors T through the connection resistors Ra. Accordingly, except for the light-emitting thyristor L1 connected to the gate terminal Gt1, the potential of each of the gate terminals Gl3, Gl5, . . . of the light-emitting thyristors L3, L5, . . . connected to the gate terminals Gt3, Gt5, . . . having a potential of −3.3 V become "L" (−3.3 V) which is the potential of the gate terminals Gt3, Gt5, . . . , according to Table 1. Thus, the threshold voltage of the light-emitting thyristors L3, L5, . . . is −4.8 V.

On the other hand, since the potential of the gate terminal Gt1 is −1.5 V, and the potential of the ϕW terminal is "L" (−3.3 V), the potential of the gate terminal Gl1 is −2.8 V, according to Table 1. Thus, the threshold voltage of the light-emitting thyristor L1 is −4.3 V.

Note that the threshold voltage of the third and higher transfer thyristors T is, as described earlier, −4.8 V.

Note that the light-emitting thyristor L is not provided for the transfer thyristor T2, as shown in FIG. 6.

<Light-Emitting Array Unit S-B1>

The light-emitting array unit S-B1 is in a similar state to the light-emitting array unit S-A1.

However, as shown in FIG. 7, in the light-emitting array unit S-B1, although the light-emitting thyristor L which corresponds to the light-emitting thyristor L1 of the light-emitting array unit S-A1 is not provided, the light-emitting thyristor L2 is provided.

As described above with the light-emitting array unit S-A1, the gate terminal Gt of the transfer thyristor T2 is −3 V. Since the potential of the gate terminal Gt2 is −3 V, and the potential of the ϕW terminal is "L" (−3.3 V), the potential of the gate terminal Gl2 becomes equal to the potential of the gate terminal Gt2 (−3 V), according to Table 1. Thus, the threshold voltage of the light-emitting thyristor L2 is −4.5 V.

(2) Time Point b

At the time point b shown in FIG. 9, the first transfer signal ϕ1 transitions from "H" (0 V) to "L" (−3.3 V). Thereby, the light-emitting device 65 is brought to an operational state.

The transfer thyristor T1 having a threshold voltage of −3 V is turned on in each of the light-emitting array units S-A1 and S-B1. However, having a threshold voltage of −4.8 V, the odd-numbered transfer thyristors T including the transfer thyristor T3 and higher is not turned on. On the other hand, since the second transfer signal ϕ2 is "H" (0 V), the transfer thyristor T2 having a threshold voltage of −4.5 V is not turned on.

When the transfer thyristor T1 is turned on, the potential of the gate terminal Gt1 becomes "H" (0 V) which is the potential of the anode terminal. Then, the potential of the cathode terminal of the transfer thyristor T1 (the first transfer signal line 72 in FIG. 6) becomes −1.5 V, which is obtained by subtracting the diffusion potential Vd (1.5 V) from "H" (0 V) which is the potential of the anode terminal of the transfer thyristor T1. Then, the potential of the cathode terminal of the coupling diode Dx1 which is forward-biased (the potential of the gate terminal Gt2) becomes −1.5 V which is obtained by subtracting the diffusion potential Vd (1.5 V) from "H" (0 V) which is the potential of its anode terminal (the gate terminal Gt1). Thereby, the threshold voltage of the transfer thyristor T2 is −3 V.

The potential of the gate terminal Gt3 connected to the gate terminal Gt2 of the transfer thyristor T2 through the coupling diode Dx2 becomes −3 V. Thereby, the threshold voltage of the transfer thyristor T3 becomes −4.5 V. The fourth or higher transfer thyristors T keep having a threshold voltage of −4.8 V since the potential of the gate terminals Gt is the power supply potential Vga which is "L."

<Light-Emitting Array Unit S-A1>

Since the selection signal ϕW1 is "L" (−3.3 V), even after the potential of the gate terminal Gt1 becomes "H" (0 V), the potential of the gate terminal Gl1 is maintained at −2.8 V, as shown in Table 1. Thus, the threshold voltage of the light-emitting thyristor L1 is −4.3 V. On the other hand, as shown in Table 1, when the potential of the gate terminal Gt3 becomes −3 V, the potential of the gate terminal Gl3 becomes −3 V which is the potential of the gate terminal Gt3. Thus, the threshold voltage of the light-emitting thyristor L3 is −4.5 V. The other light-emitting thyristors L keep their threshold voltages at −4.8 V.

However, since the light-up signal line 75 is "H," none of the light-emitting thyristors L transitions to an ON state.

In the light-emitting array unit S-A1, only the transfer thyristor T1 is turned on at the time point b. Then, immediately after the time point b (a stationary state after the thyristors and the like change due to a change in the potential of the signals at the time point b), the transfer thyristor T1 is in an ON state. The other transfer thyristors T and all the light-emitting thyristors L are in an OFF state.

Note that, in the following, only the thyristors (the transfer thyristors T and the light-emitting thyristors L) in an ON state are described, and the thyristors (the transfer thyristors T and the light-emitting thyristors L) in an OFF state are not described.

As described above, the gate terminals Gt of the transfer thyristors T are connected to one another through the coupling diodes Dx. Accordingly, if the potential of a certain one of the gate terminals Gt changes, the potential of the gate terminal Gt connected to the certain gate terminal Gt having a changed potential through the coupling diode Dx which is forward-biased changes. Then, the threshold voltage of the transfer thyristor T having the thus-changed gate terminal Gt changes. If the threshold voltage exceeds "L," the thyristor is in a state in which they may be turned on.

A more specific description is given. The potential of the gate terminal Gt connected through one forward-biased coupling diode Dx to the gate terminal Gt whose potential has changed to "H" (0 V) becomes −1.5 V, and the threshold voltage of the transfer thyristor T having that gate terminal Gt becomes −3 V. Since the threshold voltage is higher (smaller in terms of absolute value) than "L" (−3.3 V), the transfer thyristor T is turned on when its cathode terminal becomes "L" (−3.3 V).

On the other hand, the potential of the gate terminal Gt connected through forward-biased, serially-connected two coupling diodes Dx to the gate terminal Gt having a potential of "H" (0 V) becomes −3 V, and the threshold voltage of the transfer thyristor T having that gate terminal Gt becomes −4.5 V. Since this threshold voltage is lower than "L" (−3.3 V), the transfer thyristor is not turned on, and maintains its OFF state.

<Light-Emitting Array Unit S-B1>

The light-emitting array unit S-B1 is brought to a similar state to the light-emitting array unit S-A1. Specifically, the transfer thyristor T1 is turned on, and the potential of the gate terminal Gt1 becomes "H" (0 V). Then, the potential of the gate terminal Gt2 becomes −1.5 V.

Then, the potential of the gate terminal Gl2 of the light-emitting thyristor L2 becomes −2.8 V, according to Table 1, since the potential of the gate terminal Gt2 is −1.5 V, and the selection signal φW1 is "L" (−3.3 V). Thus, the threshold voltage of the light-emitting thyristor L2 becomes −4.3 V.

(3) Time Point c

At the time point c, the light-up signal φIa sent commonly to the light-emitting array unit group #a transitions from "H" (0 V) to "L" (−3.3 V).

<Light-Emitting Array Unit S-A1>

When the light-up signal line 75 becomes "L" (−3.3 V), none of the light-emitting thyristors L is turned on, since the threshold voltage of the light-emitting thyristor L1 is −4.3 V, the threshold voltage of the light-emitting thyristor L3 is −4.5 V, and the threshold voltage of the fifth and higher light-emitting thyristors L is −4.8 V.

Accordingly, immediately after the time point c, only the transfer thyristor T1 is in an ON state.

<Light-Emitting Array Unit S-B1>

Since there is no signal change in the light-emitting array unit group #b, the light-emitting array unit S-B1 maintains the state in the time point b.

(4) Time Point d

At the time point d, the selection signal φW1 sent commonly to the light-emitting array units S-A1 and S-B1 of the light-emitting array unit class #1 transitions from "L" (−3.3 V) to "H" (0 V).

<Light-Emitting Array Unit S-A1>

The transfer thyristor T1 is in an ON state, and the gate terminal Gt1 is "H" (0 V). When the selection signal φW1 transitions from "L" (−3.3 V) to "H" (0 V), the potential of the gate terminal Gl1 becomes "H" (0 V), according to Table 1. Then, the threshold voltage of the light-emitting thyristor L1 increases from −4.3 V to −1.5 V. Since the light-up signal φIa becomes "L" (−3.3 V) at the time point c, the light-emitting thyristor L1 is turned on and lights up (emits light). Thereby, the potential of the light-up signal line 75 becomes −1.5 V since the light-emitting thyristor L1 is in an ON state.

Note that, since the potential of the gate terminal Gt is −3 V, the potential of the gate terminal Gl3 becomes −3 V which is the potential of the gate terminal Gt3, according to Table 1. Accordingly, having a threshold voltage of −4.5 V, the light-emitting thyristor L3 is not turned on.

Immediately after the time point d, the transfer thyristor T1 is in an ON state, and the light-emitting thyristor L1 is in an ON state and lighting up (emitting light).

<Light-Emitting Array Unit S-B1>

The transfer thyristor T1 is in an ON state, and the gate terminal Gt1 and the gate terminal Gt2 are "H" (0 V) and −1.5 V, respectively. When the selection signal φW1 transitions from "L" (−3.3 V) to "H" (0 V), the potential of the gate terminal Gl2 becomes −1.5 V, according to Table 1. Then, the threshold voltage of the light-emitting thyristor L2 increases from −4.3 V to −3 V. However, since the light-up signal φIb is maintained at "H" (0 V), the light-emitting thyristor L2 is not turned on.

Immediately after the time point d, the transfer thyristor T1 is in an ON state.

(5) Time Point e

At the time point e, the selection signal φW1 sent commonly to the light-emitting array units S-A1 and S-B1 of the light-emitting array unit class #1 transitions from "H" (0 V) to "L" (−3.3 V).

<Light-Emitting Array Unit S-A1>

Although the gate terminal Gt1 is "H" (0 V), since the selection signal φW1 transitions from "H" (0 V) to "L" (−3.3 V), the potential of the gate terminal Gl1 returns to −2.8 V, according to Table 1, and the threshold voltage of the light-emitting thyristor L1 becomes −4.3 V. However, since the light-up signal φIa is maintained at "L" (−3.3 V), the light-emitting thyristor L1 maintains its ON state, and is lighting up (emitting light).

Accordingly, immediately after the time point e, the transfer thyristor T1 is in an ON state, and the light-emitting thyristor L1 is in an ON state and lighting up (emitting light).

<Light-Emitting Array Unit S-B1>

Although the gate terminal Gt2 is −1.5 V, since the selection signal φW1 transitions from "H" (0 V) to "L" (−3.3 V), the potential of the gate terminal Gl2 returns from −1.5 V to −2.8 V, as is shown in Table 1, and the threshold voltage of the light-emitting thyristor L1 becomes −4.3 V.

Accordingly, immediately after the time point e, the transfer thyristor T1 is in an ON state.

(6) Time Point f

At the time point f, the second transfer signal φ2 transitions from "H" (0 V) to "L" (−3.3 V).

In the light-emitting array units S-A1 and S-B1, the transfer thyristor T2 having a threshold voltage of −3 V is turned on. Then, the potential of the gate terminal Gt2 becomes "H" (0 V), the potential of the gate terminal Gt3 becomes −1.5 V, and the potential of the gate terminal Gt4 becomes −3 V.

<Light-Emitting Array Unit S-A1>

At the time point f, since the selection signal φW1 (φW) is "L" (−3.3 V), the potential of the gate terminal Gl3 is −2.8 V, according to Table 1, and the threshold voltage of the light-emitting thyristor L3 is −4.3 V.

Note that, immediately after the time point f, the transfer thyristors T1 and T2 are in an ON state, and the light-emitting thyristor L1 is in an ON state and lighting up (emitting light).

<Light-Emitting Array Unit S-B1>

The potential of the gate terminal Gt2 becomes "H" (0 V), the potential of the gate terminal Gt3 becomes −1.5 V, and the potential of the gate terminal Gt4 becomes −3 V.

At the time point f, since the selection signal φW1 (φW) is "L" (−3.3 V), the potential of the gate terminal Gl2 is −2.8 V, according to Table 1, and the threshold voltage of the light-emitting thyristor L3 is −4.3 V.

Note that, immediately after the time point f, the transfer thyristors T1 and T2 are in an ON state.

(7) Time Point g

At the time point g, the first transfer signal φ1 transitions from "L" (−3.3 V) to "H" (0 V).

The potential of the cathode terminal of the transfer thyristor T1 of each of the light-emitting array units S-A1 and S-B1 becomes "H" (0 V) which is the potential of the anode terminal thereof, and therefore the transfer thyristor T1 is turned off. Then, the potential of the gate terminal Gt1 changes toward "L" (−3.3 V). The coupling diode Dx1 is then reverse-biased, and the potential of the gate terminal Gt2 being "H" (0 V) no longer affects the gate terminal Gt1.

<Light-Emitting Array Unit S-A1>

Since the selection signal φW1 (φW) is "L" (−3.3 V) at the time point f, when the potential of the gate terminal Gt1 becomes "L" (−3.3 V), the potential of the gate terminal Gl1 also becomes "L" (−3.3 V) which is the potential of the gate terminal Gt1. However, since the light-up signal ϕIa is maintained at "L" (−3.3 V), the light-emitting thyristor L1 maintains its ON state and is lighting up (emitting light).

Immediately after the time point g, the transfer thyristor T2 is in an ON state, and the light-emitting thyristor L1 is in an ON state and lighting up (emitting light).

<Light-Emitting Array Unit S-B1>

Immediately after the time point g, the transfer thyristor T2 is in an ON state.

(8) Time Point h

At the time point h, the light-up signal ϕIb sent commonly to the light-emitting array unit group #b transitions from "H" (0 V) to "L" (−3.3 V).

<Light-Emitting Array Unit S-A1>

Since there is no signal change in the light-emitting array unit group #a, the light-emitting array unit S-A1 maintains the state at the time point g.

<Light-Emitting Array Unit S-B1>

Even when the light-up signal line 75 becomes "L" (−3.3 V), none of the light-emitting thyristors L is turned on, since the threshold voltage of the light-emitting thyristor L2 is −4.3 V, the threshold voltage of the light-emitting thyristor L4 is −4.5 V, and the threshold voltage of the sixth and higher light-emitting thyristors L is −4.8 V.

Accordingly, immediately after the time point h, only the transfer thyristor T2 is in an ON state.

(9) Time Point i

At the time point i, the selection signal ϕW1 sent commonly to the light-emitting array units S-A1 and S-B1 of the light-emitting array unit class #1 transitions from "L" (−3.3 V) to "H" (0 V).

The transfer thyristor T2 of each of the light-emitting array units S-A1 and S-B1 is in an ON state, and the potential of the gate terminal Gt2 and the potential of the gate terminal Gt3 are "H" (0 V) and −1.5 V, respectively.

<Light-Emitting Array Unit S-A1>

When the selection signal ϕW1 transitions from "L" (−3.3 V) to "H" (0 V), the potential of the gate terminal Gl3 becomes −1.5 V, according to Table 1. Then, the threshold voltage of the light-emitting thyristor L3 increases from −4.3 V to −3 V.

Although the light-up signal ϕIa has been "L" (−3.3 V) since the time point c, since the thyristor L1 is lighting up (emitting light), the potential of the light-up signal line 75 is −1.5 V which is obtained by subtracting the diffusion potential Vd (−1.5 V) from "H" (0 V) which is the potential of the anode terminal. Accordingly, the light-emitting thyristor L3 is not turned on.

Immediately after the time point i, the transfer thyristor T2 is in an ON state, and the light-emitting thyristor L1 is in an ON state and lighting up (emitting light).

<Light-Emitting Array Unit S-B1>

When the selection signal ϕW1 transitions from "L" (−3.3 V) to "H" (0 V), the potential of the gate terminal Gl2 becomes "H" (0 V), according to Table 1. Then, the threshold voltage of the light-emitting thyristor L2 increases to −1.5 V.

Since the light-up signal ϕIb has been "L" (−3.3 V) since the time point h, the light-emitting thyristor L2 is turned on and lights up (emits light). Then, the potential of the light-up signal line 75 becomes −1.5 V which is obtained by subtracting the diffusion potential Vd (−1.5 V) from "H" (0 V) which is the potential of the anode terminal.

This state is the same as the state in which the light-emitting thyristor L1 of the light-emitting array unit S-A1 is turned on and lights up (emits light) at the time point d.

Immediately after the time point i, the transfer thyristor T2 is in an ON state, and the light-emitting thyristor L2 is in an ON state and lighting up (emitting light).

In other words, at the time point i, the light-emitting thyristors L1 of the respective light-emitting array units S-A1 and S-B1 forming the light-emitting array unit class #1 are lighting up in parallel.

(10) Time Point j

At the time point j, the selection signal ϕW1 sent commonly to the light-emitting array units S-A1 and S-B1 of the light-emitting array unit class #1 transitions from "L" (−3.3 V) to "H" (0 V). This state is similar to that at the time point d.

Specifically, the transfer thyristors T and the light-emitting thyristors L do not change in state in the light-emitting array units S-A1 and S-B1. In the light-emitting array unit S-A1, the transfer thyristor T2 is in an ON state, and the light-emitting thyristor L1 is in an ON state and lighting up (emitting light). In the light-emitting array unit S-B1, on the other hand, the transfer thyristor T2 is in an ON state, and the light-emitting thyristor L2 is in an ON state and lighting up (emitting light).

(11) Time Point k

At the time point k, the first transfer signal ϕ1 transitions from "H" (0 V) to "L" (−3.3 V). This state is similar to that at the time point f.

Specifically, the transfer thyristor T3 having a threshold voltage of −3 V is turned on in each of the light-emitting array units S-A1 and S-B1. Then, the potential of the gate terminal Gt3 becomes "H" (0 V), the potential of the gate terminal Gt4 becomes −1.5 V, and the potential of the gate terminal Gt5 becomes −3 V.

However, in the light-emitting array unit S-A1, the potential of the gate terminal Gl3 does not change from −2.8 V according to Table 1, and the threshold voltage of the light-emitting thyristor L3 is maintained at −4.3 V. Note that the potential of the light-up signal line 75 is maintained at −1.5 V since the light-emitting thyristor L1 is in an ON state.

In the light-emitting array unit S-B1, on the other hand, the potential of the gate terminal Gl4 becomes −2.8 V according to Table 1, and the threshold voltage of the light-emitting thyristor L3 becomes −4.3 V. Note that the potential of the light-up signal line 75 is maintained at −1.5 V since the light-emitting thyristor L2 is in an ON state.

(12) Time Point l

At the time point l, the second transfer signal ϕ2 transitions from "L" (−3.3 V) to "H" (0 V). This state is similar to that at the time point g.

Specifically, in the light-emitting array units S-A1 and S-B1, both of the anode terminal and the cathode terminal of the transfer thyristor T2 become "H" (0 V), and the transfer thyristor T2 is turned off. Thereby, the potential of the gate terminal Gt2 of the transfer thyristor T2 changes from "H" (0 V) toward "L" (−3.3 V).

Thus, the potential of the gate terminal Gt3 being "H" (0 V) no longer affects the gate terminal Gt2.

Also at the time point l, the light-emitting thyristor L1 of the light-emitting array unit S-A1 maintains its ON state and lighting up (emitting light) since the light-up signal ϕIa is "L" (−3.3 V).

Similarly, the light-emitting thyristor L2 of the light-emitting array unit S-B1 maintains its ON state and lighting up (emitting light) since the light-up signal ϕIb is "L" (−3.3 V).

(13) Time Point m

At the time point m, the light-up signal ϕIa sent to the light-emitting array unit group #a transitions from "L" (−3.3 V) to "H" (0 V).

<Light-Emitting Array Unit S-A1>

The light-emitting thyristor L1 of the light-emitting array unit S-A1 is turned off and is unlighted since the potentials of its anode terminal and cathode terminal both become "H" (0 V).

In other words, a light-up period of the light-emitting thyristor L1 of the light-emitting array unit S-A1 is between the time point d at which the selection signal ϕW1 (ϕW) transitions from "L" (−3.3 V) to "H" (0 V) and the time point m at which the light-up signal ϕIa transitions from "L" (−3.3 V) to "H" (0 V).

Immediately after the time point m, the transfer thyristor T3 is in an ON state.

<Light-Emitting Array Unit S-B1>

In the light-emitting array unit group #b, there is no signal change, and therefore the state at the time point l is maintained.

(14) Time Point n

At the time point n, the light-up signal ϕIa sent to the light-emitting array unit group #a again transitions from "H" (0 V) to "L" (−3.3 V).

<Light-Emitting Array Unit S-A1>

The period Ta(1) in which the light-emitting thyristor L1 of the light-emitting array unit group #a is light-controlled ends, and the period Ta(2) in which the light-emitting thyristor L3 is light-controlled starts. The period Ta (2) is repetition of the period Ta(1), and is therefore not described in detail here.

<Light-Emitting Array Unit S-B1>

In the light-emitting array unit group #b, there is no signal change, and therefore the state at the time point l is maintained.

(15) Time Point o

At the time point o, the light-up signal ϕIb sent to the light-emitting array unit group #b transitions from "L" (−3.3 V) to "H" (0 V).

<Light-Emitting Array Unit S-A1>

In the light-emitting array unit group #a, there is no signal change, and therefore the prior state is maintained.

<Light-Emitting Array Unit S-B1>

The light-emitting thyristor L2 of the light-emitting array unit S-B1 is turned off and unlighted since the potentials of its anode terminal and cathode terminal both become "H" (0 V).

In other words, a light-up period of the light-emitting thyristor L2 of the light-emitting array unit S-B1 is between the time point i at which the selection signal ϕW1 (ϕW) transitions from "L" (−3.3 V) to "H" (0 V) and the time point o at which the light-up signal ϕIb transitions from "L" (−3.3 V) to "H" (0 V).

Immediately after the time point o, the transfer thyristor T3 is in an ON state.

(16) Time Point p

At the time point p, the light-up signal ϕIb sent to the light-emitting array unit group #b again transitions from "H" (0 V) to "L" (−3.3 V).

<Light-Emitting Array Unit S-A1>

In the light-emitting array unit group #a, there is no signal change, and therefore the prior state is maintained.

<Light-Emitting Array Unit S-B1>

The period Tb(1) in which the light-emitting thyristor L2 of the light-emitting array unit group #b is light-controlled ends, and the period Tb(2) in which the light-emitting thyristor L4 is light-controlled starts. The period Tb(2) is repetition of the period Tb(1), and is therefore not described in detail here.

Note that, if the selection signal ϕW1 does not transition from "L" (−3.3 V) to "H" (0 V), but is maintained at "L" (−3.3 V) in the light-emitting array unit S-A or S-B, the light-emitting thyristor L may be maintained not to light up (maintained unlighted). For example, in the light-emitting array unit S-A2, the selection signal ϕW2 is maintained at "L" (−3.3 V) at the time point d in the period Ta(1). Thereby, even when the gate terminal Gt1 of the light-emitting array unit S-A2 is "H" (0 V), the potential of the gate terminal Gl1 of the light-emitting thyristor L1 is maintained at −2.8 V, and the threshold voltage becomes −4.3 V. Accordingly, even when the light-up signal ϕIa sent to the light-emitting array unit S-A2 has been "L" (−3.3 V) since the time point c, the light-emitting thyristor L1 is not turned on and maintains its not-lighting-up (unlighted) state.

As described earlier, the light-up period of the thyristors L of the light-emitting array units S-A (light-emitting array units S-A1 to S-A20) and the light-emitting array units S-B (light-emitting array units S-B1 to S-B20) is between the time point at which the selection signal ϕW (ϕW1 to ϕW20) sent to the ϕW terminal transitions from "L" (−3.3 V) to "H" (0 V) and the time point at which the light-up signal ϕI (ϕIa, ϕIb) transitions from "L" (−3.3 V) to "H" (0 V).

Accordingly, a light-up period for exposing the photoconductive drums 12 to light may be set considering the light-emitting intensity of the light-emitting thyristors L. Specifically, a light-up start time point may be set based on a correction value for each of the light-emitting thyristors L which is calculated from the light-emitting intensity of the light-emitting thyristor L and accumulated in, for example, a nonvolatile memory provided to the image output controller 30 or the signal generating circuit 110. In this way, a light amount may be corrected (light-amount correction may be performed) for each of the light-emitting thyristors L, and thus an image may be formed with a reduced difference, due to the light-emitting thyristors L, in light-exposure amount among the photoconductive drums 12.

In the first exemplary embodiment, using a combination of the light-up signal ϕI (ϕIa and ϕIb) and the selection signal ϕW (ϕW1 to ϕW20) allows the light-up period to be set for each of the light-emitting thyristors L by selecting the light-emitting array units S-A (the light-emitting array units S-A1 to S-A20) and the light-emitting array units S-B (the light-emitting array units S-B1 to S-B20) without repetition and setting a light-up start time point for each of the light-emitting thyristors L.

For example, in FIG. 9, the light-up start time point for the light-emitting thyristor L1 of the light-emitting array unit S-A3 of the light-emitting array unit class #3 is set with a delay from the light-up start time point d of the light-emitting thyristor L1 of the light-emitting array unit S-A1 of the light-emitting array unit class #1.

As described thus far, in the first exemplary embodiment, the potential Gt(X) of the two-input AND circuit AND1 is set to "H" (0 V) by sequentially bringing the transfer thyristors T into an ON state. Then, it is configured such that, when ϕW(Y) becomes "H" (0 V), the gate terminal Gl becomes "H" (0 V), and the threshold voltage of the light-emitting thyristor L becomes −1.5 V.

By bringing the selection signal ϕW to "H" (0 V) when one transfer thyristor T is in an ON state, the light-emitting thyristor L set by the transfer thyristor T in an ON state is turned on and lights up (emits light).

The transfer thyristors T of certain numbers that are not provided with the light-emitting thyristors L in the light-emitting array unit S-A are provided with the light-emitting thyristors L in the light-emitting array unit S-B. Further, the transfer thyristors T of certain numbers that are not provided with the light-emitting thyristors L in the light-emitting array unit S-B are provided with the light-emitting thyristors L in the light-emitting array units S-A. In other words, the light-emitting array unit S-A and the light-emitting array unit S-B complement each other. Thus, the light-emitting thyristors L of the light-emitting array unit S-A and the light-emitting thyristors L of the light-emitting array unit S-B light up (emit light) in parallel.

Further, in the first exemplary embodiment, the selection signal φW1 (φW) transitions from "L" (−3.3 V) to "H" (0 V) after the light-up signal φIa transitions from "H" (0 V) to "L" (−3.3 V). Alternatively, the light-up signal φIa may transition from "H" (0 V) to "L" (−3.3 V) after the selection signal φW1 (φW) transitions from "L" (−3.3 V) to "H" (0 V).

Then, the first transfer signal φ1 is sent commonly to the light-emitting array units S-A (the light-emitting array units S-A1 to S-A20), and the second transfer signal φ2 is sent commonly to the light-emitting array units S-B (the light-emitting array units S-B1 to S-B20) to drive them in parallel. In addition, the light-up signal φI (φIa and φIb) is sent commonly to each of the light-emitting array unit groups #a and #b.

In the first exemplary embodiment, the number of wirings provided to the circuit board 62 is reduced because a combination of the light-up signal φI (φIa and φIb) and the selection signal φW (φW1 to φW20) is used to make a selection among the light-emitting array units S-A (the light-emitting array units S-A1 to S-A20) and the light-emitting array units S-B (the light-emitting array units S-B1 to S-B20)

Second Exemplary Embodiment

In the second exemplary embodiment, the light-emitting array units S-A and S-B in the first exemplary embodiment form one light-emitting array unit S. Specifically, the light-emitting array unit S in the second exemplary embodiment includes two self-scanning light-emitting device arrays (SLED). In the first exemplary embodiment, two types of arrays (the light-emitting array units S-A and S-B) are used. However, in the second exemplary embodiment, one type of array, the light-emitting array unit S, is used. The light-emitting array unit S may be a light-emitting chip. The light-emitting array unit S is described as being a light-emitting chip below.

Figures 10A, 10B:
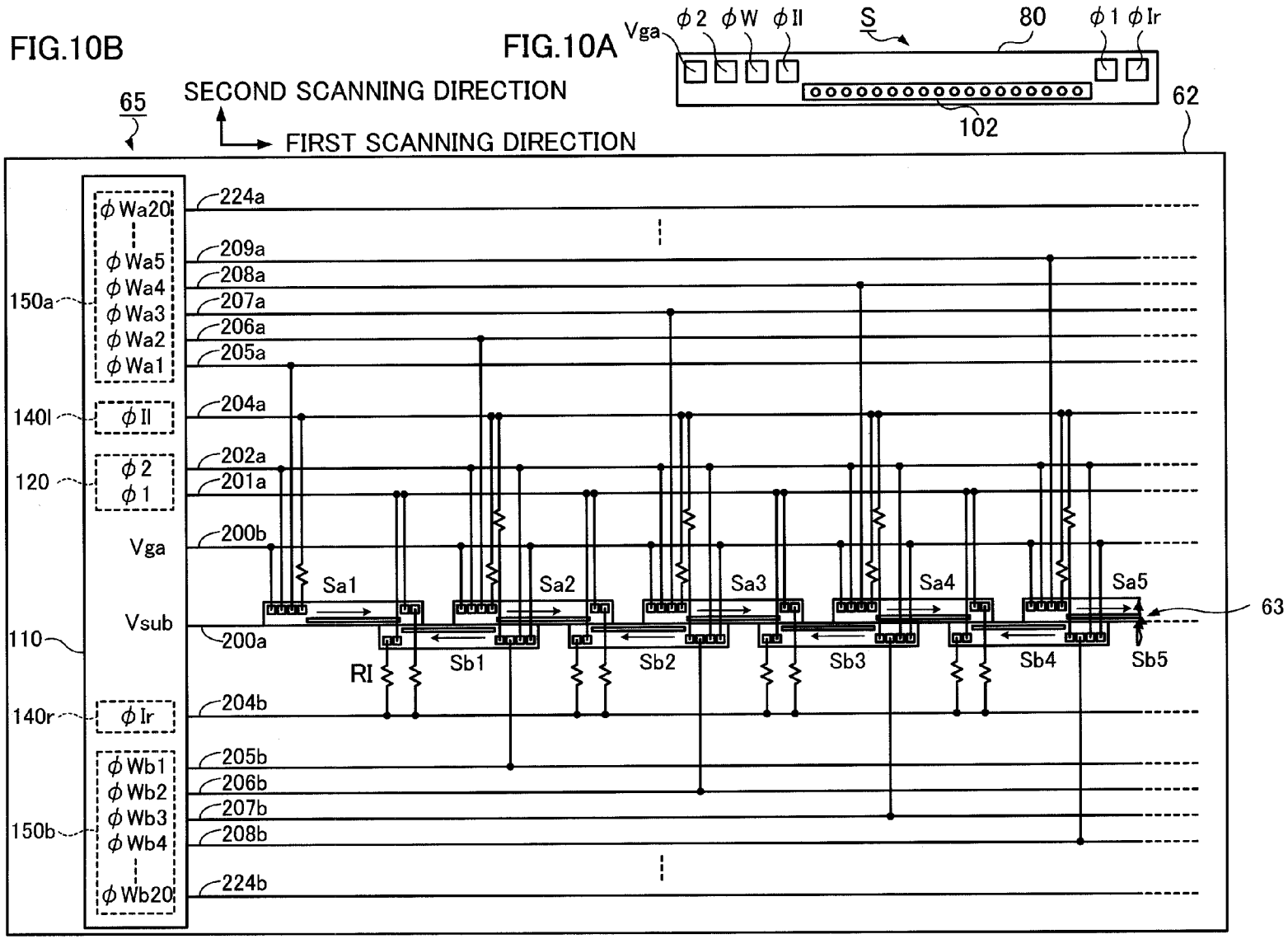
FIGS. 10A and 10B are diagrams showing a configuration of the light-emitting array unit, a configuration of the signal generating circuit of the light-emitting device, and a wiring configuration on the circuit board, in the second exemplary embodiment.

FIGS. 10A and 10B are diagrams showing a configuration of the light-emitting array unit S, a configuration of the signal generating circuit 110 of the light-emitting device 65, and a wiring configuration on the circuit board 62, in the second exemplary embodiment. FIG. 10A shows a configuration of the light-emitting array unit S, and FIG. 10B shows a configuration of the signal generating circuit 110 of the light-emitting device 65 and a wiring configuration on the circuit board 62. In the second exemplary embodiment, forty light-emitting array units S are used, and twenty light-emitting array units Sa1 to Sa20 and twenty light-emitting array units Sb1 to Sb20 are arranged. When not differentiated from one another, the light-emitting array units Sa1 to Sa20 are called light-emitting array units Sa. Likewise, when not differentiated from one another, the light-emitting array units Sb1 to Sb20 are called light-emitting array units Sb. Further, when not differentiated from each other, the light-emitting array units Sa and the light-emitting array units Sb are called light-emitting array units S.

First, a configuration of the light-emitting array unit S shown in FIG. 10A is described. In the following, differences from the light-emitting array units S-A and S-B described in the first exemplary embodiment are described, and the same configurations are denoted by the same reference signs and are not described in detail.

The light-emitting array unit S includes input terminals (the Vga terminal, the φ2 terminal, the φW terminal, a φIl terminal, the φ1 terminal, and a φIr terminal) at both end portions, in the long-side direction, of the substrate 80. These input terminals are bonding pads for reading various control signals and the like. The φI terminal of each of the light-emitting array units S-A and S-B described in the first exemplary embodiment is divided into the φIl terminal and the φIr terminal (see FIG. 11 to be described later). These input terminals arranged as follows. Specifically, the Vga terminal, the φ2 terminal, the φW terminal, and the φIl terminal are arranged in this order from one end portion of the substrate 80, and the φIr terminal and the φ1 terminal are arranged in this order from the other end of the substrate 80. Then, the light-emitting element array 102 is provided between the φIl terminal and the φ1 terminal.

Next, using FIG. 10B, a configuration of the signal generating circuit 110 of the light-emitting device 65 and a wiring configuration on the circuit board 62 are described.

As described earlier, the circuit board 62 of the light-emitting device 65 has the signal generating circuit 110, the light-emitting array units Sa1 to Sa20 and the light-emitting array units Sb1 to Sb20. Wirings are provided to connect the signal generating circuit 110 to the light-emitting array units Sa1 to Sa20 and to the light-emitting array units Sb1 to Sb20.

First, a configuration of the signal generating circuit 110 is described. In the following, differences from the light-emitting array units S-A and S-B described in the first exemplary embodiment are described, and the same configurations are denoted by the same reference signs and are not described in detail.

The signal generating circuit 110 includes the transfer signal generating part 120 that sends, based on the various control signals, the first transfer signal φ1 and a second transfer signal φ2 to the light-emitting array units Sa1 to Sa20 and to the light-emitting array units Sb1 to Sb20.

In addition, the signal generating circuit 110 includes a light-up signal generating part 140*l* and a light-up signal generating part 140*r*. Based on the various control signals, the light-up signal generating part 140*l* sends a light-up signal φIl to the light-emitting array units Sa1 to Sa20 and the light-emitting array units Sb1 to Sb20, and the light-up signal generating part 140*r* sends a light-up signal φIr to the light-emitting array units Sa1 to Sa20 and the light-emitting array units Sb1 to Sb20.

Moreover, the signal generating circuit 110 includes a selection signal generating part 150*a* and a selection signal generating part 150*b*. Based on the various control signals, the selection signal generating part 150*a* sends selection signals φWa1 to φWa20 to the respective light-emitting array units Sa1 to Sa20, and the selection signal generating part 150*b* sends selection signals φWb1 to φWb20 to the respective light-emitting array units Sb1 to Sb20.

In other words, in the second exemplary embodiment, two self-scanning light-emitting device arrays (SLED) (see an SLED-1 and an SLED-r in FIG. 11 to be described later) included in the light-emitting array unit S form a pair.

Although shown separately in FIG. 10B, the light-up signal generating part 140*l* and the light-up signal generating part 140*r* are collectively called the light-up signal generating part 140. Moreover, when not differentiated from each other, the light-up signal φIl and the light-up signal φIr are called the light-up signal φI. Further, although shown separately in FIG. 10B, the selection signal generating part 150*a* and the selection signal generating part 150*b* are collectively called the selection signal generating part 150. Furthermore, when not differentiated from one another, the selection signals φWa1 to ϕWa20 are called a selection signal ϕWa, and when not differentiated from one another, the selection signals ϕWb1 to ϕWb20 are called a selection signal ϕWb. The selection signal ϕWa and the selection signal ϕWb are collectively called the selection signal ϕW.

The arrangement of the light-emitting array units Sa1 to Sa20 and the light-emitting array units Sb1 to Sb20 are the same as that of the light-emitting array units S-A1 to S-A20 and the light-emitting array units S-B1 to S-B20 in the first exemplary embodiment.

A description is given of wirings that connect the signal generating circuit 110 to the light-emitting array units Sa1 to Sa20 and to the light-emitting array units Sb1 to Sb20.

The circuit board 62 is provided with the light-up signal line 204*a* for sending the light-up signal ϕIl from the light-up signal generating part 140*l* of the signal generating circuit 110 to the ϕIl terminals of the light-emitting array units Sa1 to Sa20 and the light-emitting array units Sb1 to Sb20. The light-up signal ϕIl is sent commonly (in parallel) to the light-emitting array units Sa1 to Sa20 and the light-emitting array units Sb1 to Sb20 through the current limitation resistors RI provided for the respective light-emitting array units Sa1 to Sa20 and light-emitting array units Sb1 to Sb20.

Likewise, the circuit board 62 is provided with the light-up signal line 204*b* for sending the light-up signal ϕIr from the light-up signal generating part 140*r* of the signal generating circuit 110 to the ϕI terminals of the light-emitting array units Sa1 to Sa20 and the light-emitting array units Sb1 to Sb20. The light-up signal ϕIr is sent commonly (in parallel) to the light-emitting array units Sa1 to Sa20 and the light-emitting array units Sb1 to Sb20 through the current limitation resistors RI provided for the respective light-emitting array units Sa1 to Sa20 and light-emitting array units Sb1 to Sb20.

Furthermore, the circuit board 62 is provided with selection signal lines 205*a* to 224*a* through which the selection signals ϕWa1 to ϕWa20 are sent from the selection signal generating part 150*a* of the signal generating circuit 110 to the respective light-emitting array units Sa1 to Sa20. In addition, the circuit board 62 is provided with selection signal lines 205*b* to 224*b* through which the selection signals ϕWb1 to ϕWb20 are sent from the selection signal generating part 150*b* of the signal generating circuit 110 to the respective light-emitting array units Sb1 to Sb20.

As described earlier, all of the light-emitting array units Sa and Sb on the circuit board 62 are commonly supplied with the reference potential Vsub and the power supply potential Vga. Likewise, all of the light-emitting array units Sa and Sb on the circuit board 62 are commonly supplied with the first transfer signal ϕ1 and the second transfer signal ϕ2.

The light-up signals ϕIl and ϕIr are sent commonly to all of the light-emitting array units Sa and Sb.

The selection signals ϕWa1 to ϕWa20 are sent to the respective light-emitting array units Sa1 to Sa20, and the selection signals ϕWb1 to ϕWb20 are sent to the respective light-emitting array units Sb1 to Sb20.

Here, the number of wirings is described.

If the second exemplary embodiment is not employed, two light-up signals ϕI are sent to each of the light-emitting array units Sa1 to Sa20 and Sb1 to Sb20; therefore, eighty light-up signal lines 204 (corresponding to the light-up signal lines 204*a* and 204*b* in FIG. 10B) are needed. In addition, the first transfer signal line 201, the second transfer signal line 202, and the power supply lines 200*a* and 200*b* are needed. Accordingly, the number of wirings provided to the light-emitting device 65 is eighty-four.

Moreover, since a current for lighting up light-emitting elements is sent through the light-up signal line 204, the light-up signal line 204 needs to have a small resistance. Accordingly, the light-up signal line 204 requires a wide wiring. For that reason, if the second exemplary embodiment is not employed, many wide wirings are provided on the circuit board 62 of the light-emitting device 65, which increases the area of the circuit board 62.

In the second exemplary embodiment, as FIG. 10B shows, the selection signal lines 205*a* to 224*a* corresponding to the selection signals ϕWa1 to ϕWa20 and the selection signal lines 205*b* to 224*b* corresponding to the selection signals ϕWb1 to ϕWb20 are needed in addition to the first transfer signal line 201, the second transfer signal line 202, and the power supply lines 200*a* and 200*b*. Accordingly, in the second exemplary embodiment, the number of wirings is forty-six.

The number of wirings in the second exemplary embodiment is about ½ of that in the case of not employing the second exemplary embodiment.

Furthermore, in the second exemplary embodiment, the number of wide wirings used for sending a current for lighting up the light-emitting elements is reduced to two, namely, the light-up signal lines 204*a* and 204*b*. Since a large current does not flow through the selection signal lines 205*a* to 224*a* and 205*b* to 224*b*, the selection signal lines 205*a* to 224*a* and 205*b* to 224*b* do not require wide wirings. For those reasons, the second exemplary embodiment does not require many wide wirings to be provided on the circuit board 62, which prevents an increase in the area of the circuit board 62.

Figure 11:
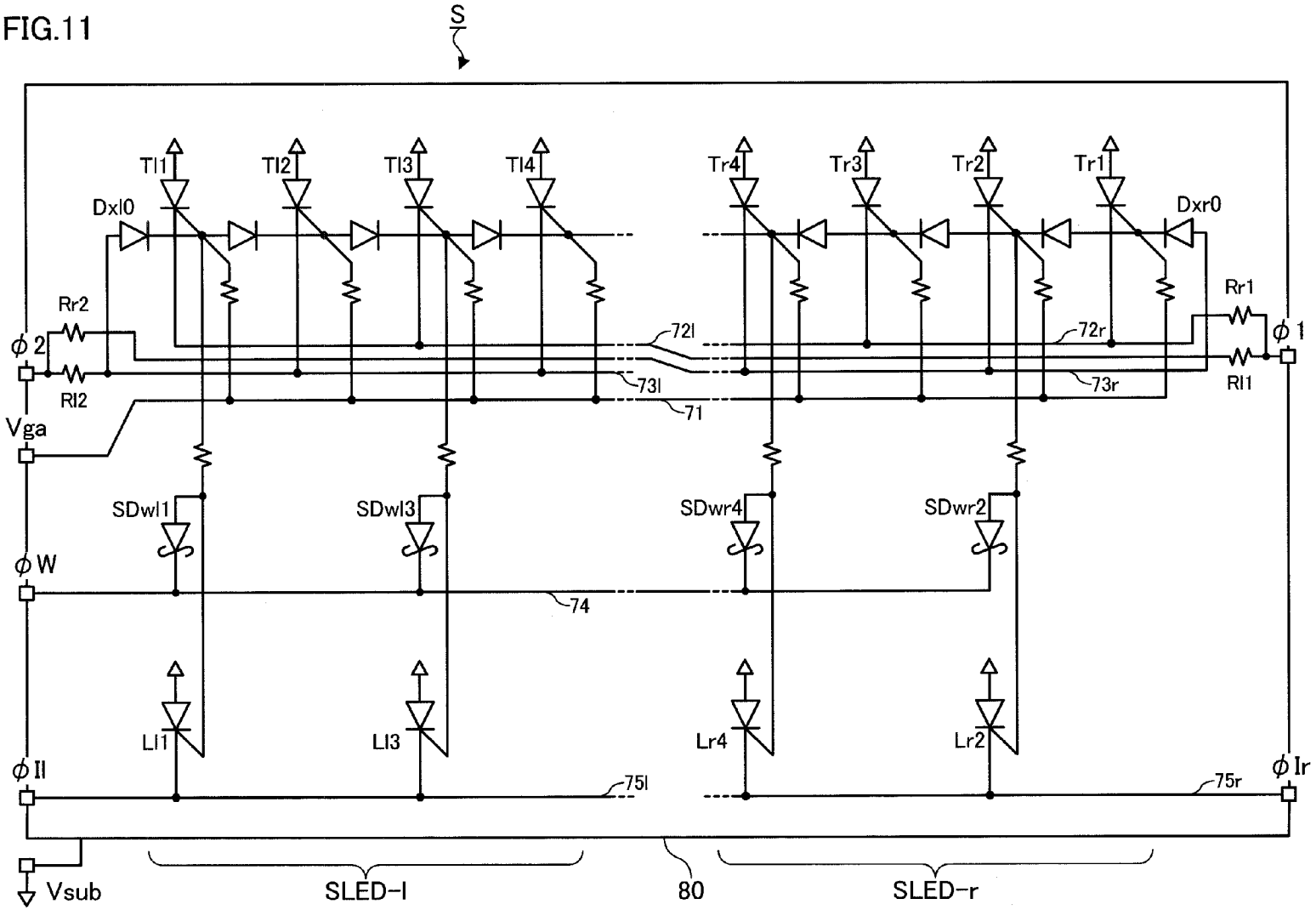
FIG. 11 is an equivalent circuit diagram for illustrating a circuit configuration of the light-emitting array unit in the second exemplary embodiment.

FIG. 11 is an equivalent circuit diagram for illustrating a circuit configuration of the light-emitting array unit S in the second exemplary embodiment. The light-emitting array unit S is a self-scanning light-emitting device array (SLED). Each of the light-emitting array units Sa1 to Sa20 and the light-emitting array units Sb1 to Sb20 has the same configuration as the light-emitting array unit S.

The light-emitting array unit S is configured by arranging the light-emitting array units S-A and S-B in the first exemplary embodiment on the single substrate 80. In FIG. 11, the SLED-1 on the left is a part corresponding to the light-emitting array unit S-A, and the SLED-r on the right is a part corresponding to the light-emitting array unit S-B.

Like the light-emitting array unit S-A shown in FIG. 6, the light-emitting array unit S has transfer thyristors Tl1, Tl2, Tl3, . . . and light-emitting thyristors Ll1, Ll3, . . . arranged from the left of FIG. 11 in numerical order. Although a detailed description is not given here, the other elements are arranged in a similar manner to the light-emitting array unit S-A shown in FIG. 6. These elements form the SLED-1.

Similarly, like the light-emitting array unit S-B shown in FIG. 7, transfer thyristors Tr1, Tr2, Tr3, . . . and light-emitting thyristors Lr2, Lr4, . . . are arranged from the right of FIG. 11 in numerical order. Although a detailed description is not given here, the other elements are arranged in a similar manner to the light-emitting array unit S-B shown in FIG. 7. These elements form the SLED-r.

Hereinafter, when not differentiated from one another, the transfer thyristors Tl1, Tl2, Tl3, . . . and the transfer thyristors Tr1, Tr2, Tr3 are called transfer thyristors T. Likewise, when not differentiated from one another, the light-emitting thyristors Ll1, Ll3, . . . and the light-emitting thyristors Ll1, Ll4, . . . are called light-emitting thyristors L.

Note that the number of the light-emitting thyristors L in each of the SLED-1 and SLED-r may be any predetermined number, such as 128.

The cathode terminals of the odd-numbered transfer thyristors Tl1, Tl3, Tl5, . . . in the SLED-1 are connected to a first transfer signal line 72*l*, and are connected through a current limitation resistor Rl1 to the ϕ1 terminal shown on the right edge of FIG. 11. The cathode terminals of the even-numbered transfer thyristors Tl2, Tl4, Tl6, . . . in the SLED-1 are connected to a second transfer signal line 73*l*, and are connected through a current limitation resistor Rl2 to the ϕ2 terminal shown on the left edge of FIG. 11.

The anode terminal of a start diode Dxl0 of the SLED-1 is connected to the second transfer signal line 73*l*, and the cathode terminal thereof is connected to a gate terminal (having no reference numeral) of the transfer thyristor Tl1.

On the other hand, the cathode terminals of the odd-numbered transfer thyristors Tr1, Tr3, Tr5, . . . in the SLED-r are connected to a first transfer signal line 72*r*, and are connected through a current limitation resistor Rr1 to the ϕ1 terminal shown on the right edge of FIG. 11. The cathode terminals of the even-numbered transfer thyristors Tr2, Tr4, Tr6, . . . in the SLED-r are connected to a second transfer signal line 73*r*, and are connected through a current limitation resistor Rr2 to the ϕ2 terminal shown on the left edge of FIG. 11.

The anode terminal of a start diode Dxr0 of the SLED-r is connected to the second transfer signal line 73*r*, and the cathode terminal thereof is connected to a gate terminal (having no reference numeral) of the transfer thyristor Tr1.

The first transfer signal ϕ1 is sent to the ϕ1 terminal, and the second transfer signal ϕ2 is sent to the ϕ2 terminal. In other words, the first transfer signal ϕ1 and the second transfer signal ϕ2 are sent commonly to the SLED-1 and to the SLED-r.

The cathode terminals of Schottky write diodes SDwl1, SDwl3, . . . of the SLED-1 and the cathode terminals of Schottky write diodes SDwr2, SDwr4, . . . of the SLED-r are connected to the selection signal line 74. The selection signal line 74 is connected to the ϕW terminal, shown on the left edge of FIG. 11, which is an example of the control terminal.

Any one of the selection signals ϕWa1 to ϕWa20 or ϕWb1 to ϕWb20 is sent to the ϕW terminal.

The cathode terminals of the light-emitting thyristors Ll1, Ll3, . . . of the SLED-1 are connected to a light-up signal line 75*l*. The light-up signal line 75*l* is connected to the ϕIl terminal shown on the left edge of FIG. 11. The cathode terminals of the light-emitting thyristors Lr2, Lr4, of the SLED-r are connected to a light-up signal line 75*r*. The light-up signal line 75*r* is connected to the ϕIr terminal shown on the right edge of FIG. 11. The light-up signal ϕIl is sent to the ϕIl terminal, and the light-up signal ϕIr is sent to the ϕIr terminal.

Figure 12:
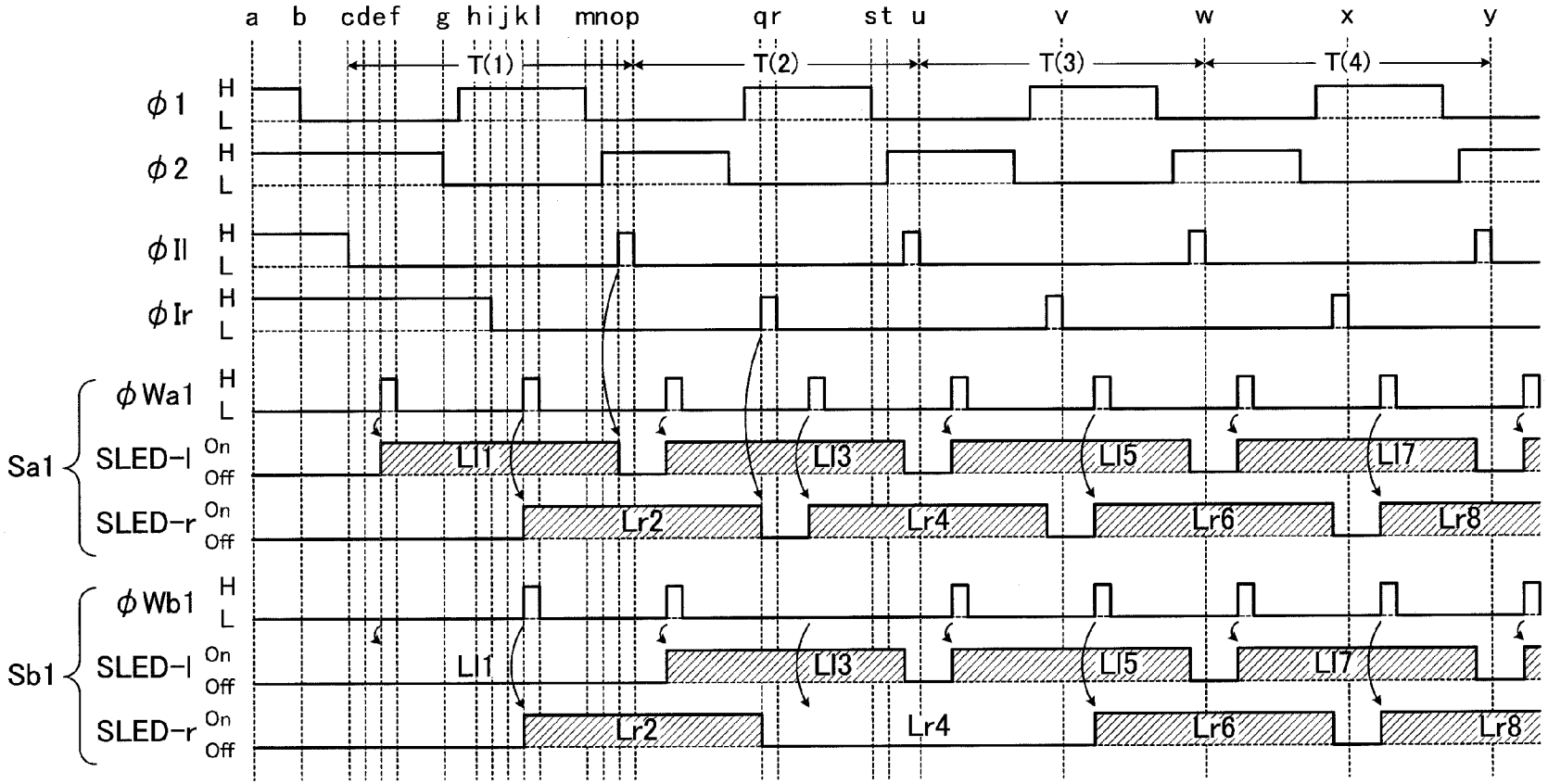
FIG. 12 is a timing chart for illustrating the operations of the light-emitting device and the light-emitting array unit in the second exemplary embodiment.

FIG. 12 is a timing chart for illustrating the operations of the light-emitting device 65 and the light-emitting array unit S in the second exemplary embodiment. FIG. 12 shows a timing chart illustrating the operations of the SLED-1 and the SLED-r of the light-emitting array unit Sa1 and the operations of the SLED-1 and SLED-r of the light-emitting array unit Sb1.

Here, in the light-emitting array unit Sa1, the light-emitting thyristors Ll1, Ll3, Ll5, and Ll7 are to be lighted up in the SLED-1, and the light-emitting thyristors Lr2, Lr4, Lr6, and Lr8 are to be lighted up in the SLED-r.

In the light-emitting array unit Sb1, the light-emitting thyristors Ll3, Ll5, and Ll7 are to be lighted up in the SLED-1, and the light-emitting thyristors Lr2, Lr6, and Lr8 are to be lighted up in the SLED-r.

In the second exemplary embodiment, the light-emitting array unit S is formed on the single substrate 80 with the light-emitting array units S-A and S-B of the first exemplary embodiment as the SLED-1 and the SLED-r, respectively. Moreover, in the second exemplary embodiment, the SLED-1 and the SLED-r of each light-emitting array unit S form the light-emitting array unit class in the first exemplary embodiment. Accordingly, in the second exemplary embodiment, there are forty light-emitting array unit pairs.

The SLED-1 of each light-emitting array unit S of the second exemplary embodiment corresponds to the light-emitting array unit group #a of the first exemplary embodiment, and the SLED-r of each light-emitting array unit S of the second exemplary embodiment corresponds to the light-emitting array unit group #b of the first exemplary embodiment.

For those reasons, in FIG. 12, the light-up signals ϕIa and ϕIb in FIG. 9 are replaced with the light-up signals ϕIl and ϕIr, respectively, and the light-emitting array units S-A and S-B in FIG. 9 are replaced with the SLED-1 and the SLED-r, respectively. Thus, the operations of the light-emitting device 65 and the light-emitting array unit S of the second exemplary embodiment are understandable from the description given for the first exemplary embodiment. A detailed description is therefore not given here.

Third Exemplary Embodiment

In the third exemplary embodiment, three light-emitting array unit groups (#a, #b, and #c) are provided.

Figure 13:
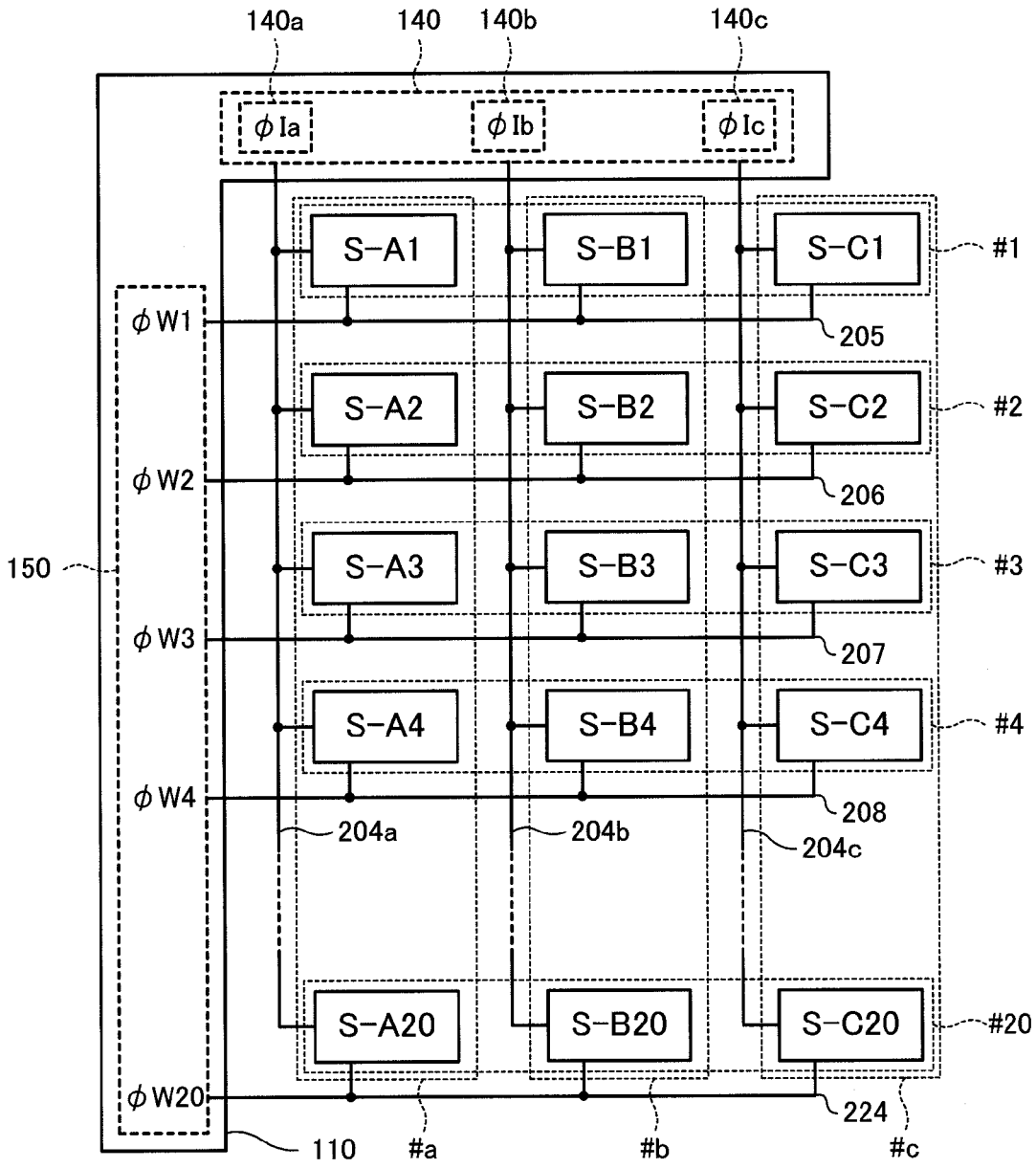
FIG. 13 is a diagram showing light-emitting array units on the circuit board of the light-emitting device in the third exemplary embodiment, arranged as matrix elements.

FIG. 13 is a diagram showing light-emitting array units S-A1 to S-A20, S-B1 to S-B20, and S-C1 to S-C20 on the circuit board 62 of the light-emitting device 65 in the third exemplary embodiment, arranged as matrix elements. Here, when not differentiated from one another, the light-emitting array units S-A1 to S-A20, the light-emitting array units S-B1 to S-B20, and the light-emitting array unit S-C1 to S-C20 are called light-emitting array units S-A, S-B, and S-C, respectively.

There are twenty light-emitting array units S-A, twenty light-emitting array units S-B, and twenty light-emitting array units S-C. The light-emitting array unit group #a includes the light-emitting array units S-A1 to S-A20, the light-emitting array unit group #b includes the light-emitting array units S-B1 to S-B20, and the light-emitting array unit group #c includes the light-emitting array unit S-C1 to S-C20.

Accordingly, a light-up signal generating part 140*c* for sending a light-up signal ϕIc to the light-emitting array unit group #c is additionally provided in the signal generating circuit 110 of the first exemplary embodiment. Other configurations are the same as that of the first exemplary embodiment, and are therefore not described here.

A light-emitting array unit class #1 is formed by the light-emitting array units S-A1, S-B1, and S-C1. A light-emitting array unit class #2 is formed by the light-emitting array units S-A2, S-B2, and S-C2. In the same manner for the rest of the pairs, the light-emitting array unit class #20 is formed by the light-emitting array units S-A20, S-B20, and S-C20. In other words, there are twenty light-emitting array unit pairs.

Here, the number of wirings is described.

Suppose that the third exemplary embodiment is not employed, and that the light-emitting array units S-A, S-B, and S-C of the light-emitting device 65 are not divided into the light-emitting array unit groups. Then, if the total number of the light-emitting array units S-A, S-B, and S-C is sixty, sixty light-up signal lines 204 (corresponding to the light-up signal lines 204*a* and 204*b* in FIG. 4C) are needed because the light-up signal ϕI is sent to each of the light-emitting array units S-A, S-B, and S-C. In addition, the first transfer signal line 201, the second transfer signal line 202, and the power supply lines 200*a* and 200*b* are needed. Accordingly, the number of wirings provided to the light-emitting device 65 is sixty-four.

Moreover, since a current for lighting up light-emitting elements is sent through the light-up signal line 204, the light-up signal line 204 needs to have a small resistance. Accordingly, the light-up signal line 204 requires a wide wiring. For that reason, if the third exemplary embodiment is not employed, many wide wirings are provided on the circuit board 62 of the light-emitting device 65, which increases the area of the circuit board 62.

In the third exemplary embodiment, there are three light-emitting array unit groups as shown in FIG. 13. Accordingly, three light-up signal lines are needed, namely, a light-up signal line 204*c* in addition to the light-up signal lines 204*a* and 204*b* shown in FIG. 4C. Further, like the first exemplary embodiment, the first transfer signal line 201, the second transfer signal line 202, the power supply lines 200*a* and 200*b*, and the selection signal lines 205 to 224 are needed. Accordingly, in the third exemplary embodiment, the number of wirings is twenty-seven.

Note that, thirty selection signal lines (corresponding to 205 to 224 in FIG. 13) are needed if the number of light-emitting array unit groups is two like the first exemplary embodiment. Accordingly, if the number of light-emitting array unit groups is two, thirty-six wirings are needed.

In the third exemplary embodiment, the number of wirings is about ½ of that in the case of not employing the third exemplary embodiment. Further, the number of wirings in the case of having three light-emitting array unit groups is ¾ of that in the case of having two light-emitting array unit groups.

Furthermore, in the third exemplary embodiment, the number of wide wirings used for sending a current for lighting up the light-emitting elements is reduced to the three light-up signal lines 204*a*, 204*b*, and 204*c*. Since a large current does not flow through the selection signal lines 205 to 224, the selection signal lines 205 to 224 do not require wide wirings. For those reasons, the third exemplary embodiment does not require many wide wirings to be provided on the circuit board 62, which prevents an increase in the area of the circuit board 62.

The first exemplary embodiment uses the light-emitting array units S-A and S-B having different configurations. The third exemplary embodiment uses three types of light-emitting array units having different configurations, namely the light-emitting array units S-A, S-B, and S-C.

Figure 14:
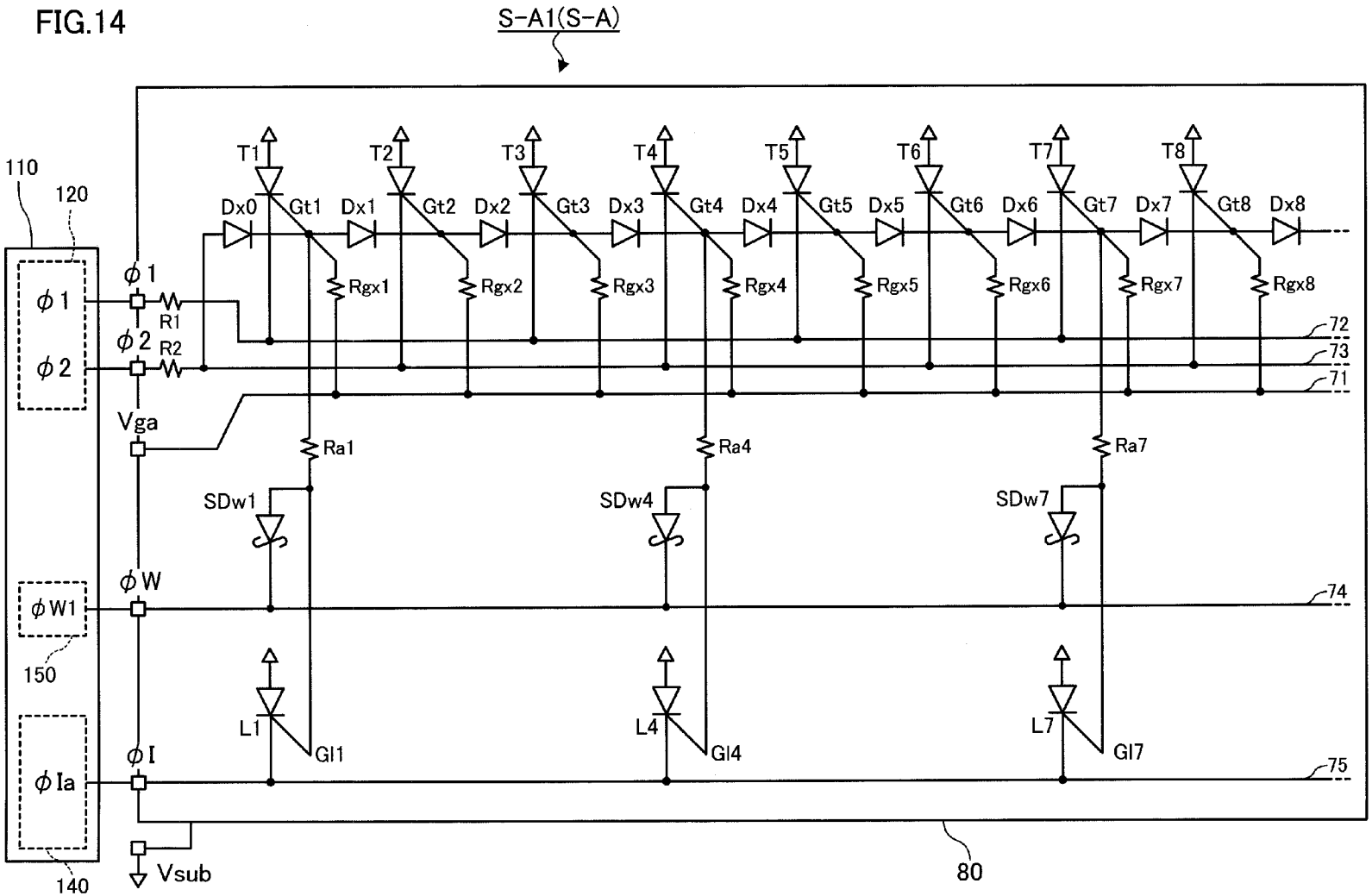
FIG. 14 is an equivalent circuit diagram for illustrating a circuit configuration of the light-emitting array unit in the third exemplary embodiment.

FIG. 14 is an equivalent circuit diagram for illustrating a circuit configuration of the light-emitting array unit S-A in the third exemplary embodiment. The light-emitting array unit S-A is a self-scanning light-emitting device array (SLED). Here, the light-emitting array unit S-A is described taking the light-emitting array unit S-A1 as an example. The light-emitting array unit S-A is thus called a light-emitting array unit S-A1(S-A) in FIG. 14.

As shown in FIG. 6, in the light-emitting array unit S-A in the first exemplary embodiment, the light-emitting thyristors L are provided for the respective (2n−1)-th transfer thyristors T (n is an integer of 1 or higher). In other words, the light-emitting thyristors L are provided for the respective odd-numbered transfer thyristors T. In contrast, as shown in FIG. 14, in the light-emitting array unit S-A in the third exemplary embodiment, the light-emitting thyristors L are provided for the respective (3n−2)-th transfer thyristors T (n is an integer of 1 or higher). In other words, the light-emitting thyristor L is provided for every three transfer thyristors T. Configurations that are the same as those in FIGS. 6 and 7 are denoted by the same reference signs, and are not described in detail.

Note that, in the light-emitting array unit S-A1, the selection signal ϕW1 is sent to the ϕW terminal which is an example of the control terminal, and the light-up signal ϕIa is sent to the ϕI terminal.

Figure 15:
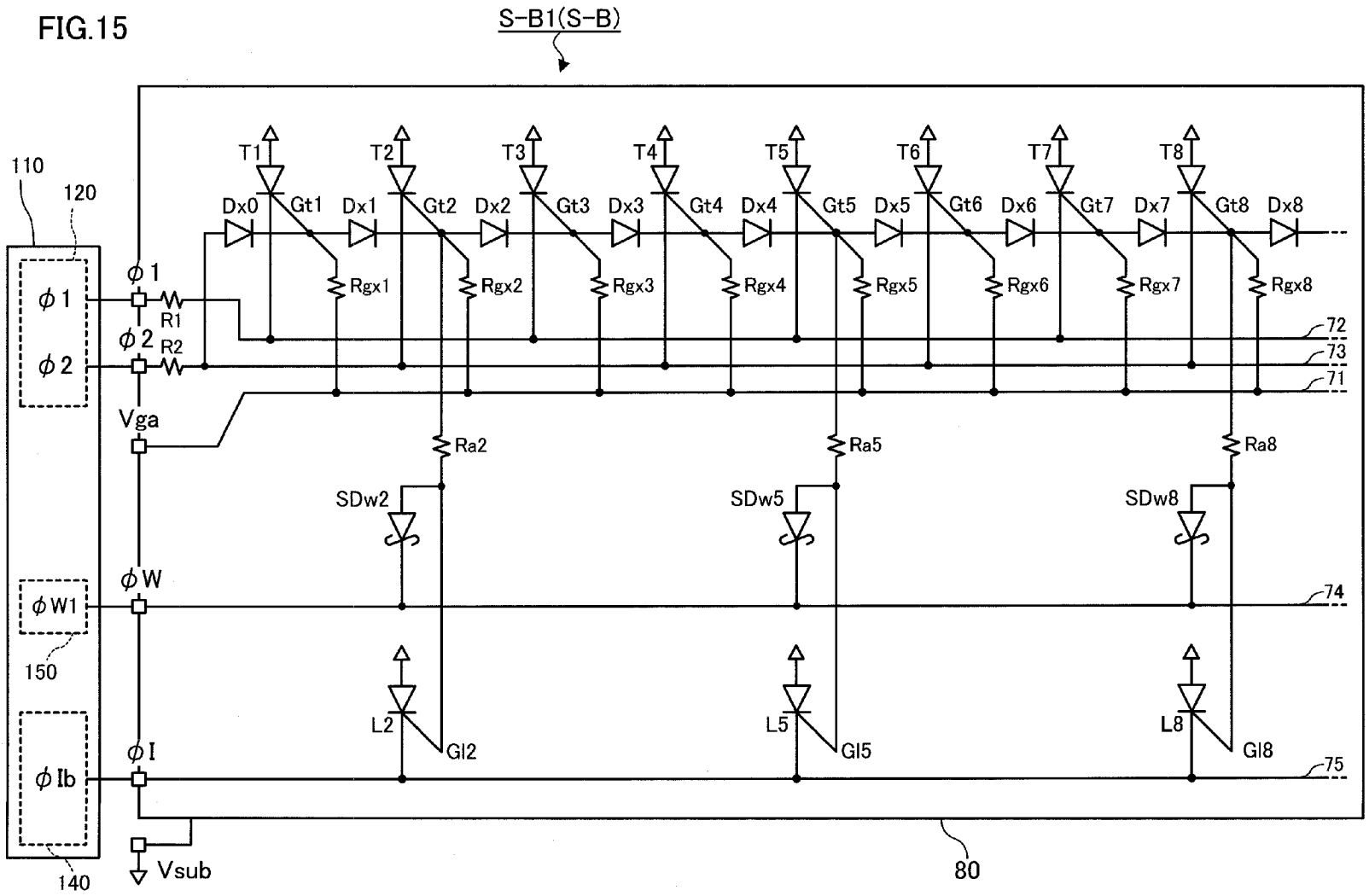
FIG. 15 is an equivalent circuit diagram for illustrating a circuit configuration of the light-emitting array unit in the third exemplary embodiment.

FIG. 15 is an equivalent circuit diagram for illustrating a circuit configuration of the light-emitting array unit S-B in the third exemplary embodiment. The light-emitting array unit S-B is a self-scanning light-emitting device array (SLED). Here, the light-emitting array unit S-B is described taking the light-emitting array unit S-B1 as an example. The light-emitting array unit S-B is thus called a light-emitting array unit S-B1(S-B) in FIG. 15.

As shown in FIG. 7, in the light-emitting array unit S-B in the first exemplary embodiment, the light-emitting thyristors L are provided for the respective (2n)-th transfer thyristors T (n is an integer of 1 or higher). In other words, the light-emitting thyristors L are provided for the respective even-numbered transfer thyristors T. In contrast, as shown in FIG. 15, in the light-emitting array unit S-B in the third exemplary embodiment, the light-emitting thyristors L are provided for the respective (3n−1)-th transfer thyristors T (n is an integer of 1 or higher). In other words, the light-emitting thyristor L is provided for every three transfer thyristors T. Configurations that are the same as those in FIGS. 6 and 7 are denoted by the same reference signs, and are not described in detail.

Note that, in the light-emitting array unit S-B1, the selection signal ϕW1 is sent to the ϕW terminal which is an example of the control terminal, and the light-up signal ϕIb is sent to the ϕI terminal.

Figure 16:
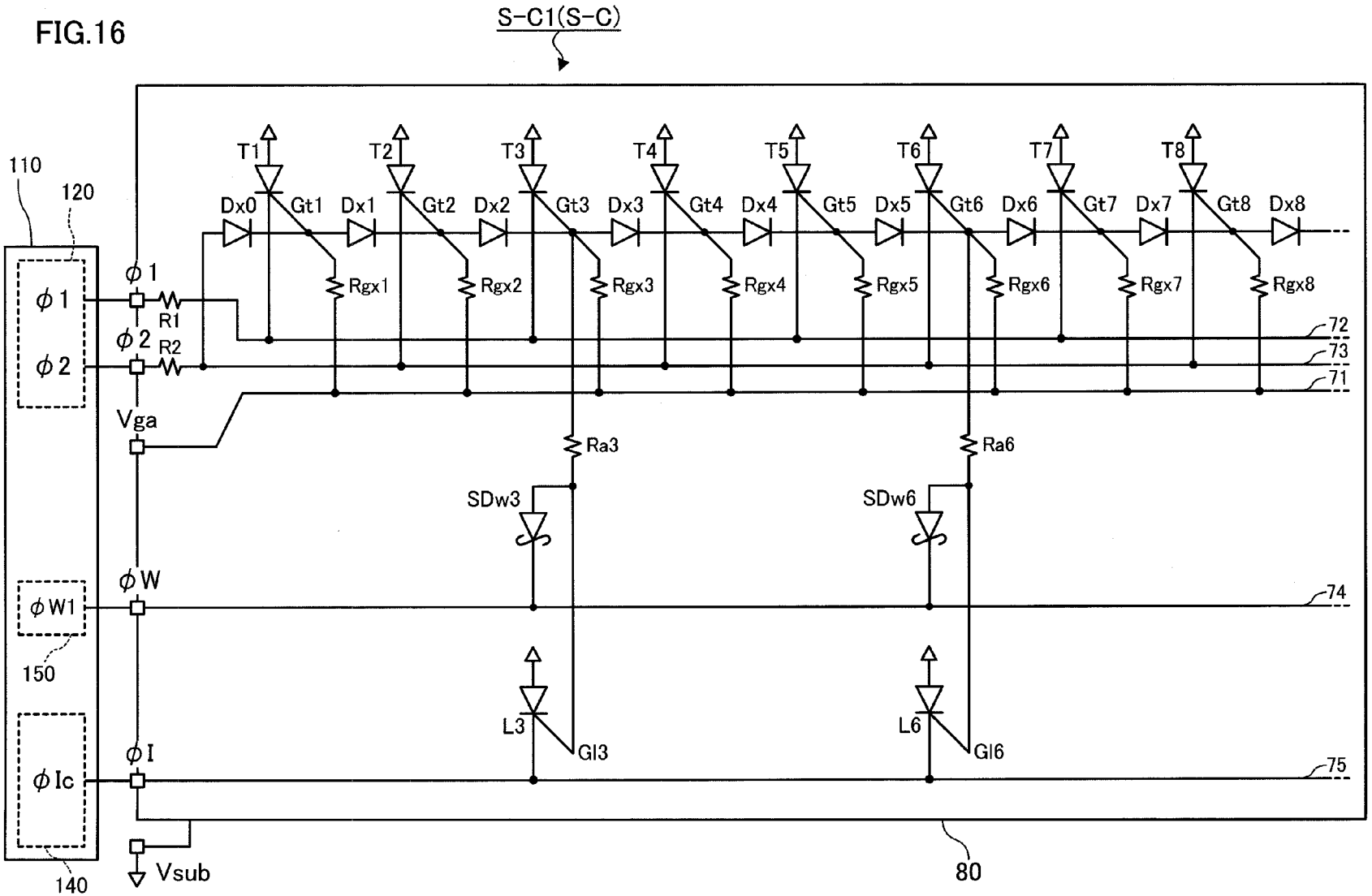
FIG. 16 is an equivalent circuit diagram for illustrating a circuit configuration of the light-emitting array unit in the third exemplary embodiment.

FIG. 16 is an equivalent circuit diagram for illustrating a circuit configuration of the light-emitting array unit S-C in the third exemplary embodiment. The light-emitting array unit S-C is a self-scanning light-emitting device array (SLED). Here, the light-emitting array unit S-C is described taking the light-emitting array unit S-C1 as an example. The light-emitting array unit S-C is thus called a light-emitting array unit S-C1(S-C) in FIG. 16.

As shown in FIG. 16, in the light-emitting array unit S-C in the third exemplary embodiment, the light-emitting thyristors L are provided for the respective (3n)-th transfer thyristors T (n is an integer of 1 or higher). In other words, the light-emitting thyristor L is provided for every three transfer thyristors T. Configurations that are the same as those in FIGS. 6 and 7 are denoted by the same reference signs, and are not described in detail.

Note that, in the light-emitting array unit S-C1, the selection signal ϕW1 is sent to the ϕW terminal which is an example of the control terminal, and the light-up signal ϕIc is sent to the ϕI terminal.

Figure 17:
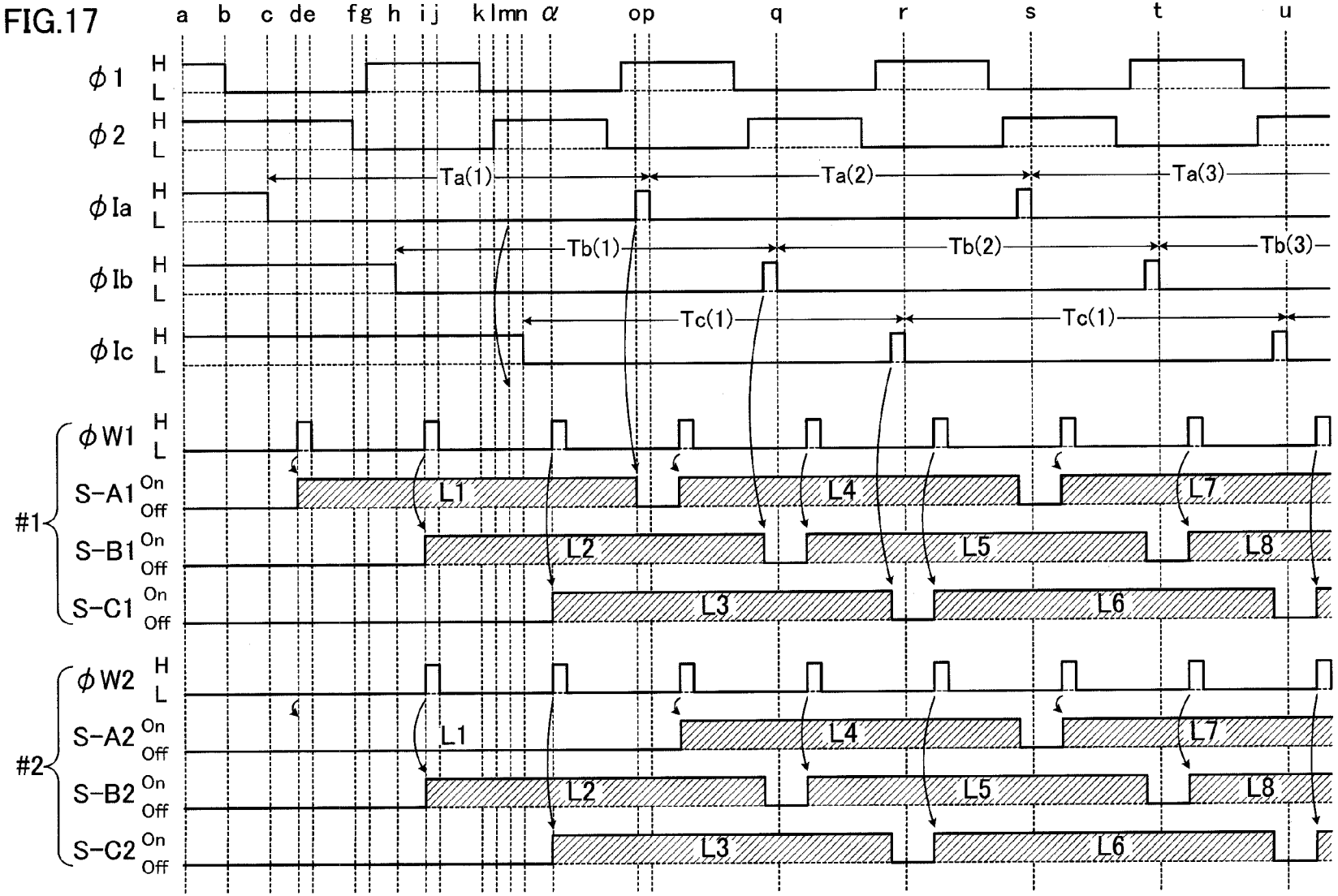
FIG. 17 is a timing chart for illustrating the operations of the light-emitting device and the light-emitting array units in the third exemplary embodiment.

FIG. 17 is a timing chart for illustrating the operations of the light-emitting device 65 and the light-emitting array units S-A, S-B, and S-C in the third exemplary embodiment. The time points a to u are the same as those in FIG. 9. Additionally, a time point a is provided between the time point n and the time point o.

The light-up signal ϕIc and the light-emitting array units S-C1 and S-C2 are added to the timing chart of the first exemplary embodiment shown in FIG. 9.

A period Ta(1) is from the time point c to the time point p, and is thus longer than the period Ta(1) of the first exemplary embodiment shown in FIG. 9. The same is true for the other periods. This is because three transfer thyristors T are turned on sequentially in one period T in the third exemplary embodiment.

The signal waveforms of the respective light-up signal ϕIa, ϕIb, and ϕIc are shifted from one another on the time axis by ⅓ of the period T.

At the time point a in which only the transfer thyristor T3 among the transfer thyristors T is in an ON state, the light-emitting thyristor L3 of the light-emitting array unit S-C1 is turned on and lights up (emits light) when the selection signal ϕW1 transitions from "L" (−3.3 V) to "H" (0 V).

The operations of the light-emitting device 65 and the light-emitting array unit S of the third exemplary embodiment are understandable from the description given for the first exemplary embodiment. A detailed description is therefore not given here.

Note that, although three light-emitting array unit groups are provided in the third exemplary embodiment, more light-emitting array unit groups may be provided.

Fourth Exemplary Embodiment

In the first exemplary embodiment, the light-up signal ϕIa is sent to the light-emitting array units S-A1 to S-A20 of the light-emitting array unit group #a, and the light-up signal ϕIb is sent to the light-emitting array units S-B1 to S-B20 of the light-emitting array unit group #b. In the fourth exemplary embodiment, the light-emitting array units S-A1 to S-A20 and the light-emitting array units S-B1 to S-B20 each includes the ϕI1 terminal and the ϕI2 terminal to which the light-up signal ϕIa and ϕIb are sent, respectively.

Figures 18A, 18B, 18C:
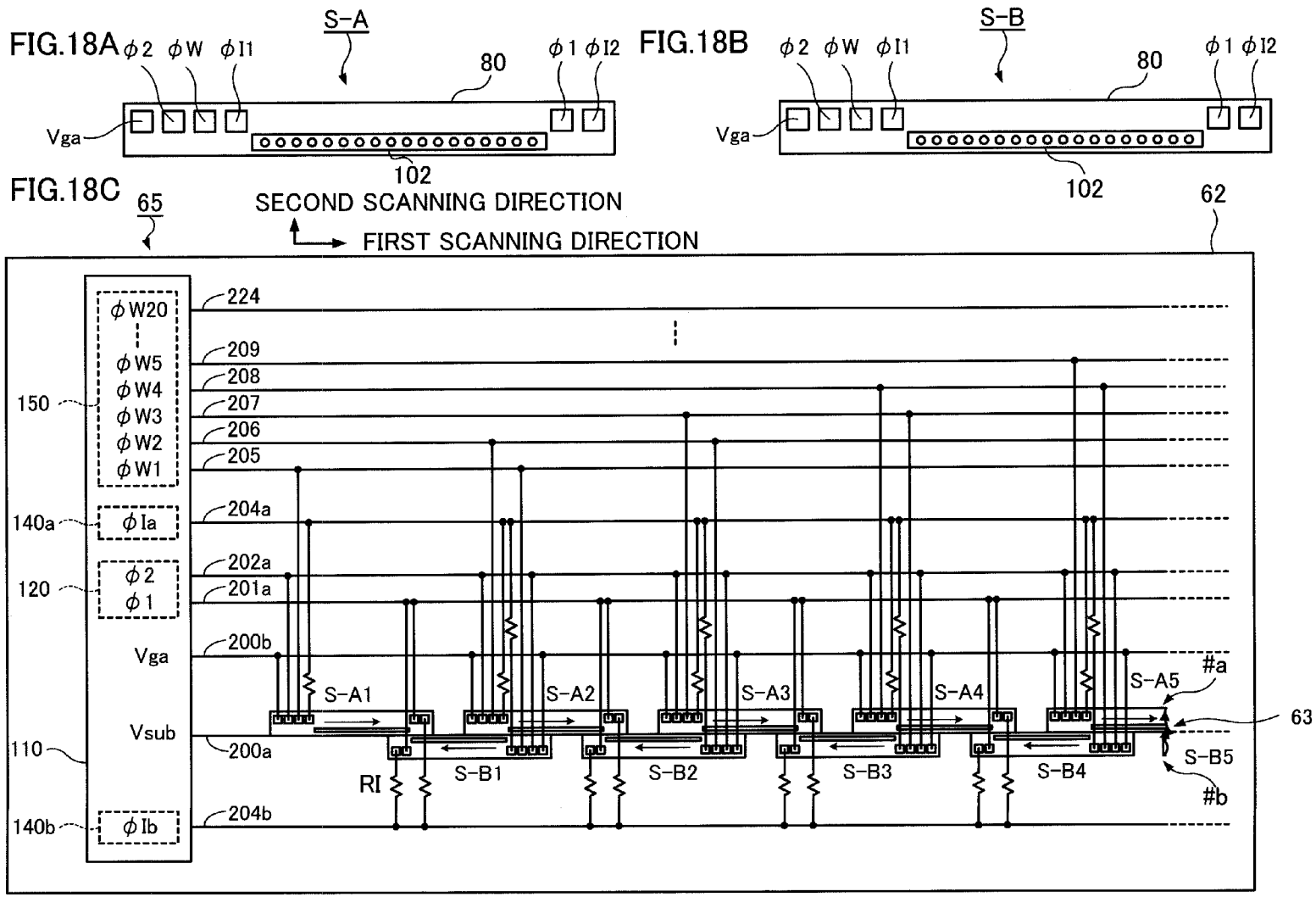
FIGS. 18A to 18C are diagrams showing configurations of the light-emitting array units, a configuration of the signal generating circuit of the light-emitting device, and a wiring configuration on the circuit board, in the fourth exemplary embodiment.

FIGS. 18A to 18C are diagrams showing configurations of the light-emitting array units S-A and S-B, a configuration of the signal generating circuit 110 of the light-emitting device 65, and a wiring configuration on the circuit board 62, in the fourth exemplary embodiment. Specifically, FIG. 18A shows a configuration of the light-emitting array unit S-A, and FIG. 18B shows a configuration of the light-emitting array unit S-B. FIG. 18C shows a configuration of the signal generating circuit 110 of the light-emitting device 65 and a wiring configuration on the circuit board 62. In the fourth exemplary embodiment, the light-emitting array units S-A1 to S-A20 and the light-emitting array units S-B1 to S-B20 are arranged on the circuit board 62.

A description is given of a configuration of the light-emitting array unit S-A shown in FIG. 18A and a configuration of the light-emitting array unit S-B shown in FIG. 18B. Note that configurations that are the same as those in FIGS. 4A and 4B are denoted by the same reference signs, and are not described in detail.

The light-emitting array units S-A and S-B each includes multiple input terminals (the Vga terminal, the ϕ2 terminal, the ϕW terminal, a ϕI1 terminal, the ϕ1 terminal, and a ϕI2 terminal) at both end portions, in the long-side direction, of the substrate 80. These input terminals are bonding pads for reading various control signals and the like. These input terminals are arranged in such a manner that the Vga terminal, the ϕ2 terminal, the ϕW terminal, and the ϕI1 terminal are arranged in this order from one end portion of the substrate 80, and the ϕI2 terminal and the ϕ1 terminal are arranged in this order from the other end of the substrate 80. The light-emitting element array 102 is provided between the ϕI1 terminal and the ϕ1 terminal.

As FIGS. 18A and 18B show, the light-emitting array unit S-A and the light-emitting array unit S-B have the same outer shape and configuration of the input terminals. However, as FIGS. 20 and 21 will show later, the light-emitting array units S-A and S-B have different circuit configurations.

Next, using FIG. 18C, a configuration of the signal generating circuit 110 of the light-emitting device 65 and a wiring configuration on the circuit board 62 are described.

The configuration of the signal generating circuit 110 is the same as that of the first exemplary embodiment, and therefore is not described in detail.

On the circuit board 62, the light-up signal line 204*a* for sending the light-up signal ϕIa from the light-up signal generating part 140*a* is connected to the ϕI1 terminals of the light-emitting array units S-A1 to S-A20 and the light-emitting array units S-B1 to S-B20. Accordingly, the light-up signal ϕIa is sent commonly to all of the light-emitting array units S-A1 to S-A20 and the light-emitting array units S-B1 to S-B20.

Likewise, the light-up signal line 204*b* for sending the light-up signal ϕIb from the light-up signal generating part 140*b* is connected to the ϕI2 terminal of each of the light-emitting array units S-A1 to S-A20 and the light-emitting array units S-B1 to S-B20. Accordingly, the light-up signal ϕIb is sent commonly to all of the light-emitting array units S-A1 to S-A20 and the light-emitting array units S-B1 to S-B20.

Figure 19:
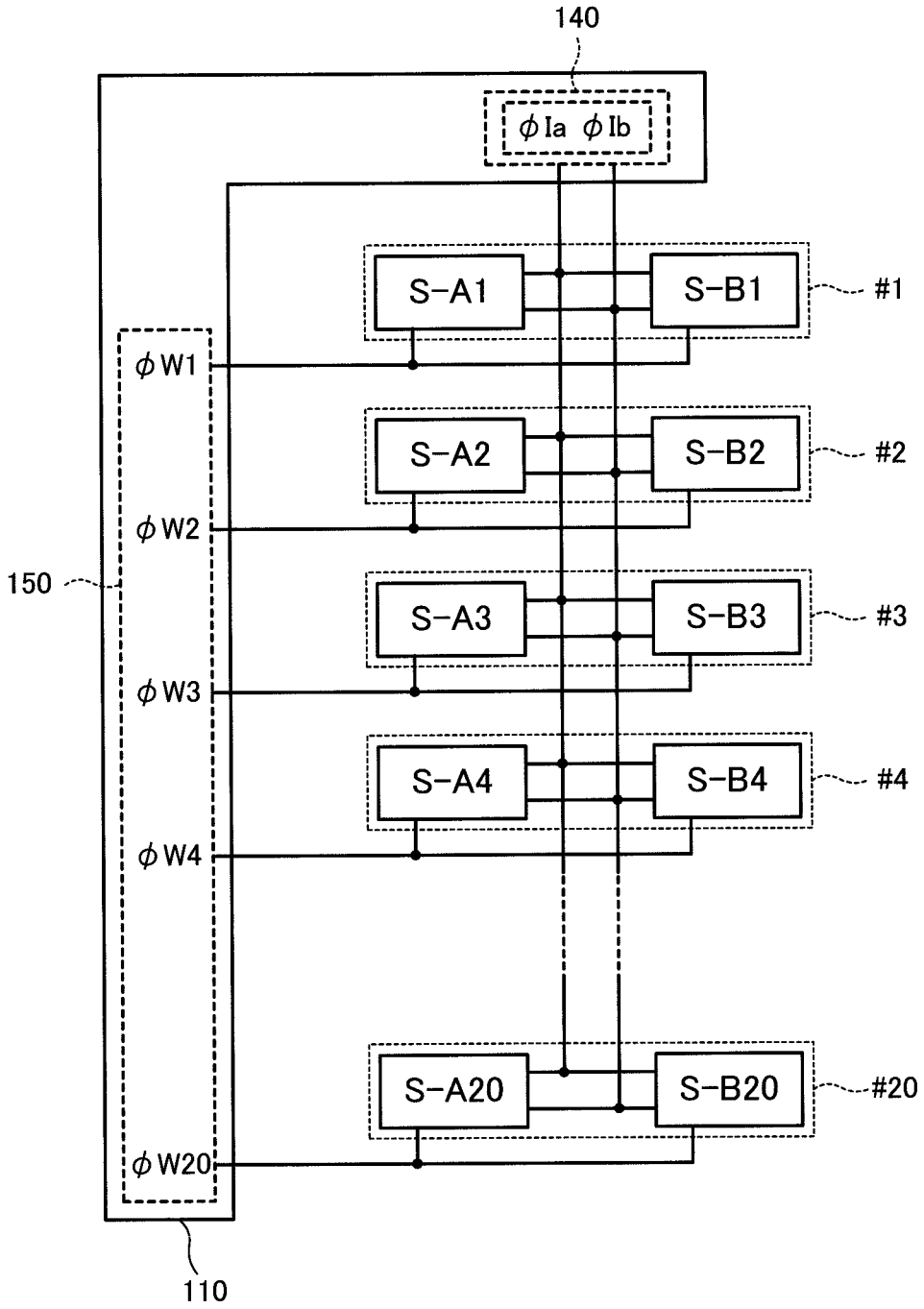
FIG. 19 is a diagram showing the light-emitting array units on the circuit board of the light-emitting device in the fourth exemplary embodiment, arranged as matrix elements.

FIG. 19 is a diagram showing the light-emitting array units S-A1 to S-A20 and light-emitting array units S-B1 to S-B20 on the circuit board 62 of the light-emitting device 65 in the fourth exemplary embodiment, arranged as matrix elements. In the first exemplary embodiment shown in FIG. 5, the light-up signal ϕIa is sent to the light-emitting array units S-A1 to S-A20, and the light-up signal ϕIb is sent to the light-emitting array units S-B1 to S-B20. However, in the fourth exemplary embodiment, the light-up signals ϕIa and ϕIb are sent commonly to the light-emitting array units S-A1 to S-A20 and the light-emitting array units S-B1 to S-B20.

The number of wirings in the fourth exemplary embodiment is the same as that in the first exemplary embodiment.

Figure 20:
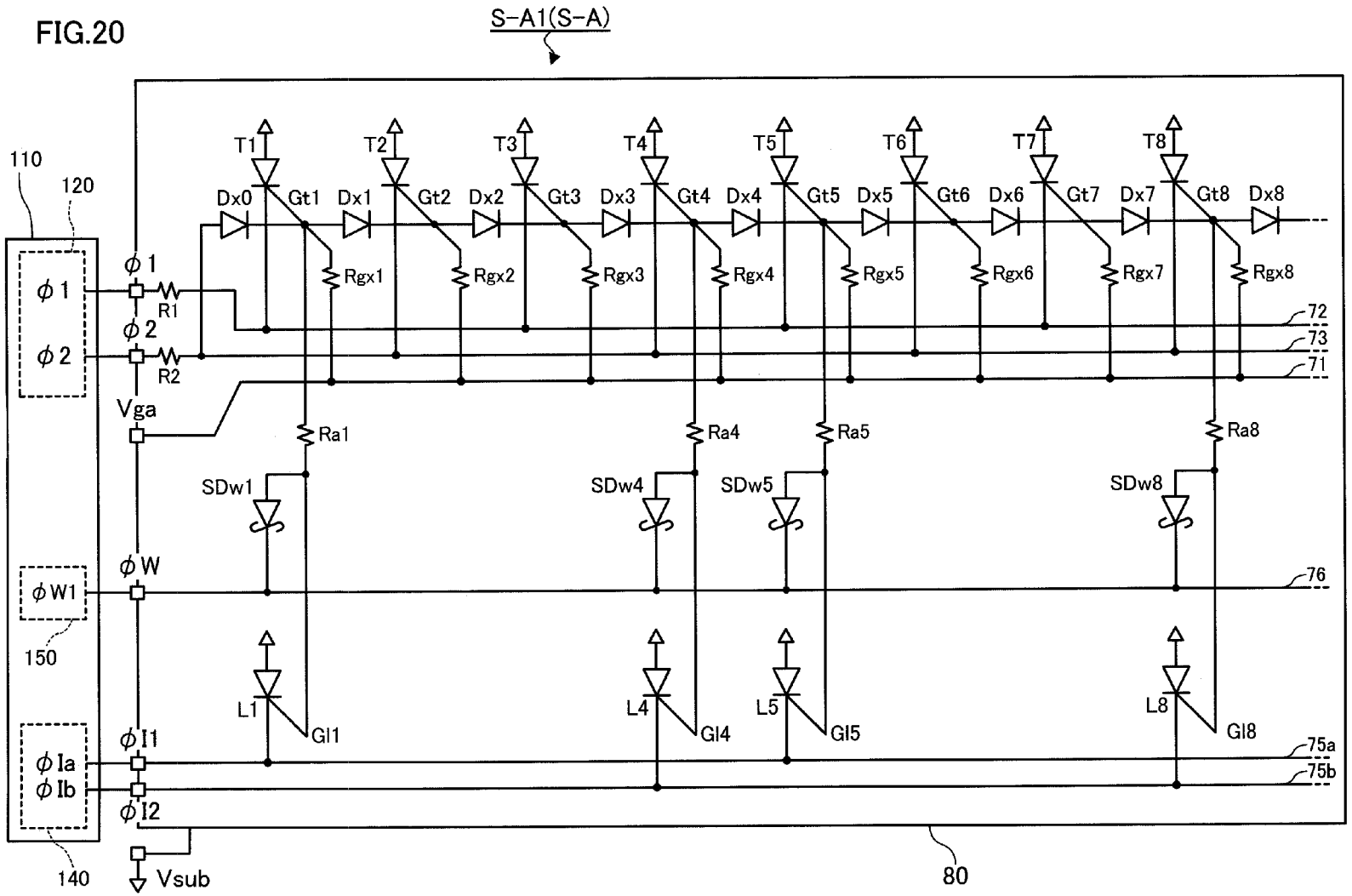
FIG. 20 is an equivalent circuit diagram for illustrating a circuit configuration of the light-emitting array unit in the fourth exemplary embodiment.

FIG. 20 is an equivalent circuit diagram for illustrating a circuit configuration of the light-emitting array unit S-A in the fourth exemplary embodiment. The light-emitting array unit S-A is a self-scanning light-emitting device array (SLED). Here, the light-emitting array unit S-A is described taking the light-emitting array unit S-A1 as an example. The light-emitting array unit S-A is thus called a light-emitting array unit S-A1(S-A) in FIG. 20.

As shown in FIG. 6, in the light-emitting array unit S-A in the first exemplary embodiment, the light-emitting thyristors L are provided for the respective (2n−1)-th transfer thyristors T (n is an integer of 1 or higher). In other words, the light-emitting thyristors L are provided for the respective odd-numbered transfer thyristors T. In contrast, as shown in FIG. 20, in the light-emitting array unit S-A of the fourth exemplary embodiment, the light-emitting thyristors L are provided for the transfer thyristors T whose number takes a remainder of 0 or 1 by division with 4. Specifically, the light-emitting thyristor L1 is provided for the transfer thyristor T1, and the light-emitting thyristor L4 is provided for the transfer thyristor T4. Moreover, the light-emitting thyristor L5 is provided for the transfer thyristor T5, and the light-emitting thyristor L8 is provided for the transfer thyristor T8. In other words, among four adjacent transfer thyristors T, the light-emitting thyristor L is provided for the leftmost transfer thyristor T and for the rightmost transfer thyristor T. Although a detailed description is not given below, the same is true for the ninth and higher thyristors.

Among the four adjacent transfer thyristors T, the cathode terminal of the leftmost transfer thyristor T is connected to a light-up signal line 75*a*, and the cathode terminal of the rightmost transfer thyristor T is connected to a light-up signal line 75*b*. The light-up signal line 75*a* is connected to the terminal ϕI1 to which the light-up signal ϕIa is sent. The light-up signal line 75*b* is connected to the terminal ϕI2 to which the light-up signal ϕIb is sent.

Other configurations are the same as those in the first exemplary embodiment. Accordingly, configurations that are the same as those in FIGS. 6 and 7 are denoted by the same reference signs, and are not described in detail.

Figure 21:
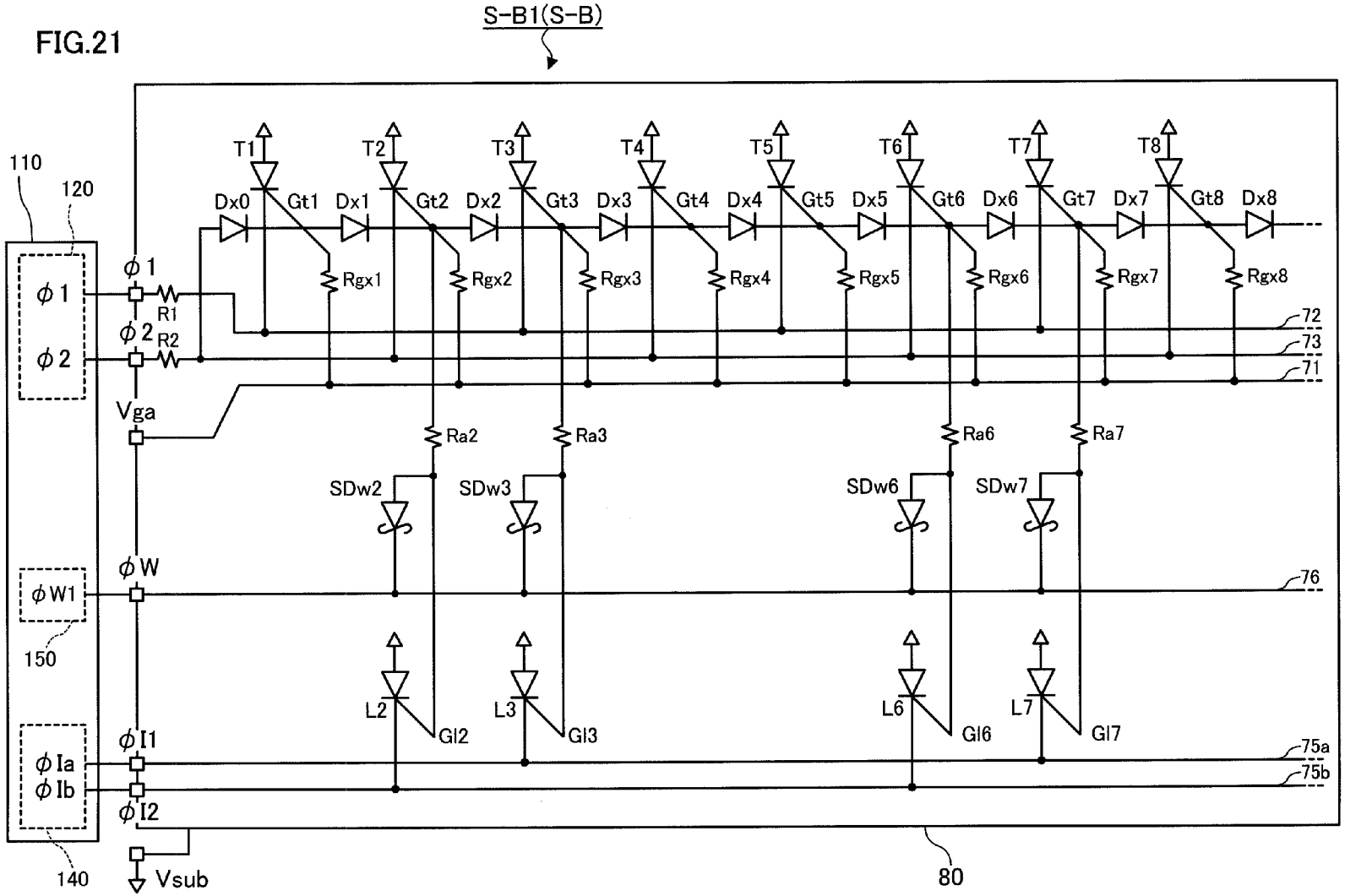
FIG. 21 is an equivalent circuit diagram for illustrating a circuit configuration of the light-emitting array unit in the fourth exemplary embodiment.

FIG. 21 is an equivalent circuit diagram for illustrating a circuit configuration of the light-emitting array unit S-B in the fourth exemplary embodiment. The light-emitting array unit S-B is a self-scanning light-emitting device array (SLED). Here, the light-emitting array unit S-B is described taking the light-emitting array unit S-B1 as an example. The light-emitting array unit S-B is thus called a light-emitting array unit S-B1(S-B) in FIG. 21.

As shown in FIG. 7, in the light-emitting array unit S-B in the first exemplary embodiment, the light-emitting thyristors L are provided for the respective 2n-th transfer thyristors T (n is an integer of 1 or higher). In other words, the light-emitting thyristors L are provided for the respective even-numbered transfer thyristors T. In contrast, as shown in FIG. 21, in the light-emitting array unit S-B of the fourth exemplary embodiment, the light-emitting thyristors L are provided for the transfer thyristors T whose number takes a remainder of 2 or 3 by division with 4. Specifically, the light-emitting thyristor L2 is provided for the transfer thyristor T2, and the light-emitting thyristor L3 is provided for the transfer thyristor T3. Moreover, the light-emitting thyristor L6 is provided for the transfer thyristor T6, and the light-emitting thyristor L7 is provided for the transfer thyristor T7. In other words, among four adjacent transfer thyristors T, the light-emitting thyristor L is provided for the two transfer thyristors T in the middle, namely, the second and third transfer thyristors T from left. Although a detailed description is not given below, the same is true for the ninth and higher thyristors.

Among the four adjacent transfer thyristors T, the cathode terminal of the transfer thyristor T which is second from the left is connected to the light-up signal line 75*b*, and the cathode terminal of the transfer thyristor T which is third from the left is connected to the light-up signal line 75*a*.

Other configurations are the same as those in the first exemplary embodiment. Accordingly, configurations that are the same as those in FIGS. 6 and 7 are denoted by the same reference signs, and are not described in detail.

In the fourth exemplary embodiment, the light-emitting thyristors L1, L5, . . . , in the light-emitting array unit S-A, whose cathode terminals are connected to the light-up signal ϕI1 and the light-emitting thyristors L3, L7, . . . , in the light-emitting array unit S-B, whose cathode terminals are connected to the light-up signal ϕI1 belong to a light-emitting array unit group #a. The light-emitting thyristors L4, L8, . . . , in the light-emitting array unit S-A, whose cathode terminals are connected to the light-up signal ϕI2 and the light-emitting thyristors L2, L6, . . . , in the light-emitting array unit S-B, whose cathode terminals are connected to the light-up signal ϕI2 belong to a light-emitting array unit group #b. Then, a light-emitting array unit class #1 is formed by the light-emitting thyristors L1, L5, . . . in the light-emitting array unit S-A and the light-emitting thyristors L3, L7, . . . in the light-emitting array unit S-B that belong to the light-emitting array unit group #a as well as the light-emitting thyristors L4, L8, . . . in the light-emitting array unit S-A and the light-emitting thyristors L2, L6, . . . in the light-emitting array unit S-B that belong to the light-emitting array unit group #b.

The same is true for the other light-emitting array unit classes #2 to #20.

The light-emitting device 65 and the light-emitting array units S-A and S-B in the fourth exemplary embodiment operate according to the timing chart of the first exemplary embodiment shown in FIG. 9. Accordingly, a detailed description is not given.

Note that, like the second exemplary embodiment, the light-emitting array units S-A and S-B of the fourth exemplary embodiment may be formed on the single substrate 80 so that the light-emitting array unit includes two self-scanning light-emitting device arrays (SLED).

Fifth Exemplary Embodiment

The fourth exemplary embodiment uses two types of light-emitting array units, the light-emitting array units S-A and S-B, having different circuit configurations. The fifth exemplary embodiment uses one type of light-emitting array, a light-emitting array unit S.

Figures 22A, 22B:
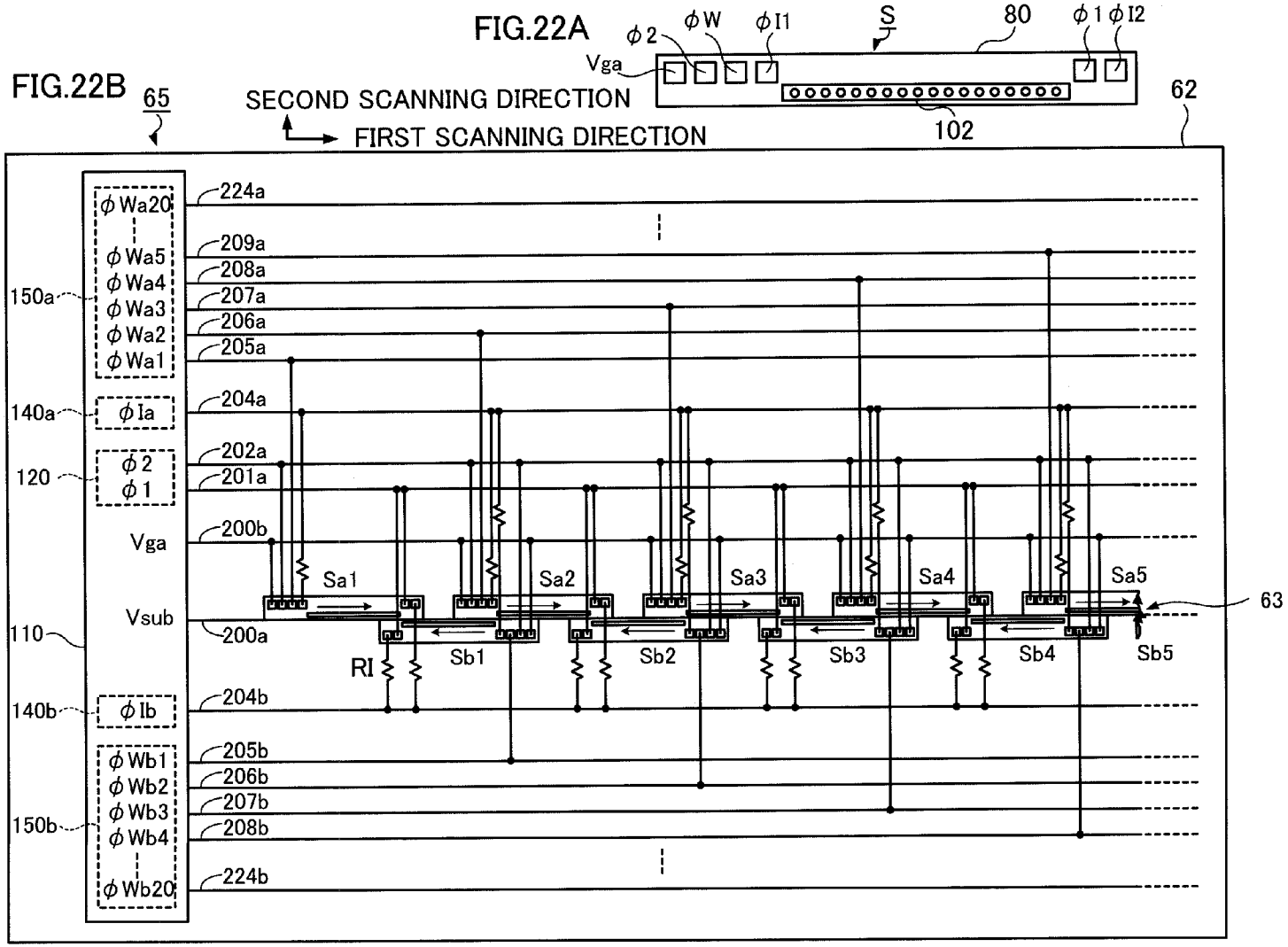
FIGS. 22A and 22B are diagrams showing a configuration of the light-emitting array unit, a configuration of the signal generating circuit of the light-emitting device, and a wiring configuration on the circuit board, in the fifth exemplary embodiment.

FIGS. 22A and 22B are diagrams showing a configuration of the light-emitting array unit S, a configuration of the signal generating circuit 110 of the light-emitting device 65, and a wiring configuration on the circuit board 62, in the fifth exemplary embodiment. FIG. 22A shows a configuration of the light-emitting array unit S, and FIG. 22B shows a configuration of the signal generating circuit 110 of the light-emitting device 65 and a wiring configuration on the circuit board 62.

The configuration of the light-emitting array unit S shown in FIG. 22A is what the ϕIl terminal and the ϕIr terminal of the light-emitting array unit S in the second exemplary embodiment shown in FIG. 10A are replaced with the ϕI1 terminal and the ϕI2 terminal, respectively.

Like the second exemplary embodiment, twenty light-emitting array units Sa1 to Sa20 and twenty light-emitting array units Sb1 to Sb20 are arranged on the circuit board 62 shown in FIG. 22B.

The configuration of the signal generating circuit 110 is what the light-up signal generating part 140*l*, the light-up signal ϕIl, the light-up signal generating part 140*r*, and the light-up signal ϕIr in the signal generating circuit 110 of the second exemplary embodiment shown in FIG. 10B are replaced with the light-up signal generating part 140*a*, the light-up signal ϕIa, the light-up signal generating part 140*b*, and the light-up signal ϕIb, respectively. The wiring configuration on the circuit board 62 is the same as that of the second exemplary embodiment shown in FIG. 10B.

The fourth exemplary embodiment uses two types of light-emitting array units S-A and S-B. The fifth exemplary embodiment only uses one type of light-emitting array, the light-emitting array unit S.

Accordingly, the number of wirings in the fifth exemplary embodiment is the same as that in the first and fourth exemplary embodiments.

Figure 23:
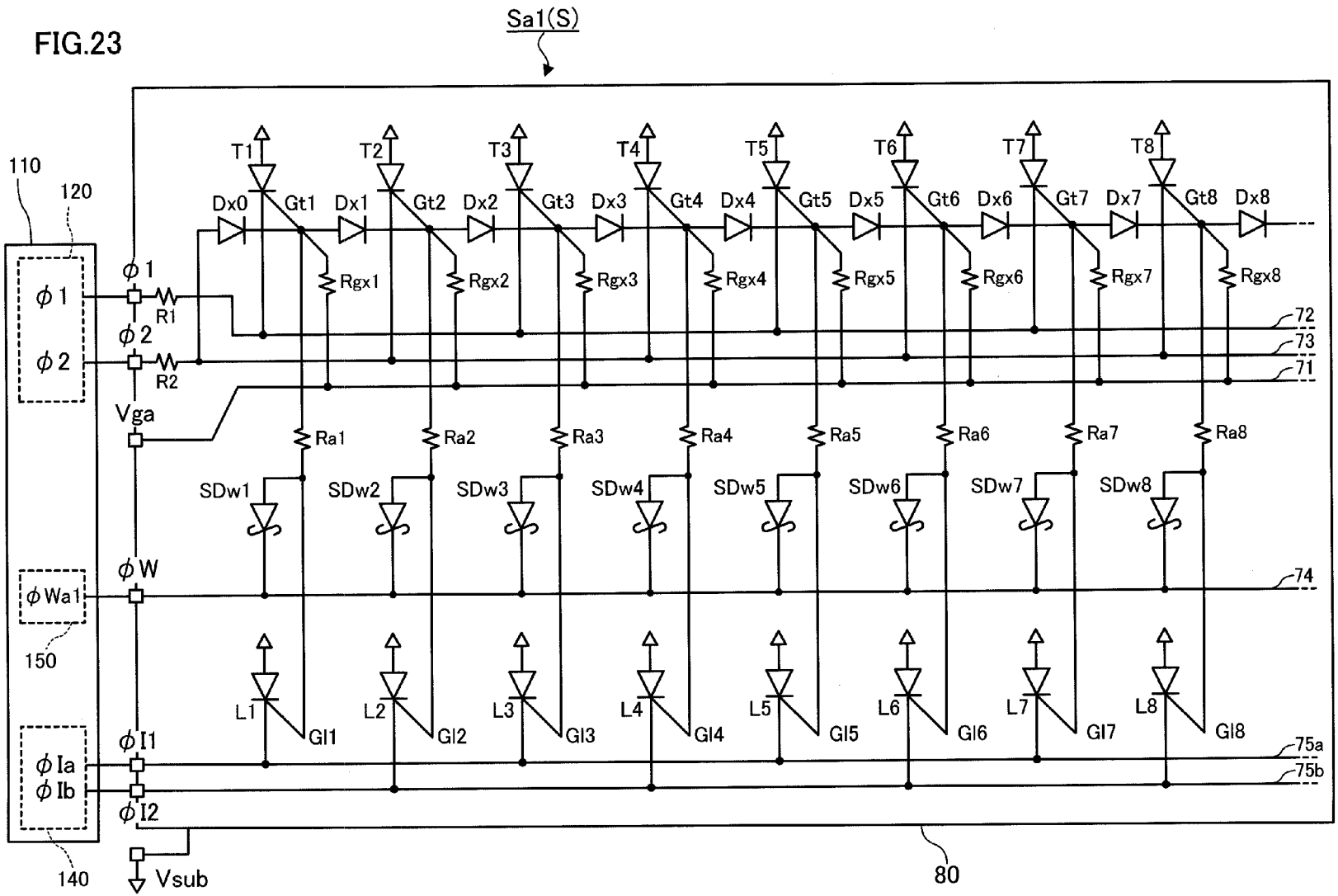
FIG. 23 is an equivalent circuit diagram for illustrating a circuit configuration of the light-emitting array unit in the fifth exemplary embodiment.

FIG. 23 is an equivalent circuit diagram for illustrating a circuit configuration of the light-emitting array unit S in the fifth exemplary embodiment. The light-emitting array unit S is a self-scanning light-emitting device array (SLED). Here, the light-emitting array unit S is described taking the light-emitting array unit Sa1 as an example. The light-emitting array unit S is thus called a light-emitting array unit Sa1(S) in FIG. 23.

As shown in FIG. 6, in the light-emitting array unit S-A of the first exemplary embodiment, the light-emitting thyristors L are provided for the respective (2n−1)-th transfer thyristors T (n is an integer of 1 or higher). In other words, the light-emitting thyristors L are provided for the respective odd-numbered transfer thyristors T. In contrast, as shown in FIG. 23, in the light-emitting array unit Sa1(S) of the fifth exemplary embodiment, the light-emitting thyristors L are provided for all of the transfer thyristors T.

The cathode terminals of the odd-numbered transfer thyristors T are connected to the light-up signal line 75*a*, and the cathode terminals of the even-numbered transfer thyristors T are connected to the light-up signal line 75*b*. The light-up signal line 75*a* is connected to the terminal ϕI1 to which the light-up signal ϕIa is sent. The light-up signal line 75*b* is connected to the terminal ϕI2 to which the light-up signal ϕIb is sent.

Configurations that are the same as those in FIGS. 6 and 7 are denoted by the same reference signs, and are not described in detail.

In the fifth exemplary embodiment, the light-emitting array unit group #a and the light-emitting array unit group #b are formed by the odd-numbered light-emitting thyristors L and the even-numbered light-emitting thyristors L, respectively, of the light-emitting array units Sa1 to Sa20 and the light-emitting array units Sb1 to Sb20.

Moreover, the odd-numbered light-emitting thyristors L and the even-numbered light-emitting thyristors L in each light-emitting array unit S form the class described in the first exemplary embodiment. In other words, the light-emitting array unit class #1 is formed by the light-emitting thyristors L1, L3, L5, . . . of the light-emitting array unit Sa1 and the light-emitting thyristors L2, L4, L6, . . . of the light-emitting array unit Sa1. Accordingly, it may be considered in such a way that the light-emitting array unit including the light-emitting thyristors L 1, L3, L5, . . . forming the light-emitting array unit class #1 and the light-emitting array unit including the light-emitting thyristors L2, L4, L6, . . . forming the light-emitting array unit class #2 are superimposed.

The same is true for the other pairs. There are twenty classes in the first exemplary embodiment. In the fifth exemplary embodiment, there are forty classes since one light-emitting array unit S forms a pair.

Figure 24:
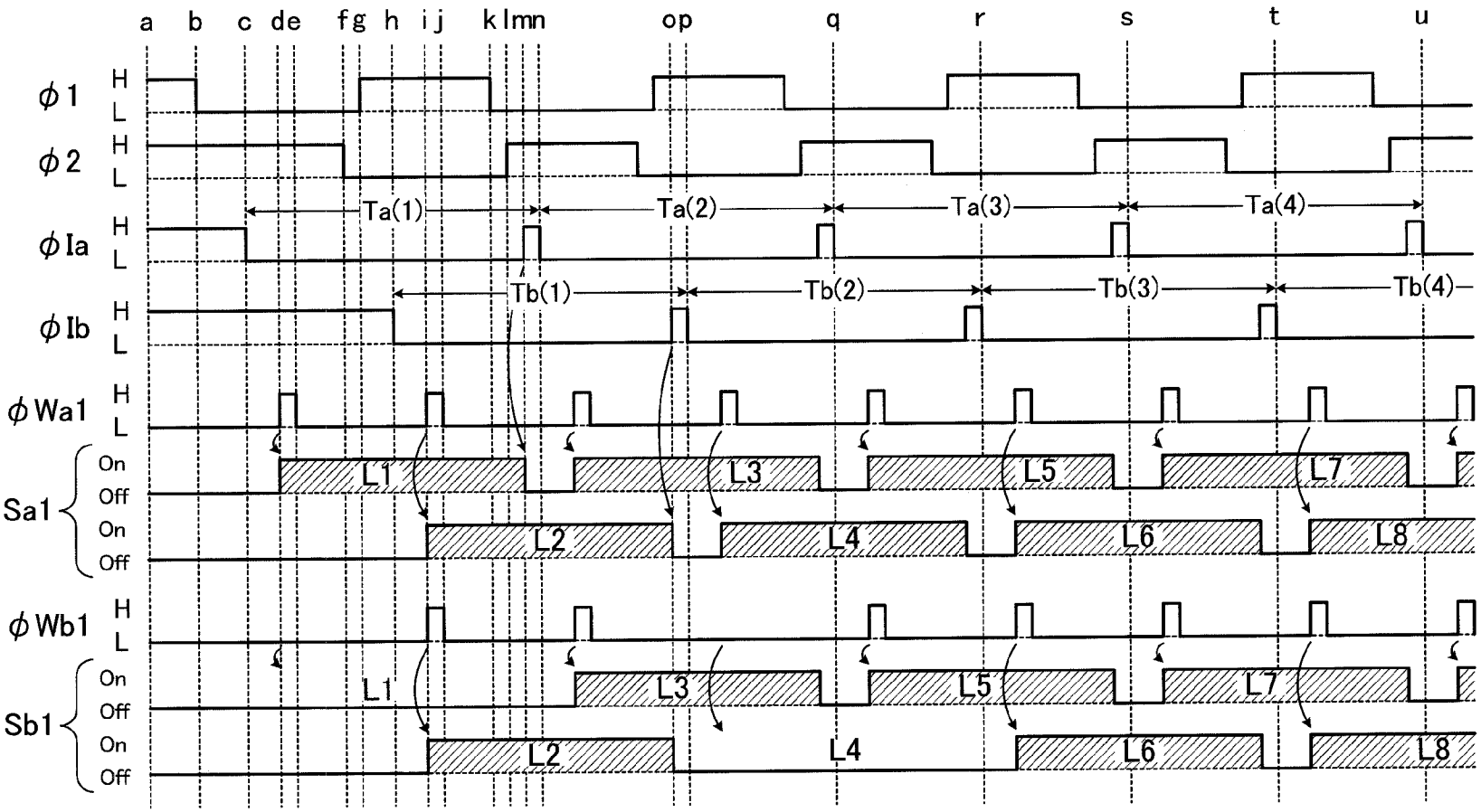
FIG. 24 is a timing chart for illustrating the operations of the light-emitting device and the light-emitting array unit in the fifth exemplary embodiment.

FIG. 24 is a timing chart for illustrating the operations of the light-emitting device 65 and the light-emitting array unit S in the fifth exemplary embodiment. The time points a to u are the same as those in FIG. 9.

Note that FIG. 24 shows a part for light-controlling the light-emitting thyristors L1 to L8 of the light-emitting array units Sa1 and Sb1. Accordingly, in the light-emitting array unit Sa1, all of the light-emitting thyristors L1 to L8 are to be lighted up. In the light-emitting array unit Sb1, on the other hand, the light-emitting thyristors L2, L3, L5, L6, L7, and L8 are to be lighted up, and the light-emitting thyristors L1 and L4 are to be kept unlighted.

The operations of the light-emitting device 65 and the light-emitting array units Sa1 to Sa20 and the light-emitting array units Sb1 to Sb20 are the same as those in the first exemplary embodiment, and are therefore not described in detail.

In the first to fifth exemplary embodiments, the transfer thyristors T are driven with two-phase signals: the first transfer signal ϕ1 and the second transfer signal ϕ2. Alternatively, the transfer thyristors T may be driven by sending three-phase signals for every three transfer thyristors T. Similarly, the transfer thyristors T may be driven by sending four-phase (or more) signals.

Further, in the first to fifth exemplary embodiments, the coupling diodes Dx are used as the first electrical parts. Alternatively, each of the first electrical parts may be a different element, such as a resistor, which causes a change in potential of one of its terminals to change the potential of the other one of the terminals.

Furthermore, each of the connection resistors Ra is used as the second electrical part. Alternatively, the second electrical part may be a different element, such as a diode, which causes a potential drop.

Similarly, although each of the Schottky write diodes SDw is used as the third electrical part, the third electrical part may be a different element, such as a diode or a resistor, which causes a change in potential of one of its terminals to change the potential of the other one of the terminals.

Moreover, although described as having 128 light-emitting thyristors L, the light-emitting array unit may have any number of light-emitting thyristors L.

Further, the number of light-emitting array units forming a light-emitting array unit group and the number of light light-emitting array units forming another light-emitting array unit group are the same in the first to fifth exemplary embodiments, but may be different. In addition, light-emitting array units forming a light-emitting array unit class belong to different light-emitting array unit groups, but the light-emitting array unit class may include light-emitting array units belonging to the same light-emitting array unit group. In this case, the light-emitting array units belonging to the same light-emitting array unit group are light-controlled in parallel.

Furthermore, in the first to fifth exemplary embodiments, the thyristors (the transfer thyristors T and the light-emitting thyristors L) are described as having common anode, where their anode terminals are connected to the substrate 80. Alternatively, by changing the polarity of the circuit, the thyristors (the transfer thyristors T and the light-emitting thyristors L) may have common cathode, where their cathode terminals are connected to the substrate 80.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. Alight-emitting device comprising:

a plurality of light-emitting array units that each include a plurality of light-emitting elements, and for which lighting up and not lighting up are controlled by using a combination of a selection signal for selecting a control target for lighting up or not lighting up and a light-up signal for supplying power for lighting up to each light-emitting element forming the plurality of light-emitting elements;

a selection signal generating unit that sends a plurality of selection signals including the selection signal to the plurality of light-emitting array units;

a light-up signal generating unit that sends a plurality of light-up signals including the light-up signal to the plurality of light-emitting array units;

a plurality of transfer elements that are respectively provided for the plurality of light-emitting elements; and a plurality of AND circuits each provided between one of the plurality of light-emitting elements and one of the plurality of transfer elements that are provided corresponding to the one of the light-emitting elements, each of the AND circuits receiving input of the selection signal and a signal from the one of the plurality of transfer elements and outputting a signal to the one of the plurality of light-emitting elements.

2. The light-emitting device according to claim 1, wherein the plurality of selection signals are sent respectively on a one-to-one basis for a plurality of classes formed by dividing the plurality of light-emitting array units.

3. The light-emitting device according to claim 2, wherein each of the plurality of selection signals is sent in a temporal sequence to the light-emitting array units included in a corresponding one of the plurality of classes.

4. The light-emitting device according to claim 3, wherein the plurality of light-up signals are provided respectively on a one-to-one basis for a plurality of groups formed by dividing the plurality of light-emitting array units.

5. The light-emitting device according to claim 2, wherein the plurality of light-up signals are provided respectively on a one-to-one basis for a plurality of groups formed by dividing the plurality of light-emitting array units.

6. The light-emitting device according to claim 1, wherein the plurality of light-up signals are provided respectively on a one-to-one basis for a plurality of groups formed by dividing the plurality of light-emitting array units.

7. The light-emitting device according to claim 1, further wherein plurality of transfer elements send a transfer signal for sequentially setting the plurality of light-emitting elements included in each of the plurality of light-emitting array units, as a control target for lighting up or not lighting up.

8. A light-emitting array unit comprising:

a plurality of light-emitting elements;

a plurality of transfer elements that are respectively provided for the plurality of light-emitting elements, and that sequentially set a light-emitting element forming the plurality of light-emitting elements, as a control target for lighting up or not lighting up;

a control terminal through which a selection signal is received to control whether or not to light up the light-emitting element set as the control target;

a light-up signal terminal through which a light-up signal is received to supply power for lighting up to the light-emitting element set as the control target;

a plurality of AND circuits each provided between one of the plurality of light-emitting elements and one of the plurality of trannsfer elements that is provided corresponding the one of the light-emitting elements, each of the AND circuits receiving input of the selection signal sent to the control terminal and a signal from the one of the plurality of transfer elements and outputting a signal to the one of the plurality of light-emitting elements.

9. The light-emitting array unit according to claim 8, wherein the plurality of transfer elements in the light-emitting array unit are a plurality of transfer thyristors each having a first gate terminal, a first anode terminal and a first cathode terminal, and the plurality of light-emitting elements are a plurality of light-emitting thyristors each having a second gate terminal, a second anode terminal and a second cathode terminal, the light-emitting array unit further comprising a plurality of first electrical parts that each connect two of the first gate terminals of the plurality of transfer thyristors to one another.

10. The light-emitting array unit according to claim 9, wherein each of the plurality of AND circuits in the light-emitting array unit includes:

a second electrical part that is connected, at one end, to the first gate terminal of a corresponding one of the transfer thyristors and is connected, at an opposite end, to the second gate terminal of a corresponding one of the light-emitting thyristors; and a third electrical part that is provided between the control terminal and the second gate terminal of the corresponding one of the light-emitting thyristors.

11. A print head comprising:

an exposure unit that exposes an image carrier to form an electrostatic latent image; and an optical unit that focuses light emitted by the exposure unit on the image carrier, the exposure unit including:

a plurality of light-emitting array units that each include a plurality of light-emitting elements, and for which lighting up and not lighting up are controlled by using a combination of a selection signal for selecting a control target for lighting up or not lighting up and a light-up signal for supplying power for lighting up to each light-emitting element forming the plurality of light-emitting elements;

a selection signal generating unit that sends a plurality of selection signals including the selection signal to the plurality of light-emitting array units;

a light-up signal generating unit that sends a plurality of light-up signals including the light-up signal to the plurality of light-emitting array units;

a plurality of transfer elements that are respectively provided for the plurality of light-emitting elements; and a plurality of AND circuits each provided between one of the plurality of light-emitting elements and one of the plurality of transfer elements that are provided corresponding to the one of the light-emitting elements, each of the AND circuits receiving input of the selection signal and a signal from the one of the plurality of transfer elements and outputting a signal to the one of the plurality of light-emitting elements.

12. An image forming apparatus comprising:

a charging unit that charges an image carrier;

an exposure unit that exposes the image carrier to form an electrostatic latent image;

an optical unit that focuses light emitted by the exposure unit on the image carrier;

a developing unit that develops the electrostatic latent image formed on the image carrier; and a transfer unit that transfers an image developed on the image carrier to a transferred body, the exposure unit including:

a plurality of light-emitting array units that each include a plurality of light-emitting elements, and for which lighting up and not lighting up are controlled by using a combination of a selection signal for selecting a control target for lighting up or not lighting up and a light-up signal for supplying power for lighting up to each light-emitting element forming the plurality of light-emitting elements;

a selection signal generating unit that sends a plurality of selection signals including the selection signal to the plurality of light-emitting array units;

a light-up signal generating unit that sends a plurality of light-up signals including the light-up signal to the plurality of light-emitting array units;

a plurality of transfer elements that are respectively provided for the plurality of light-emitting elements; and a plurality of AND circuits each provided between one of the plurality of light-emitting elements and one of the plurality of transfer elements that are provided corresponding to the one of the light-emitting elements, each of the AND circuits receiving input of the selection signal and a signal from the one of the plurality of transfer elements and outputting a signal to the one of the plurality of light-emitting elements.

13. A light-emission control method for a plurality of light-emitting array units that each include a plurality of light-emitting elements, a plurality of transfer elements that are respectively provided for the plurality of light-emitting elements, a plurality of AND circuits each provided between one of the plurality of light-emitting elements and one of the plurality of transfer elements that are provided corresponding to the one of the light-emitting elements, and for which lighting up and not lighting up are controlled by using a combination of a selection signal for selecting a control target for lighting up or not lighting up and a light-up signal for supplying power for lighting up to each light-emitting element forming the plurality of light-emitting elements, the light-emission control method comprising:

sending a plurality of selection signals including the selection signal, on a one-to-one basis, respectively to a plurality of classes formed by dividing the plurality of light-emitting array units; and sending a plurality of light-up signals including the light-up signal, on a one-to-one basis, respectively to a plurality of groups formed by dividing the plurality of light-emitting array units; and receiving an input of the selection signal and a signal from the one of the plurality of transfer elements at each of the AND circuits and outputting a signal to the one of the plurality of light-emitting elements.

* * * * *